US007075504B2

(12) United States Patent
Tokunaga et al.

(10) Patent No.: US 7,075,504 B2
(45) Date of Patent: Jul. 11, 2006

(54) DISPLAY DEVICE HAVING UNIT LIGHT EMISSION REGION WITH DISCHARGE CELLS AND CORRESPONDING DRIVING METHOD

(75) Inventors: Tsutomu Tokunaga, Yamanashi (JP); Nobuhiko Saegusa, Yamanashi (JP); Kazuo Yahagi, Yamanashi (JP); Mitsushi Kitagawa, Yamanashi (JP); Ryo Suzue, Yamanashi (JP); Eishiro Otani, Yamanashi (JP); Yoichi Sato, Yamanashi (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 300 days.

(21) Appl. No.: 10/242,666

(22) Filed: Sep. 13, 2002

(65) Prior Publication Data

US 2003/0067425 A1 Apr. 10, 2003

(30) Foreign Application Priority Data

Sep. 14, 2001 (JP) ..... 2001-279504
Jun. 7, 2002 (JP) ..... 2002-167802
Jun. 27, 2002 (JP) ..... 2002-187466

(51) Int. Cl.
*G09G 3/28* (2006.01)

(52) U.S. Cl. ..... 345/66; 345/208

(58) Field of Classification Search ..... 345/60, 345/61, 62, 63, 66, 208; 315/169.4, 169.3, 315/169.1, 169.2; 313/585, 586, 587, 584
See application file for complete search history.

(56) References Cited

U.S. PATENT DOCUMENTS 4,109,181 A * 8/1978 Murase et al. ..... 345/61
5,446,344 A * 8/1995 Kanazawa ..... 315/169.4
5,663,741 A * 9/1997 Kanazawa ..... 345/66
6,084,558 A * 7/2000 Setoguchi et al. ..... 345/60

(Continued)

FOREIGN PATENT DOCUMENTS

EP 1 041 600 A1 10/2000

(Continued)

*Primary Examiner*—Kent Chang
(74) *Attorney, Agent, or Firm*—Sughrue Mion, PLLC

(57) ABSTRACT

A plasma display panel capable of improving dark contrast. A unit light emission region is comprised of a display discharge cell in which a discharge is produced between portions of row electrodes X, Y of each row electrode pair (X, Y) opposing each other, and a reset and address discharge cell arranged in parallel with the display discharge cell, in which a discharge is produced between portions of the row electrode Y and a row electrode X of another adjacent row electrode pair (X, Y). The display discharge cell and reset and address discharge cell are communicated with each other. A light absorbing layer is formed in a portion of the reset and address discharge cell opposing the display surface. According to another aspect, the unit light emission region in the display panel comprises a first discharge cell and a second discharge cell comprising a light absorbing layer. A sustain discharge for emitting light for displaying an image is produced in the first discharge cell, while a variety of control discharges causing light emission not associated with a displayed image are produced in the second discharge cell. According to a further aspect, unit light emission regions are formed at intersections of each of a plurality of first row electrodes and second row electrodes alternately formed on the front substrate such that the first row electrode and the second electrode in each pair are arranged in a reverse order to the preceding pair, and each of a plurality of column electrodes.

20 Claims, 41 Drawing Sheets

U.S. PATENT DOCUMENTS

2001/0011871 A1 8/2001 Amemiya et al.

FOREIGN PATENT DOCUMENTS

EP 1 276 131 A2 1/2003
EP 1 326 263 A2 7/2003
EP 1381061 * 1/2004
EP 1 326 263 A3 9/2005
JP 08-162026 6/1996

* cited by examiner

FIG .30

| | DRIVING PATTERN | | | | | | | | | |
|---|---|---|---|---|---|---|---|---|---|---|
| | SF 1 | SF 2 | SF 3 | SF 4 | SF 5 | SF 6 | ~ | SF (N-2) | SF (N-1) | SF (N) |
| 1 | | | | | | | | | | |
| 2 | ◎ | | | | | | | | | |
| 3 | ◎ | ◎ | | | | | | | | |
| 4 | ◎ | ◎ | ◎ | | | | | | | |
| ~ | | ~ | | | | | | | | |
| N-1 | ◎ | ◎ | ◎ | ◎ | ◎ | ◎ | | ◎ | | |
| N | ◎ | ◎ | ◎ | ◎ | ◎ | ◎ | ~ | ◎ | ◎ | |
| N+1 | ◎ | ◎ | ◎ | ◎ | ◎ | ◎ | | ◎ | ◎ | ◎ |

FIG. 31

| | DRIVING PATTERN | | | | | | | | | |
|---|---|---|---|---|---|---|---|---|---|---|
| | SF 1 | SF 2 | SF 3 | SF 4 | SF 5 | SF 6 | ~ | SF (N-2) | SF (N-1) | SF (N) |
| 1 | ● | | | | | | | | | |
| 2 | ○ | ● | | | | | | | | |
| 3 | ○ | ○ | ● | | | | | | | |
| 4 | ○ | ○ | ○ | ● | | | | | | |
| ~ | | | ~ | | | | | | | |
| N-2 | ○ | ○ | ○ | ○ | ○ | ○ | | ● | | |
| N-1 | ○ | ○ | ○ | ○ | ○ | ○ | | ○ | ● | |
| N | ○ | ○ | ○ | ○ | ○ | ○ | ~ | ○ | ○ | ● |
| N+1 | ○ | ○ | ○ | ○ | ○ | ○ | | ○ | ○ | ○ |

BLACK CIRCLE : ADDRESS DISCHARGE (SELECTIVE ERASURE DISCHARGE)

WHITE CIRCLE : LIGHT EMISSION

DISPLAY DEVICE HAVING UNIT LIGHT EMISSION REGION WITH DISCHARGE CELLS AND CORRESPONDING DRIVING METHOD

BACKGROUND OF THE INVENTION

1. Field of the Invention

The present invention relates to a display device using a display panel, a structure of the display panel, and a method of driving the display panel.

2. Description of Related Art

In recent years, plasma display devices using a surface discharge type AC plasma display panel are drawing attention as a large-size and thin-shape color display panel.

FIGS. 1–3 are diagrams showing portions of the structure of a conventional surface discharge type AC plasma display panel.

The plasma display panel (PDP) has a structure for producing a discharge in each pixel between a front glass substrate 1 and a back glass substrate 4 arranged in parallel with each other. The surface of the front glass substrate 4 serves as a display surface. On the back side of the front glass substrate 1, a plurality of longitudinal row electrode pairs (X', Y'), a dielectric layer 2 covering the row electrode pairs (X', Y'), and a protection layer 3 made of MgO and covering the back side of the dielectric layer 2 are provided in order. Each row electrode X', Y' comprises a transparent electrode Xa', Ya' formed of a wide transparent conductive film such as ITO; and a bus electrode Xb', Yb' formed of a narrow metal film for compensating the transparent electrode for the conductivity. The row electrodes X', Y' are arranged alternately in the vertical direction of the display screen so as to be opposed to each other across a discharge gap g'. Each row electrode pair (X', Y') comprises one display line (row) L of a matrix display. The back glass substrate 4 is provided with a plurality of column electrodes D' arranged in a direction perpendicular to the row electrode pairs X', Y'; a strip-shaped partitions 5 formed respectively in parallel with one another between the column electrodes D'; and a fluorescent layer 6 formed of read (R), green (G), and blue (B) fluorescent materials for covering the side surfaces of the partitions 5 and the column electrodes D'. Between the protection layer 3 and fluorescent layer 6, a discharge space S' is formed and filled with an Ne—Xe gas containing, for example, 5 vol % of Xenon. Each display line L includes discharge cells C' as unit light emission regions at intersections of the column electrodes D' and row electrodes pairs (X', Y'), defined by the partitions 5 in the discharge space S'.

To form images on the surface discharge type AC PDP, a so-called subfield method is employed as a method of displaying a halftone image, wherein one field display period is divided into N subfields, in each of which light is emitted a specified number of times corresponding to a weighting of each bit digit of N-bit display data.

In the subfield method, each subfield divided from one field display period consists of a simultaneous reset period Rc, an address period Wc, and a sustain period Ic, as shown in FIG. 4. In the simultaneous reset period Rc, reset pulses RPx, RPy are simultaneously applied between the row electrodes X1'–Xn' and Y1'–Yn' which form pairs to simultaneously produce a reset discharge in all discharge cells, thereby once forming a predetermined amount of wall charge in each discharge cell. In the next address period Wc, the row electrodes $Y_1'$–$Y_n'$ of the row electrode pairs are sequentially applied with a scanning pulse SP, while the column electrodes $D_1'$–$D_m'$ are applied with display data pulses $DP_1$–$DP_n$ corresponding to display data for each display line of an image to produce an address discharge (selective erasure discharge). In this event, the discharge cells are divided into a light emission cell in which no erasure discharge is produced so that the wall charge remains formed therein, and a non-light emission cell in which the erasure discharge is produced to extinguish the wall charge, corresponding to image data of the image. In the next sustain period Ic, sustain pulses IPx, IPy are applied to the row electrodes $X_1'$–$X_n'$ and $Y_1'$–$Y_n'$ which form pairs, a specified number of times corresponding to a weighting of each subfield. In this manner, only light emission cells in which the wall charges remain repeat sustain discharges a number of times corresponding to the number of applied sustain pulses IPx, IPy. This sustain discharge causes Xenon Xe filled in the discharge space S' to radiate vacuum ultraviolet rays at wavelength of 147 nm. The vacuum ultraviolet rays excite the red (R), green (G), and blue (B) fluorescent layers formed on the back substrate to generate visible light to produce an image corresponding to an input video signal.

In the formation of an image on the PDP, a reset discharge is produced before the start of the address discharge and sustain discharge for stabilizing these discharges, as described above. The address discharge is also produced in each subfield. In the conventional PDP, the reset discharge and address discharge are produced by the sustain discharge in the discharge cells C' for generating visible light for image formation.

Therefore, light emitted by the reset discharge and address discharge appear on the display surface of the panel to make the screen bright even when a dark image such as a black image is displayed, resulting in a degradation in dark contrast in some cases.

OBJECT AND SUMMARY OF THE INVENTION

The present invention has been made to solve the above problem, and it is an object of the invention to provide a display device and a method of driving a display panel which are capable of improving the dark contrast.

A plasma display panel according to a first aspect of the present invention includes a plurality of row electrode pairs, each of which forms a display line, extending in a row direction and arranged in parallel in a column direction on a back side of a front substrate; a dielectric layer for covering the row electrode pairs; and a plurality of column electrodes extending in the column direction and arranged in parallel in the row direction on a side of a back substrate opposing the front substrate through a discharge space, wherein each column electrode includes a unit light emission region in the discharge space at a position at which the column electrode intersects with each row electrode pair, the unit light emission region includes a first discharge region for producing a discharge between portions of a first row electrode and a second row electrode constituting each row electrode pair and opposing each other, and a second discharge region arranged in parallel with the first discharge region for producing a discharge between portions of the second row electrode of the row electrode pair and a first row electrode of another row electrode pair adjacent to the second row electrode, the first discharge region and the second discharge region of the unit light emission region are in communication with each other, and a light absorbing layer is formed in a portion on the back side of the front substrate opposing the second discharge region.

In the plasma display panel according to the first aspect of the present invention, the unit light emission region is divided into the first discharge region and the second discharge region, so that the second discharge region can be used to produce therein a discharge which does not emit light directly contributing to the formation of an image, for example, a discharge (reset discharge) for forming wall charges on dielectric layers in all the unit light emission regions, or for erasing the wall charges on the dielectric layers, and a discharge (address discharge) for selectively erasing wall charges formed on dielectric layers of the unit light emission regions or for selectively forming wall charges on the dielectric layers.

Specifically, the reset discharge is produced in the second discharge region by applying a voltage between one second row electrode of each row electrode pair opposing in a portion opposing the second discharge region and the other first row electrode of an adjacent row electrode pair, and charged particles generated by the reset discharge are introduced from the second discharge region into the first discharge region forming part of the same unit light emission region communicated to the second discharge region to form a wall charge on a portion of the dielectric layer opposing the first discharge region or to erase a wall charge formed on the dielectric layer.

Also, an address discharge is produced in the second discharge region by selectively applying a voltage between one second row electrode of a row electrode pair and a column electrode opposing across the second discharge region, and charged particles generated by the address discharge are introduced from the second discharge region into the first discharge region forming part of the same unit light emission region communicated to the second discharge region to selectively erase a wall charge formed on a portion of the dielectric layer opposing the first discharge region or to selectively form a wall charge on the dielectric layer.

The surface of the second discharge region close to the display surface is covered with the light absorbing layer, so that the light absorbing layer blocks light emitted by a discharge produced in the second discharge region which does not directly contribute to the formation of an image, thereby preventing the light from leaking to the display surface of the front substrate.

As described above, according to the first aspect of the present invention, the unit light emission region is formed with the first discharge region in which a discharge (sustain discharge) is produced for emitting light contributing to the formation of an image, and the second discharge region, separate from the first discharge region, which is communicated to the first discharge region and has the surface close to the display surface shielded by the light absorbing layer, so that a discharge which does not emit light directly contributing to the formation of the image can be produced in the second discharge region, and therefore light emitted by the discharge which does not emit light directly contributing to the formation of image is shielded from the display surface of the panel, thereby preventing the image plane from becoming bright due to the discharge which does not emit light directly contributing to the formation of image such as a reset discharge, an address discharge, and the like, to permit an improvement in the dark contrast of the plasma display panel.

A display device according to another aspect of the present invention is provided for displaying an image corresponding to an input video signal in accordance with pixel data of each pixel based on the input video image. The display device includes a display panel having a front substrate and a back substrate opposing each other across a discharge space, a plurality of row electrode pairs arranged on an inner surface of the front substrate, a plurality of column electrodes arranged on an inner surface of the back substrate to intersect with the row electrode pairs, and an unit light emission region formed at each of intersections of the row electrode pairs and the column electrodes and including a first discharge cell and a second discharge cell having a light absorbing layer; addressing means for sequentially applying a scanning pulse to one row electrode of each row electrode pair while sequentially applying each column electrode with pixel data pulses corresponding to the pixel data one display line by one display line at the same timing as the scanning pulse to selectively produce an address discharge in the second discharge cell to set the first discharge cell to one of a lit cell state and an unlit cell state; and sustaining means for repeatedly applying a sustain pulse to each row electrode pair to produce a sustain discharge only in the first discharge cell set in the lit cell state.

A method of driving a display panel according to the present invention is provided for driving a display panel having a front substrate and a back substrate opposing each other across a discharge space, a plurality of row electrode pairs arranged on an inner surface of the front substrate, a plurality of column electrodes arranged on an inner surface of the back substrate to intersect with the row electrode pairs, and an unit light emission region formed at each of intersections of the row electrode pairs and the column electrodes and including a first discharge cell and a second discharge cell having a light absorbing layer, in accordance with pixel data of each pixel based on an input video signal. The method includes an address stage for sequentially applying a scanning pulse to one row electrode of each row electrode pair while sequentially applying each column electrode with pixel data pulses corresponding to the pixel data one display line by one display line at the same timing as the scanning pulse to selectively produce an address discharge in the second discharge cell to set the first discharge cell to one of a lit cell state and an unlit cell state; and a sustain stage for repeatedly applying a sustain pulse to each row electrode pair to produce a sustain discharge only in the first discharge cell set in the lit cell state.

A display device according to a further aspect of the present invention is provided for displaying an image corresponding to an input video signal in accordance with pixel data of each pixel based on the input video image. The display device includes a display panel having a front substrate and a back substrate opposing each other across a discharge space, a plurality of first row electrodes and second row electrodes alternately formed on the front substrate such that the first row electrode and the second electrode in each pair are arranged in a reverse order to the preceding pair, a plurality of column electrodes arranged on the back substrate to intersect with the first row electrode and the second row electrode, and an unit light emission region formed at each of intersections of the first row electrodes and the second row electrodes and the column electrodes and including a first discharge cell and a second discharge cell having a light absorbing layer; addressing means for sequentially applying a scanning pulse to each second row electrode while sequentially applying each column electrode with pixel data pulses corresponding to the pixel data one display line by one display line at the same timing as the scanning pulse to selectively produce an address discharge in the second discharge cell to set the first discharge cell to one of a lit cell state and an unlit cell state; and sustaining means for alternately and repeatedly applying a sustain pulse to each of the first row electrode and the second row electrode to produce a sustain discharge only in the first discharge cell set in the lit cell state.

A method of driving a display panel according to another aspect of the present invention is provided for driving a display panel having a front substrate and a back substrate opposing each other across a discharge space, a plurality of first row electrodes and second row electrodes alternately formed on the front substrate such that the first row electrode and the second electrode in each pair are arranged in a reverse order to the preceding pair, a plurality of column electrodes arranged on the back substrate to intersect with the first row electrode and the second row electrode, and an unit light emission region formed at each of intersections of the first row electrodes and the second row electrodes and the column electrodes and including a first discharge cell and a second discharge cell having a light absorbing layer, in accordance with pixel data of each pixel based on an input video signal. The method includes an address stage for sequentially applying a scanning pulse to each second row electrode while sequentially applying each column electrode with pixel data pulses corresponding to the pixel data one display line by one display line at the same timing as the scanning pulse to selectively produce an address discharge in the second discharge cell to set the first discharge cell to one of a lit cell state and an unlit cell state; and a sustain stage for alternately and repeatedly applying a sustain pulse to each of the first row electrode and the second row electrode to produce a sustain discharge only in the first discharge cell set in the lit cell state.

BRIEF DESCRIPTION OF THE DRAWINGS

FIG. 30 is a diagram showing an example of a driving pattern in each field when the selective write address method is employed to drive the PDP 50 to provide (N+1) levels of gradation;

FIG. 31 is a diagram showing an example of a driving pattern in each field when the selective erasure address method is employed to drive the PDP 50 to provide (N+1) levels of gradation;

DETAILED DESCRIPTION OF PREFERED EMBODIMENTS

Figure 1:
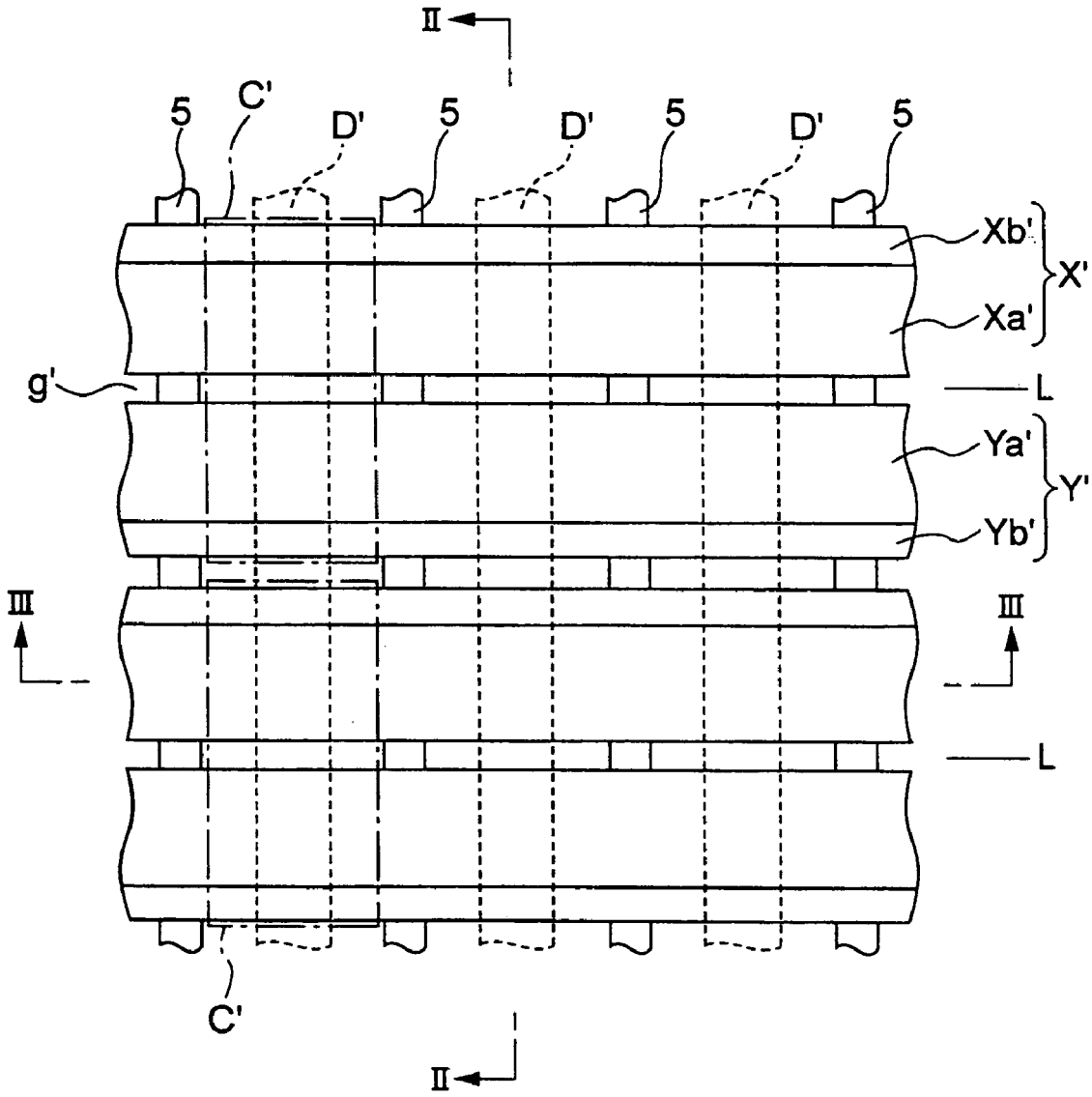
FIG. 1 PRIOR ART
FIG. 1 is a diagram showing a portion of the structure of a conventional surface discharge type AC plasma display panel.
Figure 2:
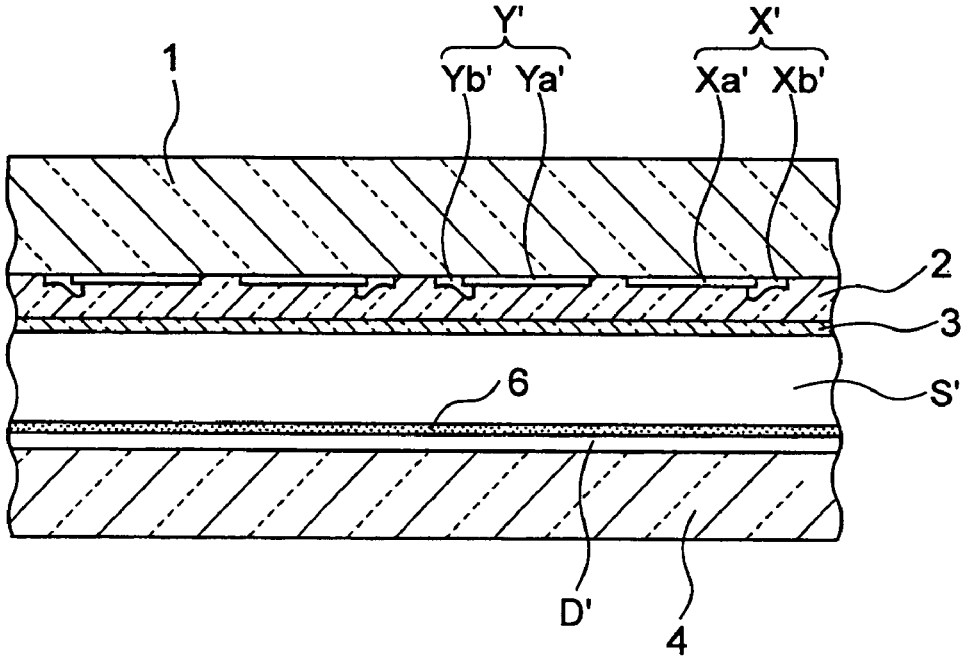
FIG. 2 PRIOR ART
FIG. 2 is a cross-sectional view taken along a line II—II in FIG. 1.
Figure 3:
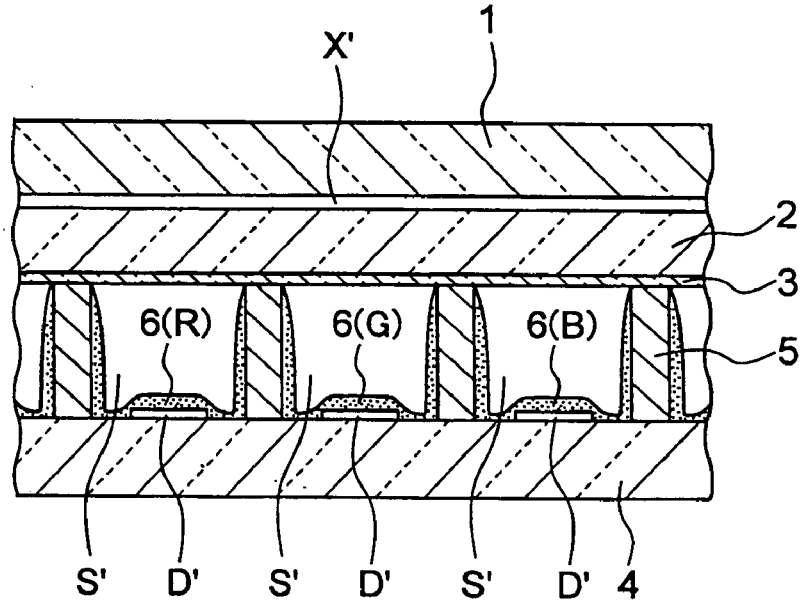
FIG. 3 PRIOR ART
FIG. 3 is a cross-sectional view taken along a line III—III in FIG. 1.
Figure 4:
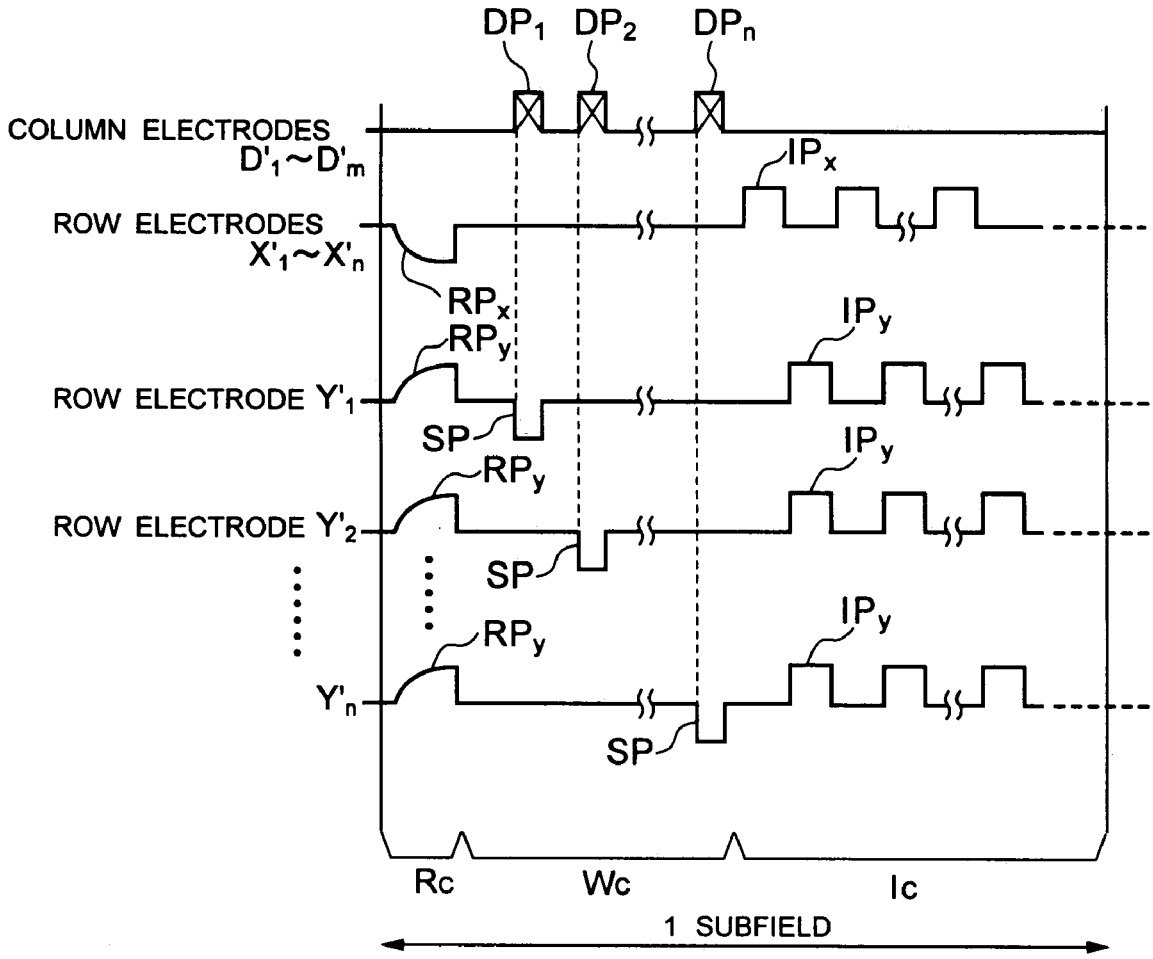
FIG. 4 is a diagram showing a variety of driving pulses applied to a plasma display panel in one subfield, and timings at which the driving pulses are applied.
Figure 5:
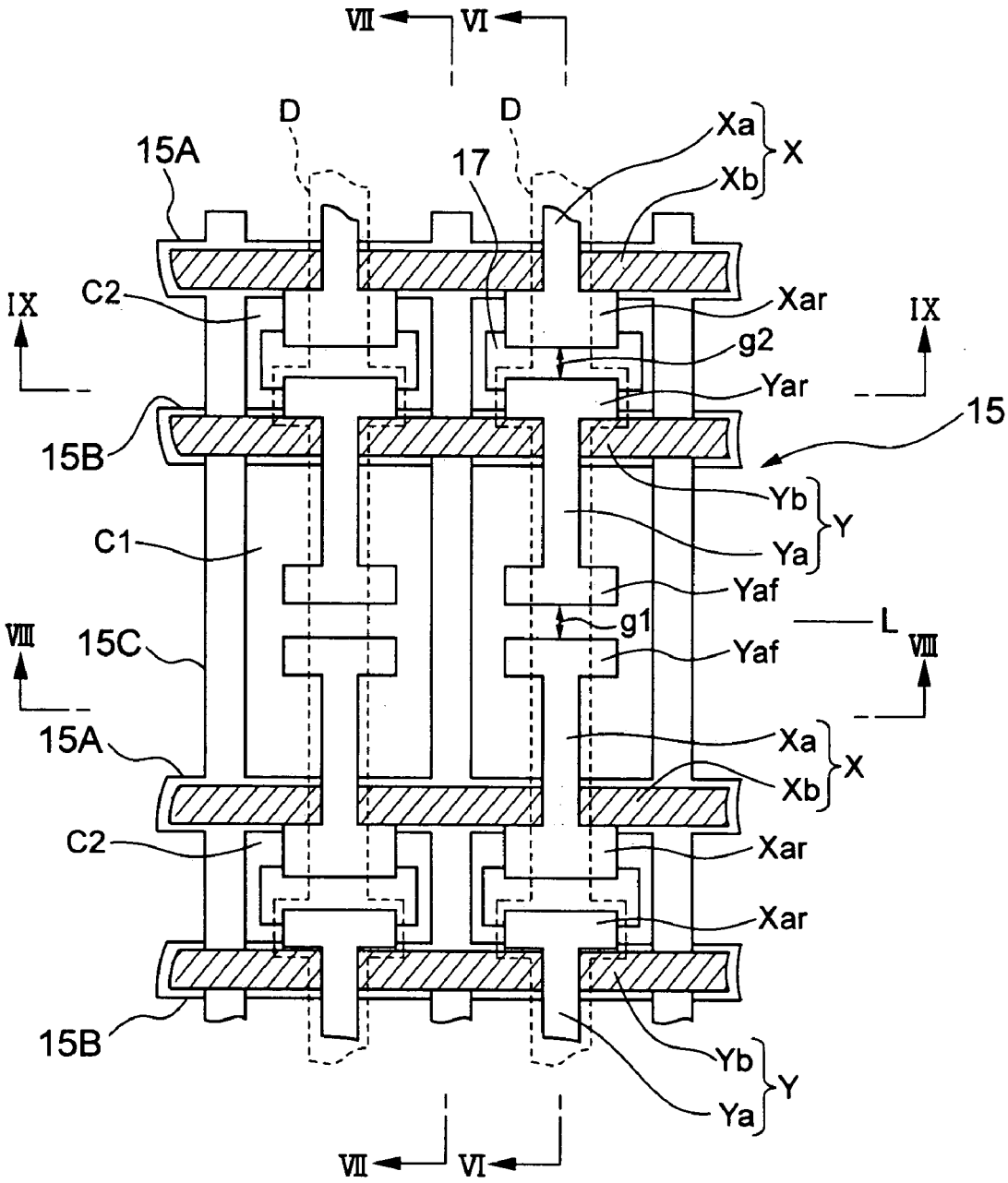
FIG. 5 is a front view schematically showing one embodiment of a plasma display panel according to the present invention.
Figure 6:
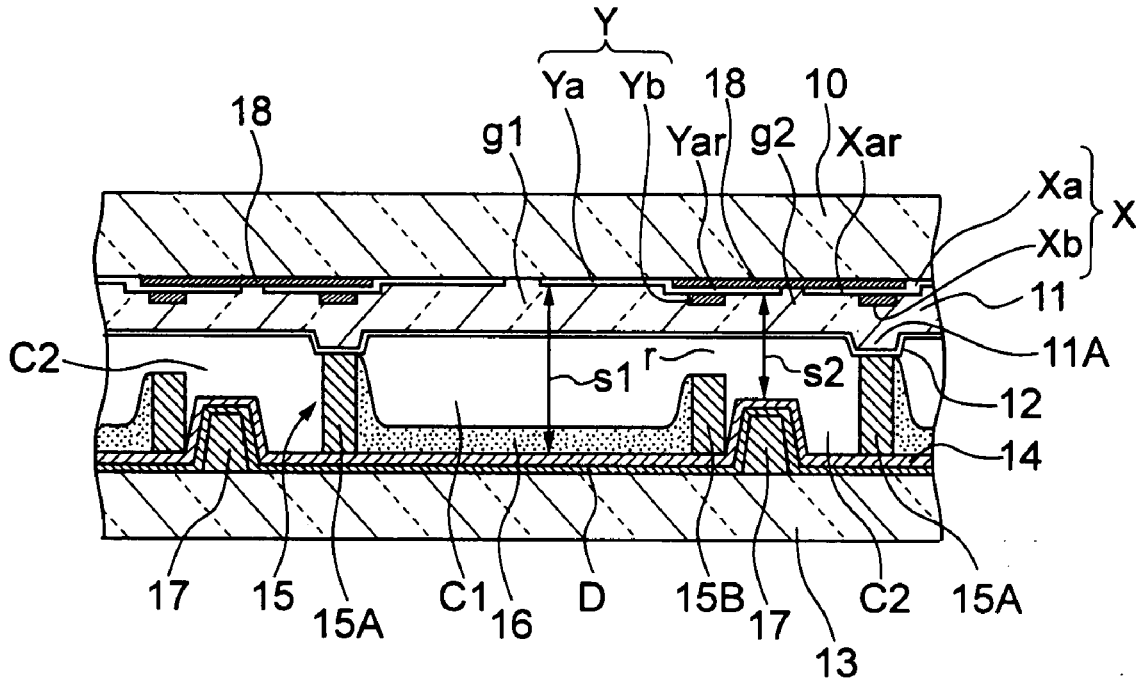
FIG. 6 is a cross-sectional view taken along a line VI—VI in FIG. 5.
Figure 7:
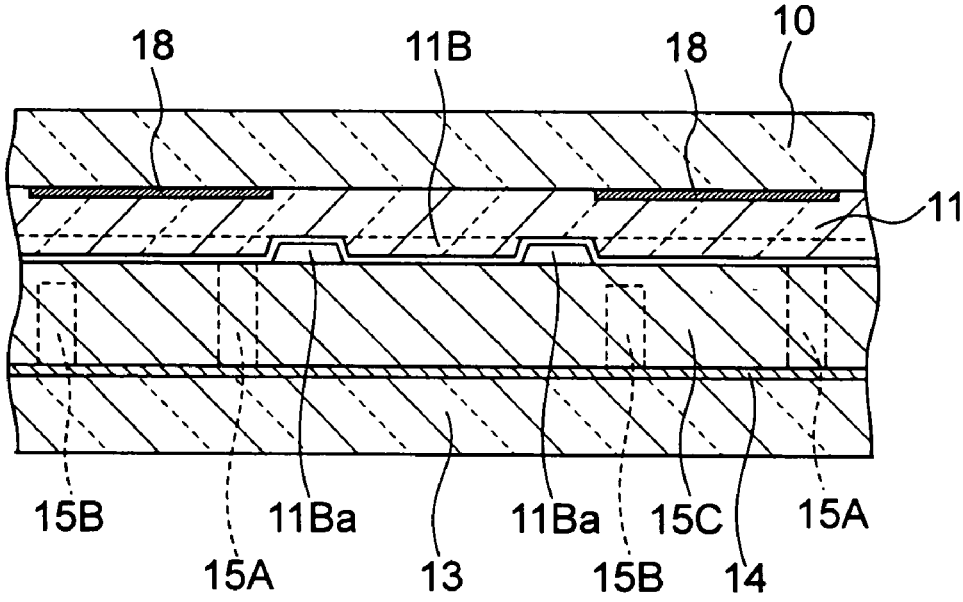
FIG. 7 is a cross-sectional view taken along a line VII—VII in FIG. 5.
Figure 8:
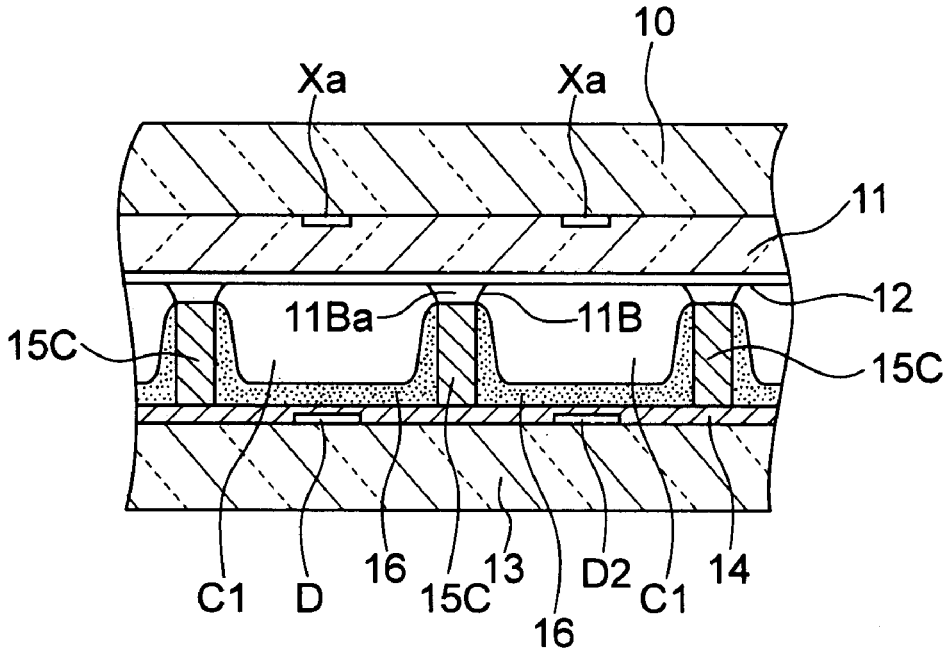
FIG. 8 is a cross-sectional view taken along a line VIII—VIII in FIG. 5.
Figure 9:
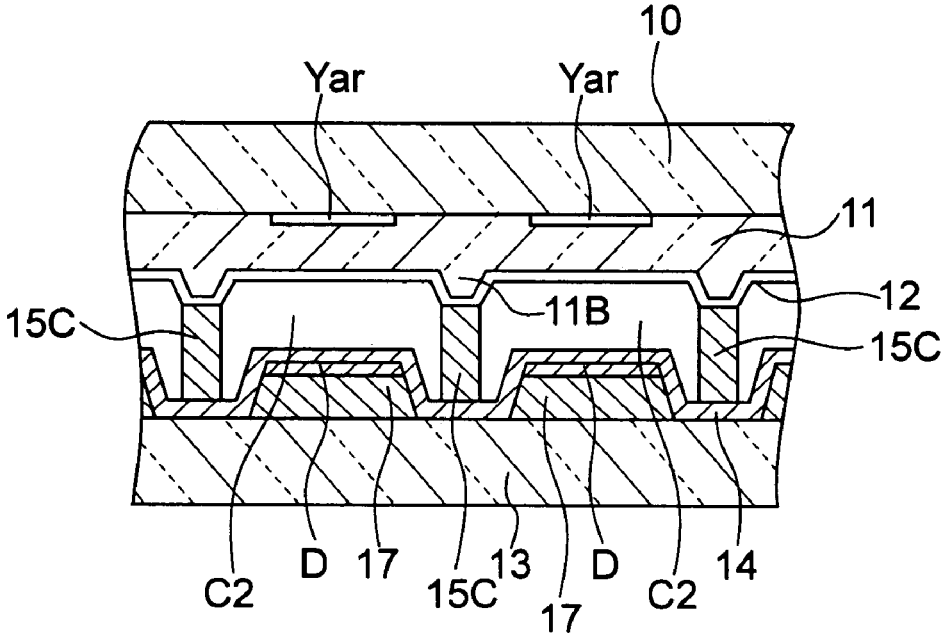
FIG. 9 is a cross-sectional view taken along a line IX—IX in FIG. 5.

FIGS. 5–9 are diagrams schematically showing on exemplary embodiment of a plasma display panel (hereinafter called the "PDP") according to the present invention. FIG. 5 is a front view showing a portion of a cell structure of the PDP in this embodiment; FIG. 6 is a cross-sectional view taken along a line VI—VI in FIG. 1; FIG. 7 is a cross-sectional view taken along a line VII—VII in FIG. 5; FIG. 8 is a cross-sectional view taken along a line VIII—VIII in FIG. 5; and FIG. 9 is a cross-sectional view taken along a line IX—IX in FIG. 5.

The PDP shown in FIGS. 5–9 has a plurality of row electrode pairs (X, Y) arranged in parallel on the back side of a front glass substrate 10, which serves as a display surface, to extend in a row direction (horizontal direction in FIG. 5) of the front glass substrate 10.

The row electrode X is comprised of a transparent electrode Xa formed of a transparent conductive film such as ITO in a T-shape; and a black bus electrode Xb extending in the row direction of the front glass substrate 10 and formed of a metal film connected to a narrow proximal end of the transparent electrode Xa.

Similarly, the row electrode Y is comprised of a transparent electrode Ya formed of a transparent conductive film such as ITO in a T-shape; and a black bus electrode Yb extending in the row direction of the front glass substrate 10 and formed of a metal film connected to a narrow proximal end of the transparent electrode Ya.

The row electrodes X, Y are alternately arranged in the column direction (in the vertical direction in FIG. 5, and in the horizontal direction in FIG. 6) of the front glass substrate 10. The respective transparent electrodes Xa, Ya arranged in parallel at equal intervals along the bus electrodes Xb, Yb extend toward the row electrode of the other party, formed in pair, so that wide distal ends Xaf, Yaf of the transparent electrodes Xa, Ya oppose each other across a first discharge gap g1 having a predetermined width.

A display line L extending in the row direction is defined for each row electrode pair (X, Y).

On the back side of the front glass substrate 10, a dielectric layer 11 is formed to cover the row electrode pairs (X, Y). On the back side of the dielectric layer 11, a first eminent dielectric layer 11A protruding from the dielectric layer 11 toward the back (downward in FIGS. 6–9) is formed at a position opposite to the bus electrode Xb of the row electrode X to extend in a direction parallel (row direction) to the bus electrodes Xb, Yb.

Further, on the back side of the dielectric layer 11, a second eminent dielectric layer 11B protruding from the dielectric layer 11 toward the back (downward in FIGS. 6–9) is formed in a portion opposite to an intermediate position of the transparent electrodes Xa, Ya, adjacent to each other, arranged at equal intervals along the bus electrodes Xb, Yb of the row electrodes X, Y to extend in a direction (column direction) perpendicular to the bus electrodes Xb, Yb.

As shown in FIG. 7, the second eminent dielectric layer 11B is formed with a communication groove 11Ba, both end faces of which are open to both side surfaces of the second eminent dielectric layer 11B, at a position opposite to a portion between the bus electrodes Xb, Yb in each row electrode pair (X, Y).

Then, the back sides of the dielectric layers 11, first eminent dielectric layer 11A, and second eminent dielectric layer 11B are covered with a protection layer 12 made of MgO.

On the display surface of the back glass substrate 13 arranged in parallel with the front glass substrate 10 through a discharge space, a plurality of column electrodes D are formed in parallel and spaced apart from each other to extend in a direction (column direction) perpendicular to the bus electrodes Xb, Yb at a positions opposing the transparent electrodes Xa, Ya, formed in pair, of the respective row electrode pairs (X, Y).

Further, on the display surface of the back glass substrate 13, a white column electrode protection layer (dielectric layer) 14 is formed to cover the column electrodes D, and a partition 15 is formed on the column electrode protection layer 14 in a shape as described below in detail.

Specifically, the partition 15 is formed substantially in a lattice shape, and comprises, viewed from the display surface of the front glass substrate 10, first horizontal walls 15A respectively extending in the row direction at positions opposing the bus electrodes Xb of the respective row electrodes X and the first eminent dielectric layer 11A; second horizontal walls 15B respectively extending in the row directions at positions opposing the bus electrodes Yb of the respective row electrodes Y; and vertical walls 15C respectively extending in the column direction at positions opposing the second eminent dielectric layer 11B halfway between the respective transparent electrodes Xa, Ya arranged at equal intervals along the bus electrodes Xb, Yb of the row electrodes X, Y.

Then, the height of the first horizontal walls 15A and vertical walls 15C is set to be equal to the interval between the protection layer 12 which covers the back sides of the first eminent dielectric layer 11A and second eminent dielectric layer 11B and the column electrode protection layer 14 which covers the column electrodes D, while the height of the second horizontal walls 15B is set to be slightly smaller than the height of the first horizontal walls 15A and vertical walls 15C, so that the front sides (upper sides in FIG. 6) of the first horizontal walls 15A and vertical walls 15C are in contact with the back side of the protection layer 12 which covers the first eminent dielectric layer 11A and second eminent dielectric layer 11B, whereas the second horizontal walls 15B are not in contact with the protection layer 12 which covers the dielectric layer 11, and gaps r are formed between the respective front sides and the protection layer 12 which covers the dielectric layer 11, as shown in FIG. 6.

The first horizontal walls 15A, second horizontal walls 15B, and the vertical walls 15C of the partition 15 partition the discharge space between the front glass substrate 10 and back glass substrate 13 into regions opposing the transparent electrodes Xa, Ya formed in pair, respectively opposing each other, to form display discharge cells C1. Also, the vertical walls 15C partition the discharge space opposing portions between the bus electrodes Xb, Yb positioned back-to-back to the adjacent row electrode pairs (X, Y) sandwiched between the first horizontal walls 15A and second horizontal walls 15B to form reset-and-address discharge cells C1 which are arranged alternately with the display discharge cells C2 in the column direction.

The respective display discharge cells C1 and reset-and-address discharge cells C2 placed adjacent across the second horizontal walls 15B in the column direction communicate with each other through a gap r formed between the front side of the second horizontal walls 15B and the protection layer 12 which covers the eminent dielectric layer 11A (see FIG. 6), thereby forming the adjacent display discharge cell C1 and reset-and-address discharge cell C2 in the column direction across the second horizontal wall 15B into a pair.

Intervals between the adjacent display discharge cells C1 in the row direction communicate with one another through the communication grooves 11Ba formed in the second eminent dielectric layer 11B (see FIG. 8).

The transparent electrodes Xa, Ya of the row electrodes X, Y have their trailing ends Xar, Yar respectively extending from joints with the bus electrodes Xb, Yb to portions opposing the reset-and-address discharge cells C2. The trailing ends Xar, Yar of the transparent electrodes Xa, Ya extending on the reset-and-address discharge cells C2 are formed wider in the row direction than the joints with the bus electrodes Xb, Yb, respectively.

The trailing end Xar of the row electrode X is formed with the width in the column direction larger than the width of the trailing end Yar of the row electrode Y in the column direction.

Then, the trailing ends Xar, Yar of the transparent electrodes Xa, Ya of the row electrodes X, Y positioned back-to-back to the adjacent row electrode pairs (X, Y) in the column direction are placed in opposition to each other through a second discharge gap g2 in portions opposing the reset-and-address discharge cells C2.

On the respective side surfaces of the first horizontal wall 15A, second horizontal wall 15B, and vertical wall 15C of the partition 15 facing the discharge space of the respective display discharge cells C1, and on the surface of the column electrode protection layer 14, a fluorescent layer 16 is formed to cover all of the five surfaces. The fluorescent layer 16 has colors, red (R), green (G), blue (B) arranged in order in the row direction for each display discharge cell C1.

On the surface of the back glass substrate 13 opposing each of the reset-and-address discharge cells C2, a protruding rib 17 having a height lower than the second horizontal wall 15B and protruding into the address discharge cell C2 from the display surface of the back glass surface 13 is formed in a square island shape.

The protruding rib 17 is formed at a position opposing the discharge gap g2 between the trailing ends Xar, Yar of the transparent electrodes Xa, Ya, such that the width of the trailing end Xar of the row electrode X in the column direction is larger than the width of the trailing end Yar of the row electrode Y in the column direction, so that it is positioned at a position closer to the second horizontal wall 15B than a central position of the reset-and-address discharge cell 2, as shown in FIG. 6.

The protruding rib 17 raises a portion of the column electrode D opposing each reset-and-address discharge cell C2, and the column electrode protection layer 14 covering the column electrode D from the back glass substrate 13, so that they respectively protrude into the reset-and-address discharge cells C2. Thus, a spacing s2 between the trailing ends Xar, Yar of the transparent electrodes Xa, Ya opposing the reset-and-address discharge cell C2 is smaller than a spacing s1 between the portion of the column electrode D opposing the display discharge cell C1 and the transparent electrodes Xa, Ya.

The protruding rib 17 may be formed of the same dielectric material as the column electrode protection layer 14, or alternatively created by forming ruggedness on the back glass substrate 13 by a method such as sand blast, wet etching, and the like.

On the back side of the front glass substrate 10, black or dark brown light absorbing layers 18 are formed along the row direction in a strip shape between portions of the dielectric layer 11 opposing the reset-and-address discharge cells C2, the trailing ends Xar, Yar of the transparent electrodes Xa, Ya, and the bus electrodes Xb, Yb. The overall surfaces of the reset-and-address discharge cells C2 are covered with the light absorbing layers 18, viewed from the display surface of the front glass substrate 10.

Each of the display discharge cells C1 and reset-and-address discharge cells C2 is filled with a discharge gas.

Figure 10:
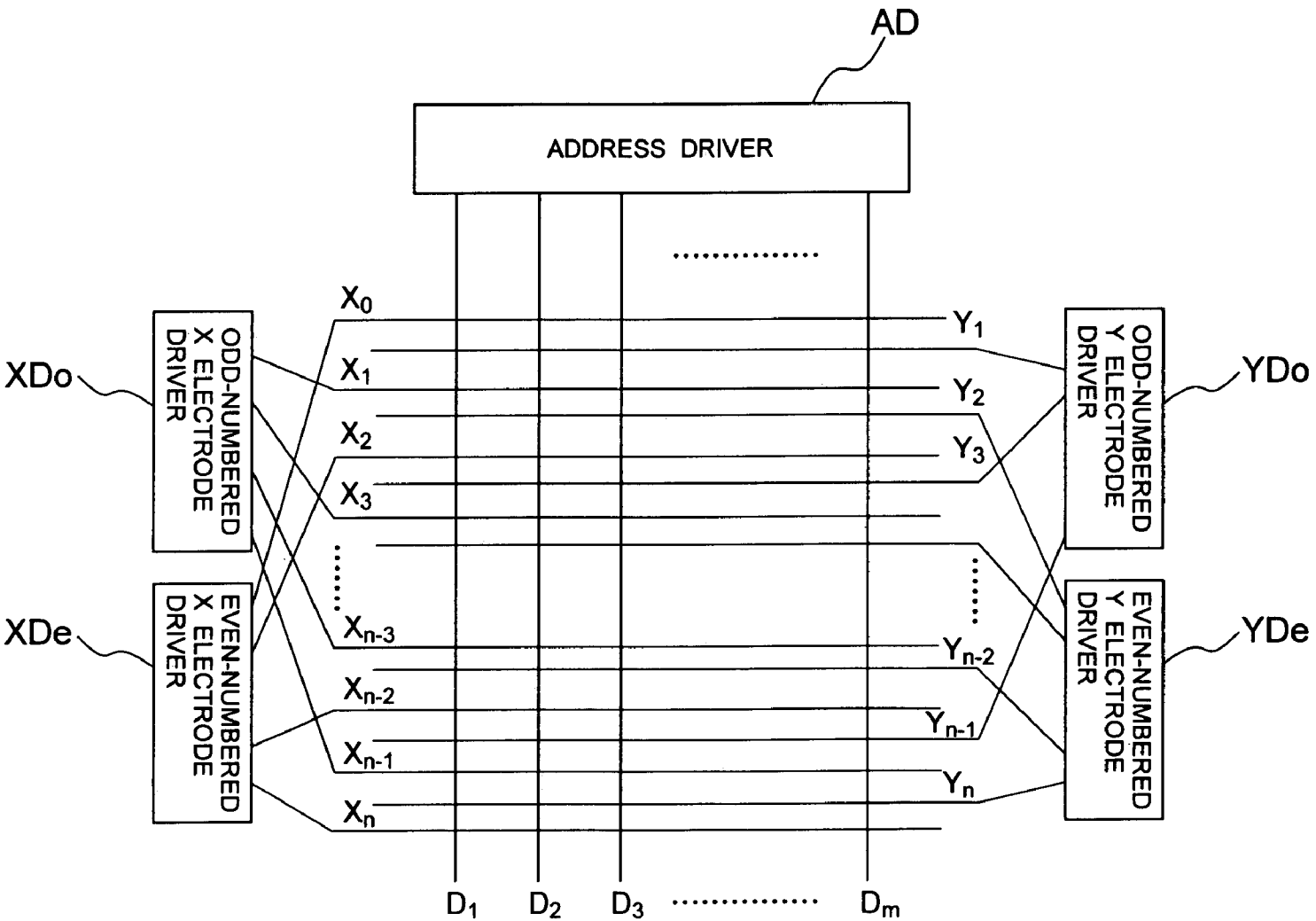
FIG. 10 is a block diagram generally showing the configuration of a plasma display panel driver in the embodiment.

FIG. 10 is a schematic circuit diagram showing a PDP driving circuit.

In FIG. 10, an odd-numbered X electrode driver XDo is connected to odd-numbered row electrodes X of the row electrodes X from the above of the panel surface, an even-numbered X electrode driver XDe is connected to even-numbered row-electrodes X, an odd-numbered Y electrode driver YDo is connected to even numbered row electrodes Y of the row electrodes Y from the above of the panel surface, and an even-numbered Y electrode driver YDe is connected to even-numbered row electrodes Y.

An address driver AD is connected to the column electrodes D.

Next, the PDP driving method will be described with reference to a pulse output timing chart shown in FIG. 11.

Figure 11:
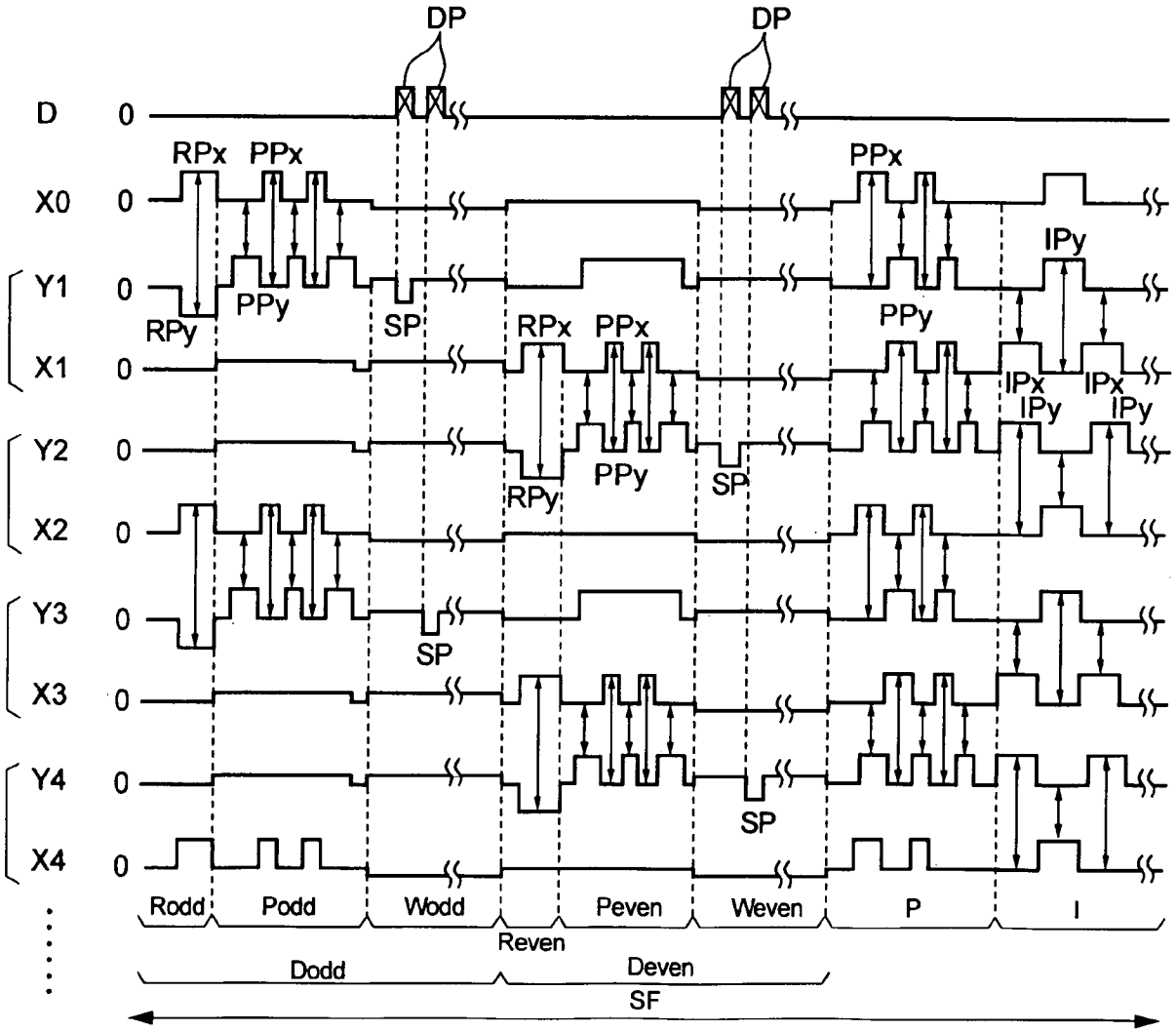
FIG. 11 is a diagram showing an example of a pulse output timing chart in one embodiment of a method of driving a plasma display panel according to the present invention.

FIG. 11 shows a pulse output timing chart in one of N subfields divided from one field display period in the subfield method.

In this subfield SF, a discharge period consists of an odd-numbered row discharge period Dodd in odd-numbered row electrodes Y, an even-numbered row discharge period Deven for even-numbered row electrodes Y, a simultaneous priming discharge period P, and a simultaneous sustain discharge period I.

The odd-numbered row discharge period Dodd consists of an odd-numbered line reset period Rodd, an odd-numbered line priming period Podd, and an odd-numbered line address period Wodd, while the even-numbered row discharge period Deven consists of an even-numbered line reset period Reven, an even-numbered line priming period Peven, and an even-numbered line address period Weven.

As a discharge is started in the subfield SF, first, in the odd-numbered line reset period Rodd of the odd-numbered row discharge period Dodd, respective row electrodes Yodd on odd-numbered columns are simultaneously applied with a reset pulse RPy by the odd-numbered Y electrode driver YDo (see FIG. 10), and respective row electrodes Xeven on even-numbered columns are simultaneously applied with a reset pulse RPx by the even-numbered X electrode driver XDe (see FIG. 10).

Consequently, a reset discharge is produced between a row electrode Y on an odd-numbered column and a row electrode X on an even-numbered column of the row electrodes X, Y positioned back-to-back to each other of adjacent row electrode pairs (X, Y) in the column direction.

This reset discharge is produced between the trailing end Yar of the row electrode Y on the odd-numbered column and the trailing end Xar of the row electrode X on the even-numbered column opposite thereto, in FIGS. 6 and 7, thereby producing charged particles within a reset-and-address discharge cell C2 opposing the trailing end Yar of the row electrode Y on the odd-numbered column and the trailing end Xar of the row electrode X on the even-numbered column.

Then, the charged particles produced in the reset-and-address discharge cell C2 is introduced into the adjoining display discharge cell C1 through the gap r between the second horizontal wall 15B and protection layer 12, thereby forming a wall charge on the dielectric layer 11 opposing each of the display discharge cells C1 arranged on the odd-numbered column.

Next, in the odd-numbered line priming period Podd, priming pulses PPy, PPx are alternately applied to the row electrodes Y on the odd-numbered columns and the row electrodes X on the even-numbered columns, thereby producing a priming discharge between the trailing end Yar of the row electrode Y on the odd-numbered column and the trailing end Xar of the row electrode X on the even-numbered column within the reset-and-address discharge cell C2 to produce priming particles (pilot flame) within the reset-and-addressing discharge cell C2.

After the odd-numbered line priming period Podd, in the odd-numbered line address period Wodd, a scanning pulse SP is applied sequentially to the row electrodes Yodd on the odd-numbered columns, while a display data pulse DPm corresponding to display data of each display line in an image is applied to the column electrodes D by an address driver AD, to produce an address discharge (selective erasure discharge).

Then, the charged particles produced in the reset-and-address discharge cell C2 by the address discharge are introduced into the adjoining display discharge cell C1 through the gap r between the second horizontal wall 15B and protection layer 12, thereby selectively erasing the wall charge formed on the dielectric layer 11 opposing the display discharge cell C1 to distribute light emission cells (display discharge cells C1 formed with the wall charge on the dielectric layer 11) and non-light emission cells (display discharge cells C1 in which the wall charge on the dielectric layer 11 is erased) on the odd-numbered display lines L on the panel surface corresponding to the display data of the image.

When the address discharge is produced in the odd-numbered line address period Wodd, the priming particles (pilot flame) have been generated in the reset-and-address discharge cells C2 by the priming discharge produced in the odd-numbered line priming period Podd immediately before the odd-numbered line address period Wodd, thereby improving the stability of the address discharge in the odd-numbered line address period Wodd, and increasing the scan rate.

After the odd-numbered row discharge period Dodd, similar reset discharge, priming discharge, and address discharge are produced as well in the even-numbered row discharge period Deven.

Specifically, in the even-numbered line reset period Reven, the respective row electrodes Yeven on the even-numbered columns are simultaneously applied with the reset pulse RPy by the even-numbered Y electrode driver YDe (see FIG. 10), while each of the row electrodes Xodd on the odd-numbered columns are simultaneously applied with the reset pulse RPx by the odd-numbered X electrode driver XDo (see FIG. 10).

Consequently, a reset discharge is produced between a row electrode Y on an even-numbered column and a row electrode X on an odd-numbered column of the row electrodes X, Y positioned back-to-back to each other of adjacent row electrode pairs (X, Y) in the column direction.

This reset discharge is produced between the trailing end Yar of the row electrode Y on the even-numbered column and the trailing end Xar of the row electrode X on the odd-numbered column opposite thereto, thereby producing charged particles within a reset-and-address discharge cell C2 opposing the trailing end Yar of the row electrode Y on the even-numbered column and the trailing end Xar of the row electrode X on the odd-numbered column.

Then, the charged particles produced in the reset-and-address discharge cell C2 is introduced into the adjoining display discharge cell C1 through the gap r between the second horizontal wall 15B and protection layer 12, thereby forming a wall charge on the dielectric layer 11 opposing each of the display discharge cells C1 arranged on the even-numbered column.

Next, in the even-numbered line priming period Peven, priming pulses PPy, PPx are alternately applied to the row electrodes Y on the even-numbered columns and the row electrodes X on the odd-numbered columns, thereby producing a priming discharge between the trailing end Yar of the row electrode Y on the even-numbered column and the trailing end Xar of the row electrode X on the odd-numbered column within the reset-and-address discharge cell C2 to generate priming particles (pilot flame) within the reset-and-addressing discharge cell C2.

After the even-numbered line priming period Peven, in the even-numbered line address period Weven, a scanning pulse SP is applied sequentially to the row electrodes Yeven on the even-numbered columns, while a display data pulse DPn corresponding to display data of each display line in an image is applied to the column electrodes D by the address driver AD, to produce an address discharge (selective erasure discharge).

Then, the charged particles generated in the reset-and-address discharge cell C2 by the address discharge are introduced into the adjoining display discharge cell C1 through the gap r between the second horizontal wall 15B and protection layer 12, thereby selectively erasing the wall charges formed on the dielectric layer 11 opposing the display discharge cells C1 to distribute light emission cells (display discharge cells C1 formed with the wall charge on the dielectric layer 11) and non-light emission cells (display discharge cells C1 in which the wall charge on the dielectric layer 11 is erased) on the even-numbered display lines L on the panel surface corresponding to the display data of the image.

As in the odd-numbered row discharge period Dodd, when the address discharge is produced in the even-numbered line address period Weven, the priming particles (pilot flame) have been generate in the reset-and-address discharge cells C2 by the priming discharge produced in the even-numbered line priming period Peven immediately before the even-numbered line address period Weven, thereby improving the stability of the address discharge in the even-numbered line address period Weven, and increasing the scan rate.

In this PDP, when the reset discharge, priming discharge, and address discharge are produced, the display surface of the reset-and-address discharge cell C2 on which these discharges are produced is covered with the light absorbing layer 18 to completely shield the light emitted by the discharges in the reset-and-address discharge cell C2 to prevent the light from leaking to the display surface of the front glass substrate 10, thereby reducing the luminance level on the panel surface substantially to zero when a black image is displayed.

In the foregoing, the respective intervals between adjacent display discharge cells C1 across the first horizontal walls 15A in the column direction and the other adjacent reset-and-address discharge cells C2 in the row direction are closed by the first horizontal walls 15A and first eminent dielectric layers 11A, and the vertical walls 15C and second eminent dielectric layers 11B, respectively, thereby preventing the charged particles produced by the reset discharge and address discharge produced in the reset-and-address discharge cells C2 from flowing except for the adjacent display discharge cells C1 across the second horizontal walls 15B.

Further, during the address discharge, the spacing s2 between the column electrode D and the trailing end Yar of the row electrode Y is reduced by the protruding rib 17, so that the address discharge is started at a low voltage. Also, the width of the trailing end Xar of the row electrode X in the column direction is formed larger than the width of the trailing end Yar of the row electrode Y in the column direction, so that the address discharge is produced at a position closer to the second horizontal wall 15B than the central position of the reset-and-address discharge cell C2, thereby facilitating the introduction of the charged particles generated by the address discharge into the adjoining display discharge cells C1 through the gap r.

In the foregoing manner, upon completion of the distribution of light emission cells and non-light emission cells corresponding to the display data of the image on the odd-numbered and even-numbered display lines L, the row electrodes Yodd on the odd-numbered columns, the row electrodes Xodd on the even-numbered columns, the row electrodes Yeven on the even-numbered columns, and the row electrodes Xodd on the odd-numbered columns are next applied with the priming pulses PPy, PPx, respectively, at predefined timings, in the simultaneous priming discharge period P to produce a priming discharge in each of the reset-and-address discharge cells C2 to generate priming particles (pilot flame) in the reset-and-address discharge cell C2.

The priming particles are introduced into the adjacent display discharge cell C1 through the second horizontal wall 15B through the gap r between the second horizontal wall 15B and protection layer 12.

Then, after the simultaneous priming discharge period P, the row electrodes X, Y, formed in pair, of each row electrode pair (X, Y) are applied with sustain pulses IPx, IPy, respectively, a number of times corresponding to a weighting applied to the subfield in the simultaneous sustain discharge period I.

Thus, the sustain discharge is repeated each time the sustain pulses IPx, IPy are applied, corresponding to the number of times of the application, in the light emission cells in which the wall charges are formed on the dielectric layer 11. Each of the red (R), green (G), and blue (B) fluorescent layers 16 facing the display discharge cells C1 are excited by the ultraviolet rays emitted by the sustain discharges to emit light, thereby forming a displayed image.

The priming particles (pilot flame) generated in the reset-and-addressing discharge cells C2 are introduced into the display discharge cells C1 by the simultaneous priming discharge produced in the simultaneous priming discharge period P immediately before the simultaneous sustain discharge period I, thereby improving the stability of the sustain discharge in the simultaneous sustain discharge period I.

Also, in the simultaneous sustain discharge period I, the communication groove 11Ba formed in the second eminent dielectric layer 11B ensures a so-called priming effect by the introduction of the priming particles (pilot flame) generated by the sustain discharge produced in the display discharge cells C1 into other display discharge cells C1 adjacent thereto in the row direction through the communication groove 11Ba.

In the subfield method for driving the PDP, a clear driving method can further be applied.

The clear driving method refers to a PDP driving method which involves producing a reset discharge only in the first subfield of a plurality (here, N) of subfields divided from one field, producing an address discharge corresponding to a display data of an image, followed by a sustain discharge produced in order from the first subfield in a selective erasure address method (method of writing image data by erasing wall charges by an address discharge), or from the last subfield in order in a selective write address method (method of writing image data by forming wall charges by an address discharge) to drive the discharge cells to emit light (turn on), thereby displaying an image at N+1 levels of gradation.

Figure 12:
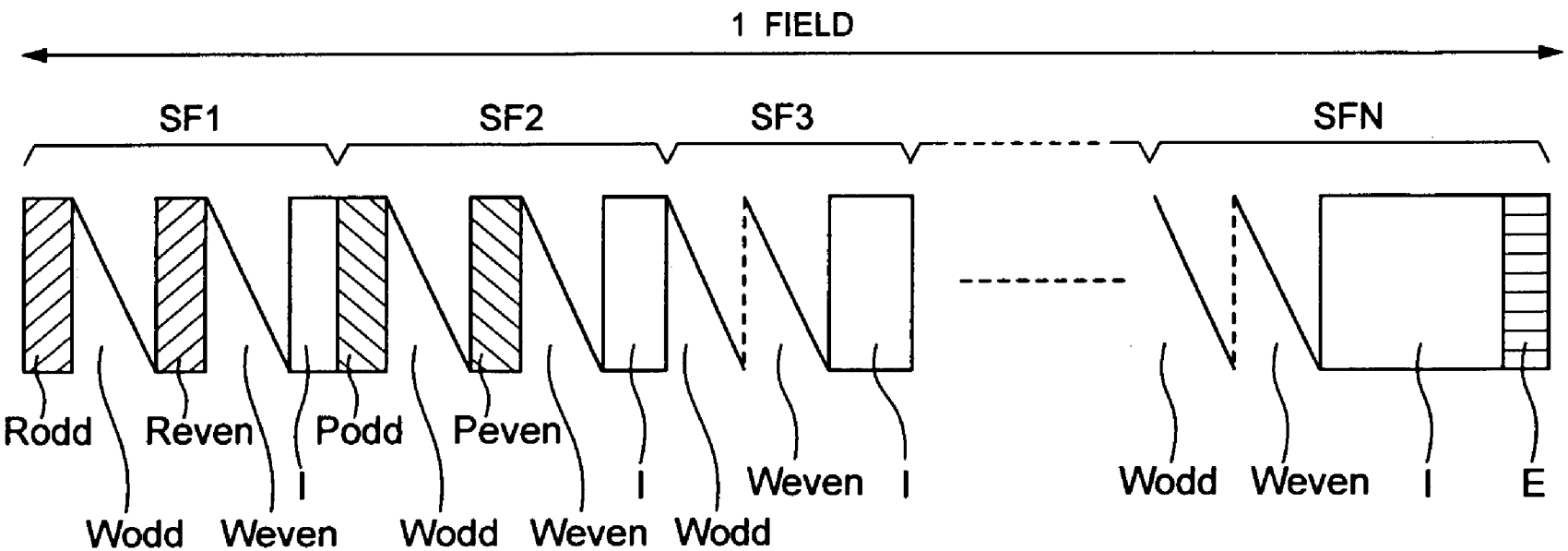
FIG. 12 is a diagram showing an example of a light emission driving format in the embodiment of the method of driving a plasma display panel according to the present invention.
Figure 13:
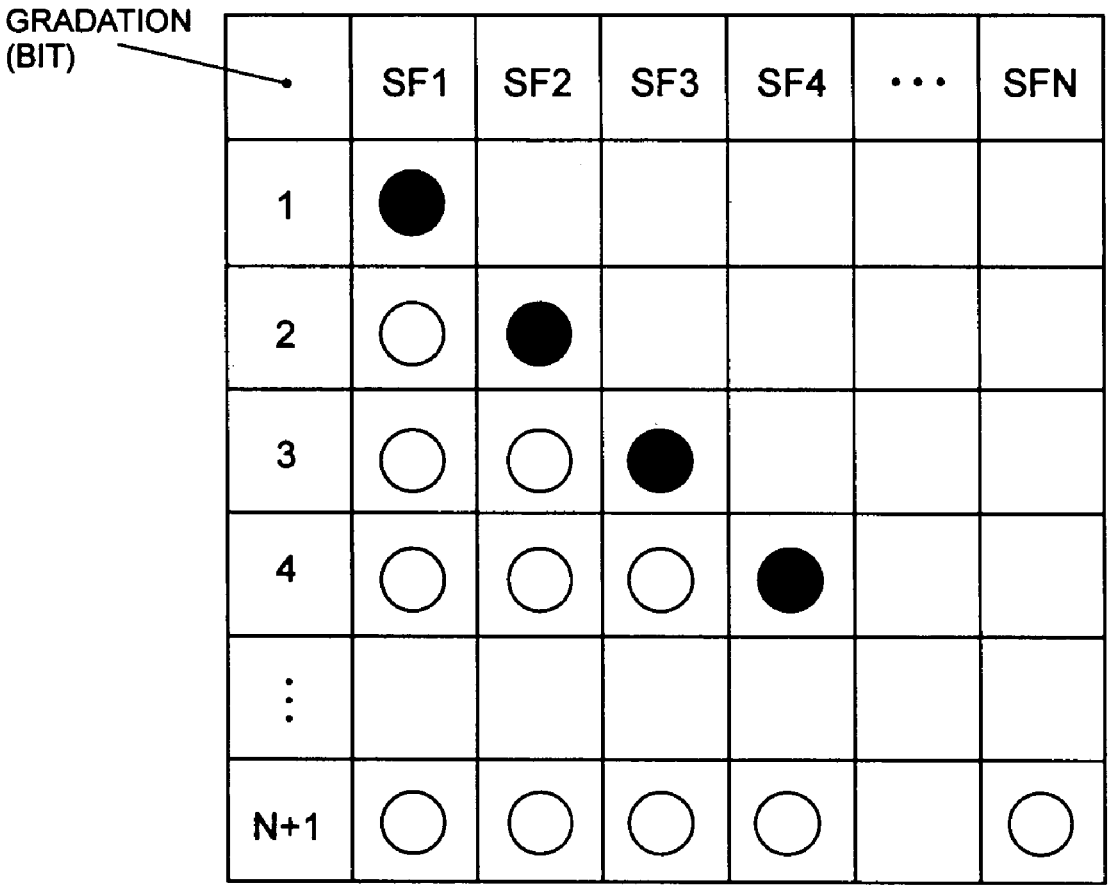
FIG. 13 is a diagram showing a light emission pattern in the embodiment of the method of driving a plasma display panel according to the present invention.

FIG. 12 shows a light emission driving format when the clear driving method is applied for driving the PDP in accordance with the subfield method for the PDP in the foregoing embodiment, and FIG. 13 is a diagram showing a light emission pattern in the driving method of FIG. 12.

FIGS. 12 and 13 show a light emission driving format and a light emission pattern in the selective erasure address method. In FIG. 12, the odd-numbered line reset period Rodd and even-numbered line reset period Reven are set only in the first subfield SF1.

The odd-numbered line priming period Podd and even-numbered line priming period Peven are set in a subfield SF2.

Then, a sustain discharge in the simultaneous sustain discharge period I is produced in order from the first subfield SF1 after the address discharges (selective erasure discharges) in the odd-numbered line address period Wodd and the even-numbered line address period Weven in the respective subfields.

The address discharges in the odd-numbered line address period Wodd and the even-numbered line address period Weven are produced in subfields SF corresponding to image data to erase (turn off) wall charges in display discharge cells C1 adjacent to the reset-and-address discharge cells C2 in which the address discharges have been produced (see FIGS. 5 and 6).

The subfields in which the address discharge is produced are indicated by black circles in FIG. 13.

In the anteceding subfields from the first subfield to the subfield in which the address discharge is produced, the wall charges formed (turned on) in the display discharge cells C1 are maintained as indicated by white circles in FIG. 13.

In FIG. 12, at the end of the last subfield SFN in one field, an overall erasure discharge E is produced.

By applying the clear driving method for driving the PDP according to the present invention, the number of times of reset discharges is reduced in an image display period in one field, thereby making it possible to achieve a reduction in the power consumed by the PDP.

While the foregoing description has focused on the formation of an image on the PDP in accordance with the selective erasure address method, the same description is applied to the formation of image in accordance with a selective write address method.

The PDP in the foregoing embodiment may be formed with a dielectric layer made of a high $\in$ material having a relative dielectric constant equal to or higher than 50 (50–250) between the trailing end Yar of the row electrode Y and the column electrode D in the reset-and-address discharge cell C2.

In this case, the address discharge produced between the trailing end Yar of the row electrode Y and the column electrode D is produced through the high $\in$ material of the dielectric layer to reduce an apparent discharge distance between the trailing end Yar of the row electrode Y and the column electrode D, thereby making it possible to reduce a start voltage of the address discharge.

The high $\in$ material for forming the dielectric layer is, for example, $SrTiO_3$ or the like.

In the following, another embodiment of the present invention will be described with reference to the drawings.

Figure 14:
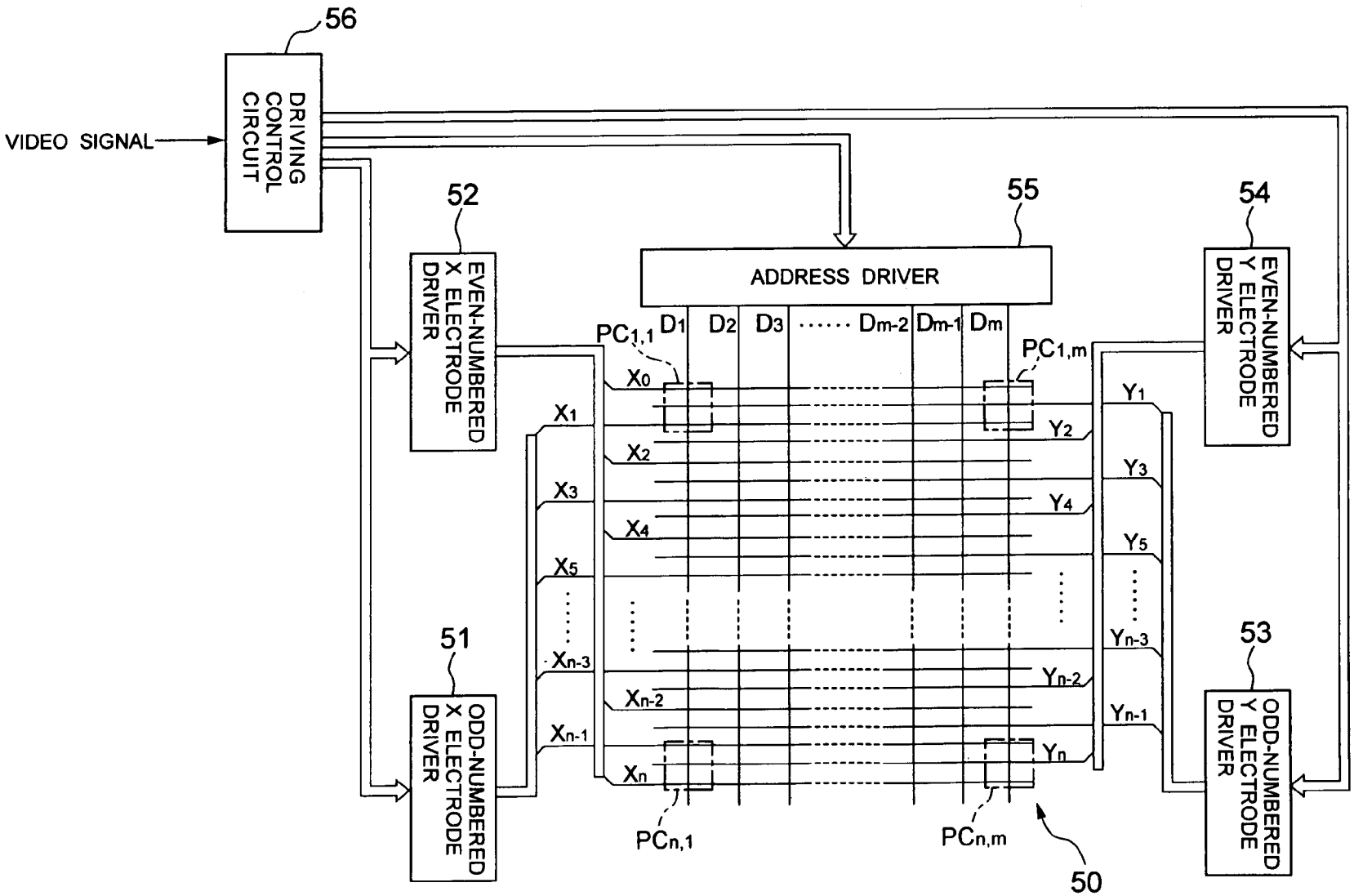
FIG. 14 is a plan view showing another configuration of a plasma display device as a display device according to the present invention.

FIG. 14 is a diagram showing another configuration of the plasma display device as a display device according to the present invention.

As shown in FIG. 14, the plasma display device comprises a PDP 50 as a plasma display panel; an odd-numbered X electrode driver 51; an even-numbered X electrode driver 52; an odd-numbered Y electrode driver 53; an even-numbered Y electrode driver 54; an address driver 55; and a driving control circuit 56.

The PDP 50 is formed with strip-shaped column electrodes $D_1$–$D_m$ respectively extending in the vertical direction on a display screen. The PDP 50 is also formed with stripe-shaped row electrodes $X_0$, $X_1$–$X_n$ and row electrodes $Y_1$–$Y_n$ respectively extending in the horizontal direction on the display screen. Row electrode pairs, i.e., a row electrode pair ($X_1$, $Y_1$)—a row electrode pair ($X_n$, $Y_n$) comprise a first display line—an n-th display line on the PDP 50, respectively. A unit light emission region, i.e., a pixel cell PC carrying a pixel is formed at each intersection of each display line and each of the column electrodes $D_1$–$D_m$. In other words, on the PDP 50, pixel cells $PC_{1,1}$–$PC_{n,m}$ are arranged in matrix in the form as shown in FIG. 14. The row electrode X0 is included in each of the pixel cells $PC_{1,1}$–$PC_{1,m}$ belonging to a first display line.

Figure 15:
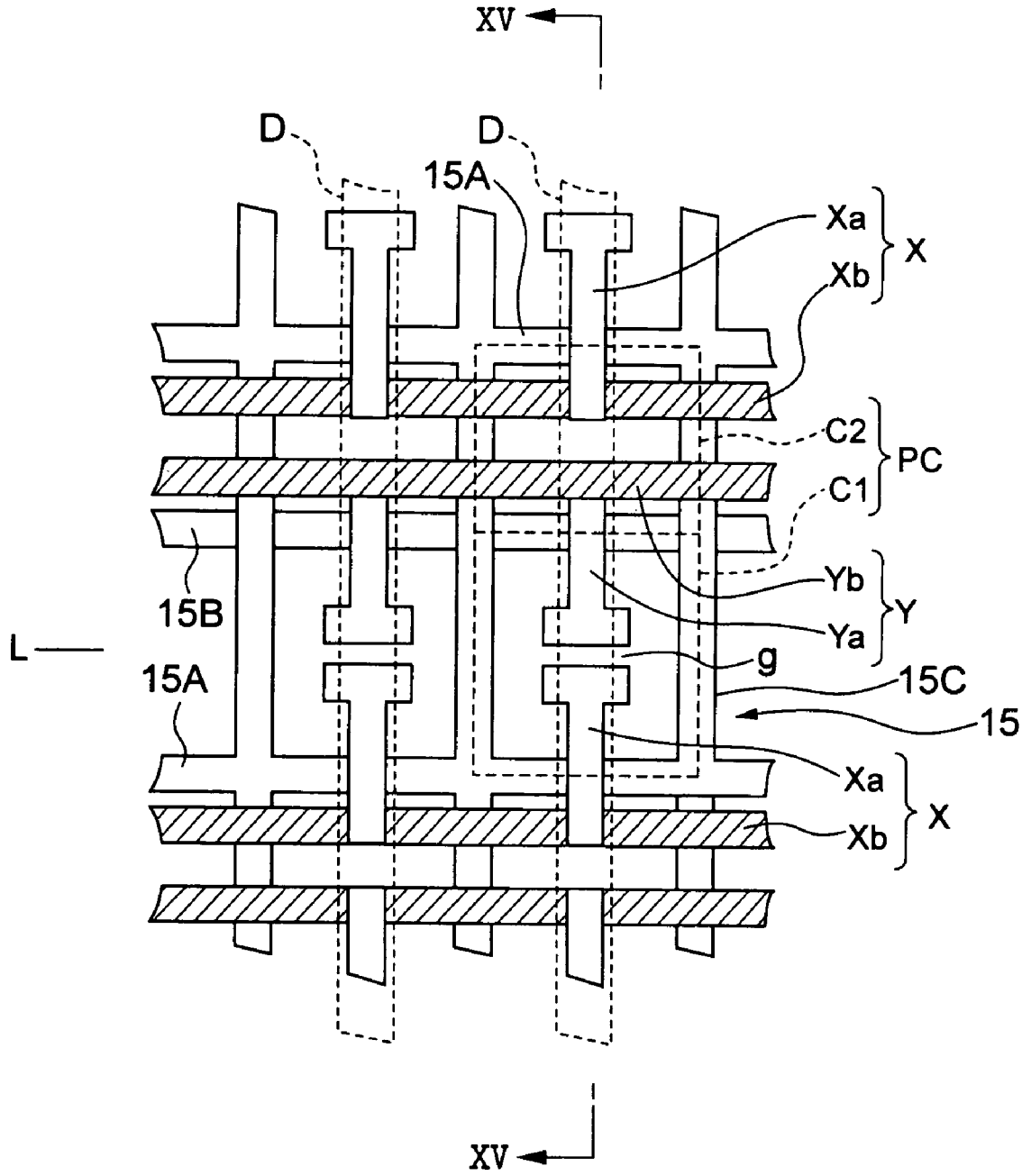
FIG. 15 is a plan view of a PDP 50 equipped in the plasma display device shown in FIG. 14 when seen from a display screen of the PDP.
Figure 16:
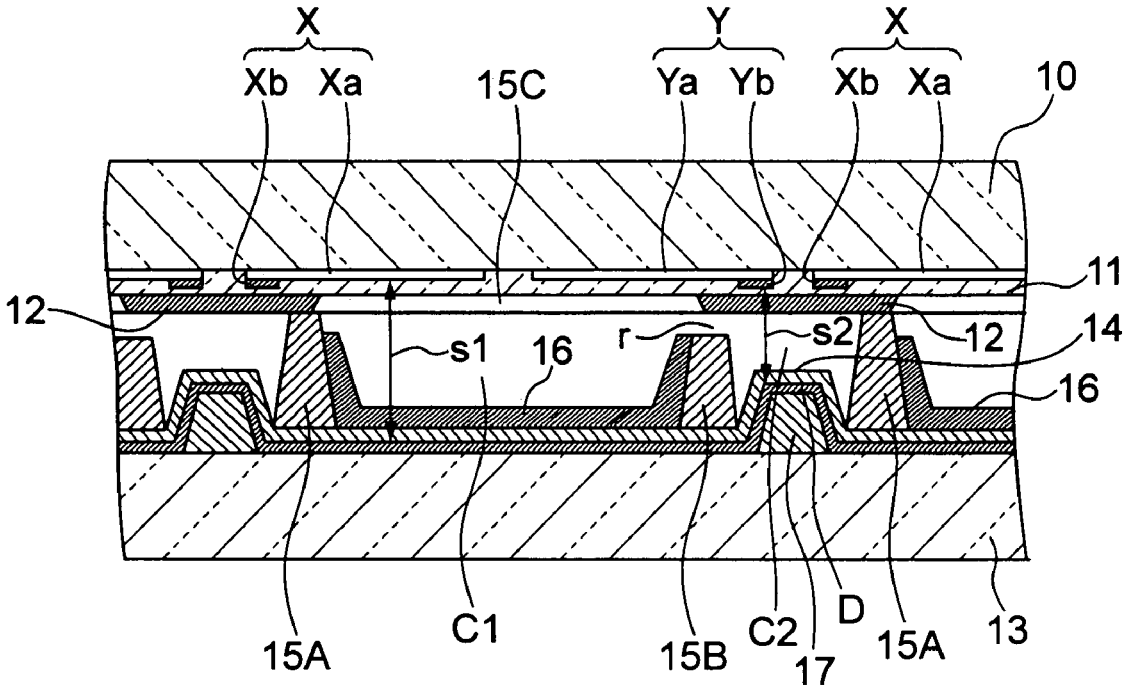
FIG. 16 is a cross-sectional view taken along a line XVI—XVI indicated in FIG. 15.
Figure 17:
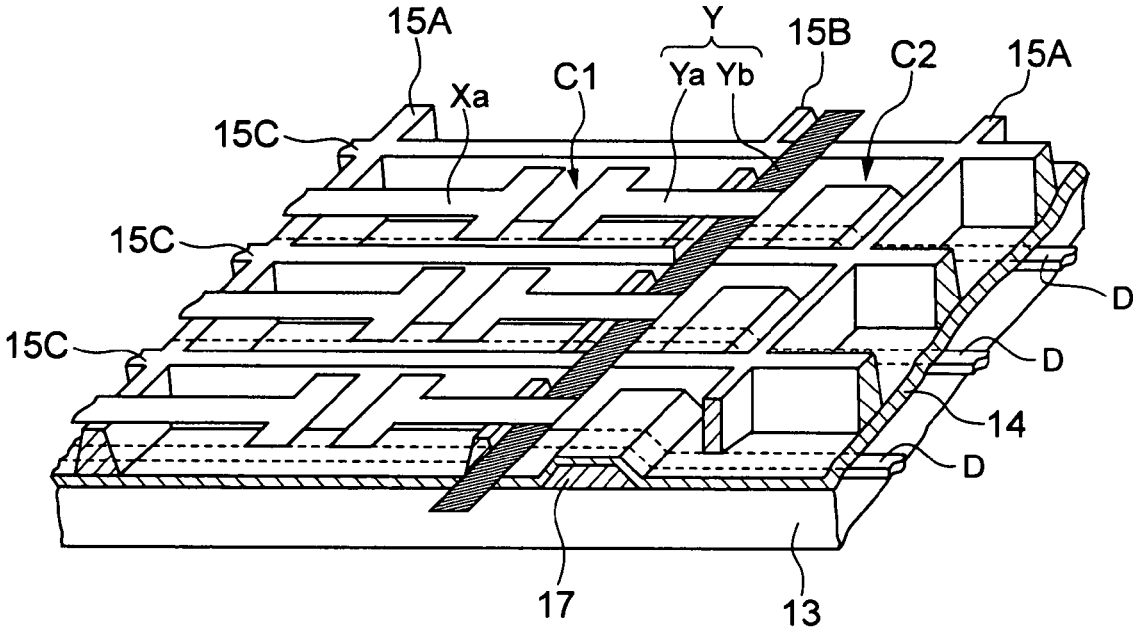
FIG. 17 is a diagram showing the PDP 50 when viewed from a diagonally upward direction of the display surface of the PDP 50.

FIGS. 15–17 show a portion of the internal structure extracted from the PDP 50. As shown in FIG. 16, the PDP 50 is formed with a variety of features, including the column electrodes D and the row electrodes X, Y for producing a discharge in each pixel between a front glass substrate 10 and a back glass substrate 13 arranged in parallel with each other. The surface of the front glass substrate 10 serves as a display surface, the back side of which is formed with a plurality of longitudinal row electrode pairs (X, Y) respectively arranged in parallel in the horizontal direction (left to right in FIG. 5) on the display screen.

The row electrode X is comprised of a electrode Xa made of a transparent conductive film such as ITO in a T-shape; and a black bus electrode Xb made of a metal film. The bus electrode Xb is a strip-shaped electrode which extends in the horizontal direction on the display panel. A narrow proximal end of the transparent electrode Xa extends in the vertical direction on the display screen, and is connected to the bus electrode Xb. The transparent electrode Xa is connected to a position corresponding to each column electrode D on the bus electrode Xb. In other words, the transparent electrode Xa is a protruding electrode which protrudes from the position corresponding to each column electrode D on the strip-shaped bus electrode Xb toward the row electrode Y formed in pair. Similarly, the row electrode Y is comprised of a transparent electrode Ya made of transparent conductive film such as ITO in a T-shape; and a black bus electrode Yb made of a metal film. The bus electrode Yb is a strip-shaped electrode which extends in the horizontal direction on the display screen. A narrow proximal end of the transparent electrode Ya extends in the vertical direction on the display screen, and is connected to the bus electrode Yb. The transparent electrode Ya is connected to a position corresponding to each column electrode D on the bus electrode Yb. In other words, the transparent electrode Ya is a protruding electrode which protrudes from the position corresponding to each column electrode D on the strip-shaped bus electrode Yb toward the row electrode X formed in pair. The row electrodes X, Y are alternately arranged in the vertical direction (up-down direction in FIG. 6, and left to right in FIG. 7) of the front glass substrate 10. The respective transparent electrodes Xa, Ya arranged in parallel at equal intervals along the bus electrodes Xb, Yb extend toward the row electrodes with which they are formed in pair. Wider distal ends of the respective transparent electrodes Xa, Ya are arranged opposite to each other through a discharge gap g of a predetermined width.

As shown in FIG. 16, the front glass substrate 10 is formed with a dielectric layer 11 on the back side to cover the row electrode pairs (X, Y). An eminent dielectric layer 12 protruding from the dielectric layer 11 toward the back side is formed at a position corresponding to each control discharge cell C2 (later described) on the surface of the dielectric layer 11. The eminent dielectric layer 12 is formed of a light absorbing layer including a black or dark pigment, extending in a direction parallel with the bus electrodes Xb, Yb. The surface of the eminent dielectric layer 12 and the surface of the dielectric layer 11 not formed with the eminent dielectric layer 12 are covered with a protection layer made of MgO, not shown. The back glass substrate 13 arranged in parallel with the front glass substrate 10 through a discharge space is formed with a protruding rib 17 at a position opposing the eminent dielectric layer 12, as shown in FIG. 16. The protruding rib 17 extends in the horizontal direction on the display screen. On the back glass substrate 13, a plurality of column electrodes D extending in a direction (vertical direction) perpendicular to the bus electrodes Xb, Yb are arranged in parallel with and spaced away from each other by a predetermined interval. As shown in FIG. 17, each column electrode D is formed at a position on the back glass substrate 13 opposing the transparent electrodes Xa, Ya. A white column electrode protection layer (dielectric layer) 14 is further formed on the back glass substrate 13 for covering the column electrodes D. A partition 15 comprised of first horizontal walls 15A, second horizontal walls 15B, and vertical walls 15C is formed on the column electrode protection layer 14. The first horizontal walls 15A are formed respectively extending in the horizontal direction along the sides of the bus electrodes Yb forming pairs with the bus electrodes Xb of the respective row electrodes X, viewed from the front glass substrate 10. The second horizontal walls 15B are formed respectively extending in parallel with and spaced apart from the first horizontal walls 15A by predefined intervals along the sides of the bus electrodes Xb forming pairs with the bus electrodes Yb of the respective row electrodes Y. The vertical walls 15C are formed respectively extending in the vertical direction at positions between the respective transparent electrodes Xa, Ya arranged at equal intervals along the bus electrodes Xb, Yb.

The height of the first horizontal walls 15A and vertical walls 15C is set to be equal to the interval between the protection layer which protects the back side of the eminent dielectric layer 12 and the column electrode protection layer 14 which covers the column electrodes D. In other words, the first horizontal walls 15A and vertical walls 15C are in contact with the back side of the protection layer which covers the eminent dielectric layer 12. On the other hand, the height of the second horizontal walls 15B is slightly smaller than the height of the first horizontal wall 15A and vertical wall 15C. In other words, the second horizontal walls 15B are not in contact with the protection layer which covers the eminent dielectric layer 12, so that a gap r as shown in FIG. 16 exists between the second horizontal wall 15B and the protection layer which covers the eminent dielectric layer 12.

As shown in FIG. 15, a region surrounded by the first horizontal wall 15A and vertical wall 15C is a pixel cell PC which carries a pixel. The pixel cell PC is partitioned by the second horizontal wall 15B into a display discharge cell C1 and a control discharge cell C2. Each of the display discharge cell C1 and control discharge cell C2 is filled with a discharge gas, and both are communicated with each other through the gap r.

The display discharge cell C1 includes a pair of transparent electrodes Xa, Ya opposing each other. Specifically, the display discharge cell C1 is formed therein with the transparent electrode Xa of the row electrode X and the transparent electrode Ya of the row electrode Y in a row electrode pair (X, Y) corresponding to a display line to which the pixel cell PC belongs, in opposition to each other through the discharge gap g. For example, the transparent electrode Xa of the row electrode X2 and the transparent electrode Ya of the row electrode Y2 are formed in each of the display discharge cells C1 in pixel cells $PC_{2,1}$–$PC_{2,m}$ belonging to a second display line.

The control discharge cell C2 includes the protruding rib 17, bus electrodes Xb, Yb, and eminent dielectric layer 12. The bus electrode Yb formed in the control discharge cell C2 is the bus electrode of the row electrode Y in the row electrode pair (X, Y) corresponding to a display line to which the pixel cell PC belongs. The bus electrode Xb formed in the control discharge cell C2 is the bus electrode of the row electrode X which carries a display line upwardly adjacent to the display line to which the pixel cell PC belongs. For example, each of the control discharge cells C2 in pixel cells $PC_{2,1}$–$PC_{2,m}$ belonging to the second display line is formed therein with the bus electrode Yb of a row electrode $Y_2$ corresponding to this second display line, and the bus electrode Xb of a row electrode $Y_1$ corresponding to the first display line upwardly adjacent to the second display line. No display line exists above the first display line. Therefore, in the PDP 50, a row electrode $X_0$ is provided at a position upwardly adjacent to the row electrode $Y_1$ which comprises the first display line. Specifically, each of the control discharge cells C2 in the pixel cells $PC_{1,1}$–$PC_{1,m}$ belonging to the first display line is formed therein with the bus electrode $Y_b$ of the row electrode $Y_1$ corresponding to the first display line, and the bus electrode $X_b$ of the row electrode $X_0$.

A fluorescent layer 16 is formed on the respective side surfaces of the first horizontal wall 15A, second horizontal wall 15B, and vertical wall 15C which face the discharge space of each display discharge cell C1, and on the surface of the column electrode protection layer 14, so as to cover these five surfaces. The fluorescent layer 16 comprises three groups, i.e., a red fluorescent layer for emitting light in red; a green fluorescent layer for emitting light in green; and a blue fluorescent layer for emitting light in blue, and the assignment of color is determined for each pixel cell PC. Such a fluorescent layer is not formed in the control discharge cells C2.

On the back glass substrate 13, a protruding rib 17 extending in a strip shape along the horizontal direction on the display screen is formed at a position corresponding to each control discharge cell C2. The protruding rib 17 is lower than the second horizontal wall 15B. The protruding rib 17 raises the column electrode D and column electrode protection layer 14 from the back glass substrate 13, as shown in FIG. 16, in each control discharge cell C2. Therefore, a spacing s2 between the column electrode D formed at the position corresponding to the control discharge cell C2 and the bus electrode Xb (Yb) is smaller than a spacing s1 between the column electrode D formed at the position corresponding to the display discharge cell C1 and the transparent electrode Xa (Ya). The protruding rib 17 may be formed of the same dielectric material as the column electrode protection layer 14, or may be made by forming ruggedness on the back glass substrate 13 by such a method as sand blast, wet etching, and the like.

As described above, the PDP 50 is formed with the pixel cells $PC_{1,1}$–$PC_{n,m}$ in matrix, each enclosed by the partition 15 (first horizontal wall 15A and vertical wall 15C) between the front glass substrate 10 and back glass substrate 13. In this event, each pixel cell PC comprises the display discharge cell C1 and control discharge cell C2 with their discharge spaces communicating with each other, and is driven in the following manner through the row electrodes $X_0$, $X_1$–$X_n$, row electrodes $Y_1$–$Y_n$, and column electrodes $D_1$–$D_n$.

The odd-numbered X electrode driver 51 applies a variety of driving pulses (later described) to odd-numbered row electrodes X of the PDP 50, i.e., each of the row electrodes $X_1, X_3, X_5, \ldots, X_{n-3}, X_{n-1}$ in response to a timing signal supplied from the driving control circuit 56. The even-numbered X electrode driver 52 applies a variety of driving pulses (later described) to even-numbered row electrodes X of the PDP 50, i.e., each of the row electrodes $X_0, X_2, X_4, \ldots, X_{n-2}, X_n$ in response to a timing signal supplied from the driving control circuit 56. The odd-numbered Y electrode driver 53 applies a variety of driving pulses (later described) to odd-numbered row electrodes Y of the PDP 50, i.e., each of the row electrodes $Y_1, Y_3, Y_5, \ldots, Y_{n-3}, Y_{n-1}$ in response to a timing signal supplied from the driving control circuit 56. The even-numbered Y electrode driver 54 applies a variety of driving pulses (later described) to odd-numbered row electrodes Y of the PDP 50, i.e. , each of the row electrodes $Y_2, Y_4, \ldots, Y_{n-2}, Y_n$ in response to a timing signal supplied from the driving control circuit 56. The address driver 55 applies a variety of driving pulses (later described) to the column electrodes $D_1$–$D_m$ of the PDP 50 in response to a timing signal supplied from the driving control circuit 56.

The driving control circuit 56 controls and drives the PDP 50 based on the so-called subfield (subframe) method which divides each field (frame) in a video signal into N subfields SF1–SF(N) for driving. The driving control circuit 56 first converts an input video signal to pixel data representative of a luminance level for each pixel. Next, the driving control circuit 56 converts the pixel data to a group of pixel driving data bits DB1–DB(N) for specifying whether or not light is emitted in each of the subfields SF1–SF(N), and supplies the address driver 55 with the pixel driving data bits DB1–DB (N).

Figure 18:
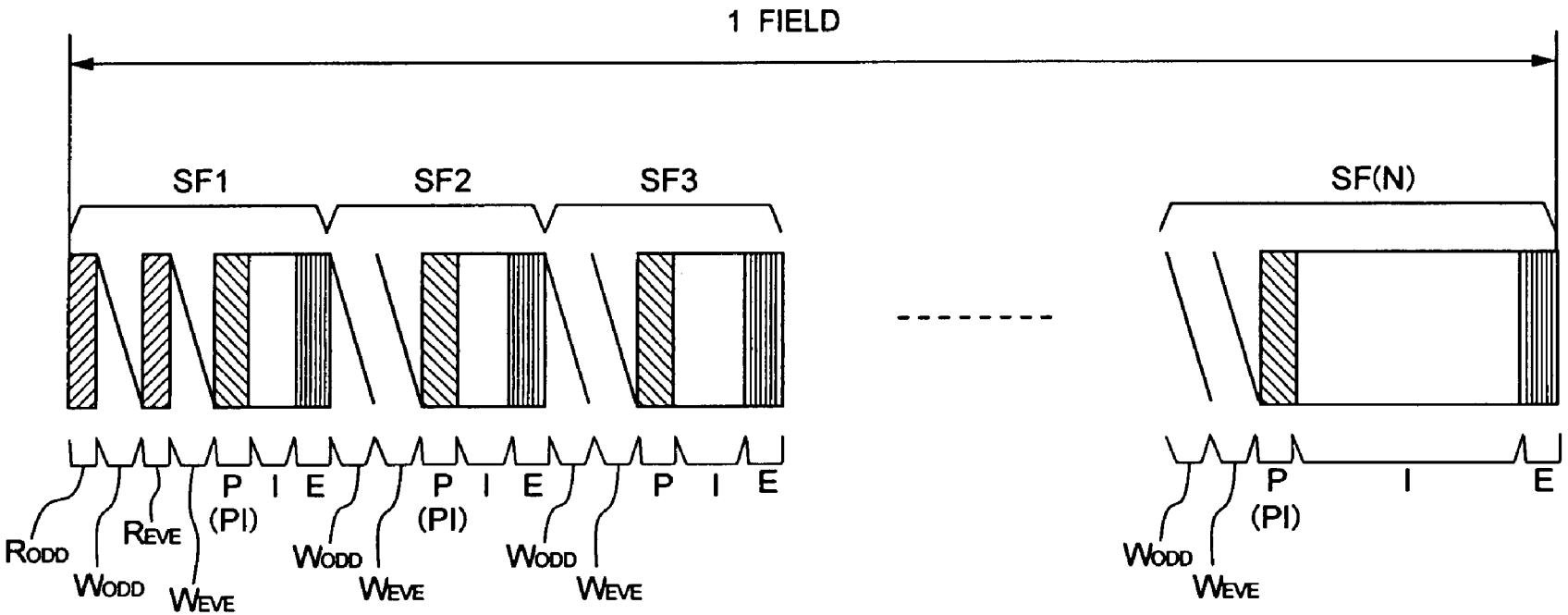
FIG. 18 is a diagram showing an example of a light emission driving sequence when a selective write address method is employed to drive the PDP 50.

The driving control circuit 56 further generates a variety of timing signals for controlling and driving the PDP 50 in accordance with a light emission driving sequence as shown in FIG. 18, and supplies the timing signals to the odd-numbered X electrode driver 51, even-numbered X electrode driver 52, odd-numbered Y electrode driver 53, and even-numbered Y electrode driver 54.

In the light emission driving sequence shown in FIG. 18, an odd-numbered row reset stage $R_{ODD}$, an odd-numbered row address stage $W_{ODD}$, an even-numbered row reset stage $R_{EVE}$, an even-numbered row address stage $W_{EVE}$, a priming stage P, a sustain stage I, and an erasure stage E are sequentially performed in the first subfield SF1. Also, the odd-numbered row address stage $W_{ODD}$, even-numbered row address stage $W_{EVE}$, priming stage P, sustain stage I, and erasure stage E are performed in sequence in each of the subfields SF2–SF(N).

Figure 19:
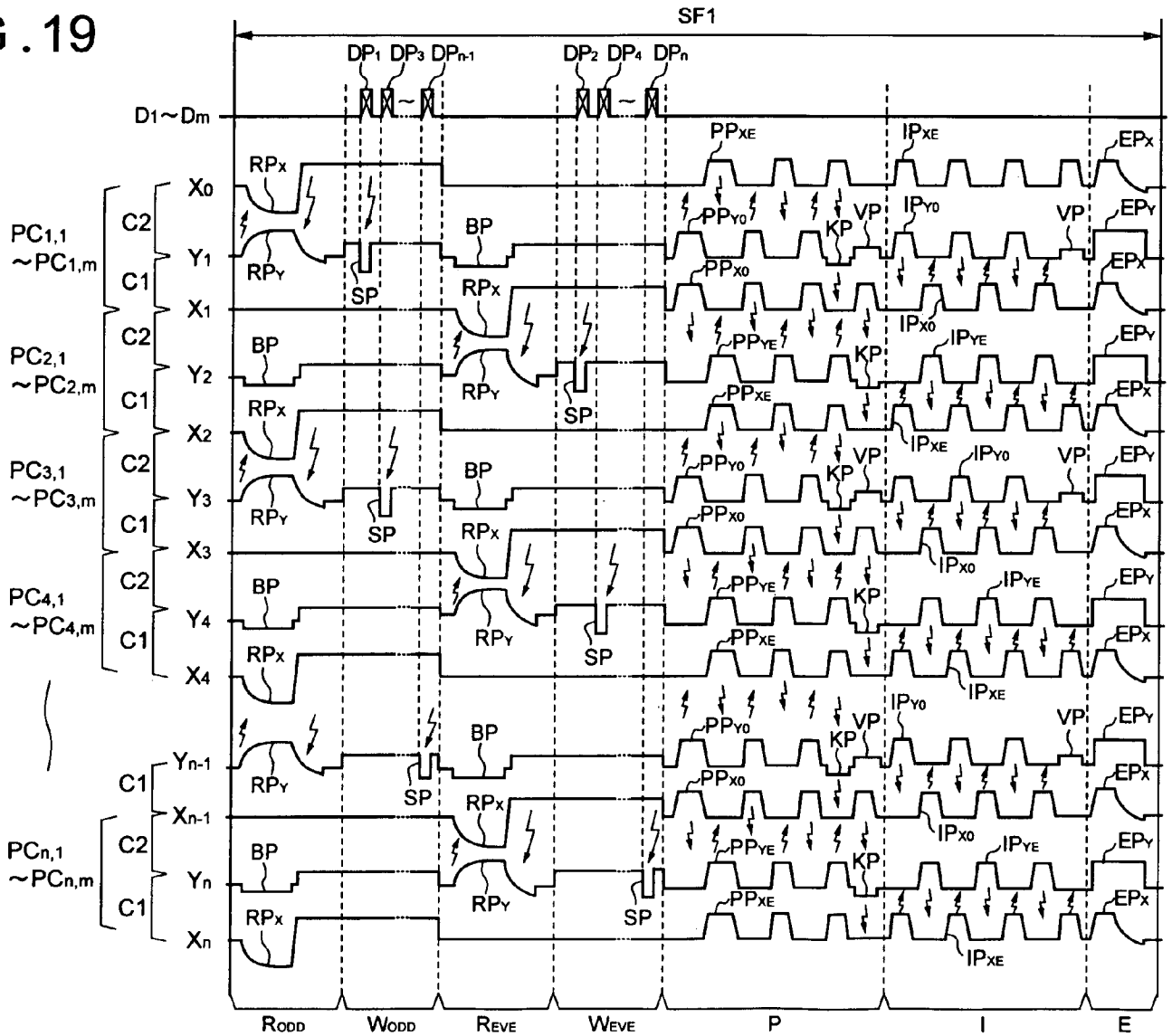
FIG. 19 is a diagram showing a variety of driving pulses applied to the PDP 50 in the first subfield SF1 in accordance with the light emission driving sequence shown in FIG. 18, and timings at which the driving pulses are applied.
Figure 20:
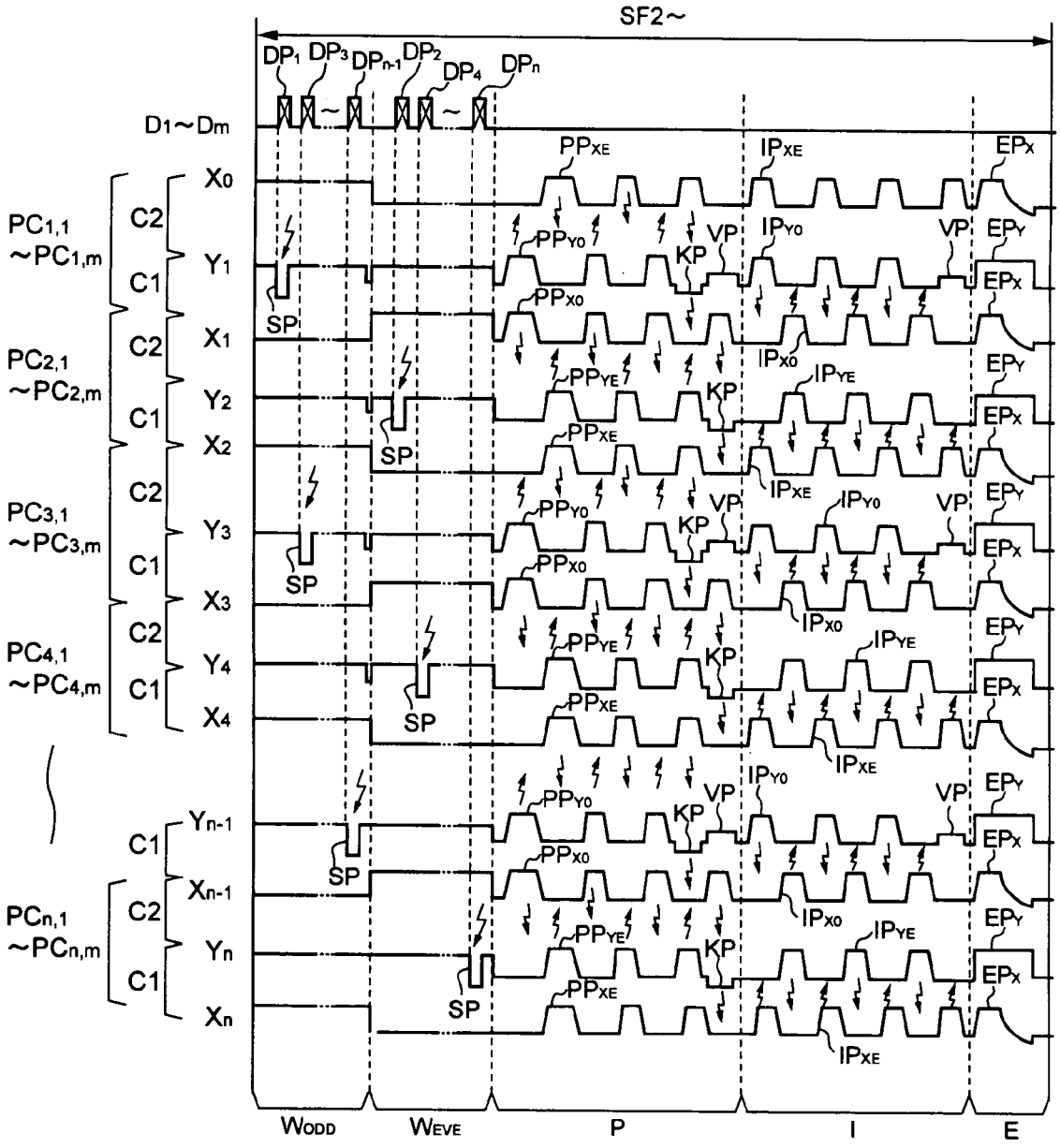
FIG. 20 is a diagram showing a variety of driving pulses applied to the PDP 50 in subfields subsequent to SF2 in accordance with the light emission driving sequence shown in FIG. 18, and timings at which the driving pulses are applied.

FIG. 19 is a diagram showing a variety of driving pulses applied to the PDP 50 by each of the odd-numbered X electrode driver 51, even-numbered X electrode driver 52, odd-numbered Y electrode driver 53, even-numbered Y electrode driver 54, and address driver 55 in the first subfield SF1, and timings at which the respective driving pulses are applied. FIG. 20 in turn shows a diagram showing a variety of driving pulses applied to the PDP 50 by each of the odd-numbered X electrode driver 51, even-numbered X electrode driver 52, odd-numbered Y electrode driver 53, even-numbered Y electrode driver 54, and address driver 55 in each of the subfields SF2–SF(N), and timings at which the respective driving pulses are applied. First, in the odd-numbered row reset stage $R_{ODD}$ of the subfield SF1, the even-numbered X electrode driver 52 generates a negative reset pulse $RP_X$ having a waveform as shown in FIG. 19, which is simultaneously applied to the respective even-numbered row electrodes $X_0, X_2, X_4, \ldots, X_{n-2}, X_n$. After applying the reset pulse $PR_X$, the even-numbered X electrode driver 52 continuously applies a constant high voltage as shown in FIG. 19. Simultaneously with the application of the reset pulse $PR_X$, the odd-numbered Y electrode driver 53 simultaneously applies a positive reset pulse RPY having a waveform as shown in FIG. 19 to the respective odd-numbered row electrodes $Y_1, Y_3, Y\backslash_5, \ldots, Y_{n-3}\ Y_{n-1}$. Level transitions in rising sections and falling sections of the respective reset pulses $RP_X$, $PR_Y$ are slower than level transitions in a rising section and a falling section of a sustain pulse IP, later described. Further, the level transition in the falling section of the reset pulse $PR_Y$ is slower than the level transition in the rising section of the reset pulse $RP_X$. In response to the applications of the reset pulses $RP_X$, $PR_Y$, a reset discharge is produced in the control discharge cell C2 of each of pixel cells $PC_{1,1}$–$PC_{1,m}$, $PC_{3,1}$–$PC_{3,m}$, $PC_{5,1}$–$PC_{5,m}$, . . . , $PC_{(n-1),1}$–$PC_{(n-1),m}$ belonging to the odd-numbered display lines. Specifically, the application of the reset pulses $RP_X$, $PR_Y$ causes the reset discharge to be produced between the bus electrodes Xb and Yb formed in the control discharge cell C2 as shown in FIG. 15. In this event, the first reset discharge is produced at a rising edge of the reset pulse $RP_Y$, and a wall charge is formed on the surface of the eminent dielectric layer 12 in the control discharge cell C2 immediately after the discharge. Subsequently, the second reset discharge is produced at a falling edge of the reset pulse $RP_Y$ to extinguish the wall charge formed in the control discharge cell C2. In the odd-numbered row reset stage $R_{ODD}$, the even-numbered Y electrode driver 54 simultaneously applies a negative discharge preventing pulse BP to the even-numbered row electrodes $Y_2, Y_4, \ldots, Y_{n-2}, Y_n$ of the PDP 50 at the same timing as the reset pulses $RP_X$, $RP_Y$. After the application of the discharge preventing pulse BP, the even-numbered Y electrode driver 54 continuously applies a constant high voltage as shown in FIG. 19. The application of the constant high voltage and the application of the discharge preventing pulse BP prevent erroneous discharges in pixel cells PC belonging to even-numbered display lines.

In this manner, in the odd-numbered row reset stage $R_{ODD}$, the wall discharges are extinguished from the control discharge cells C2 of all the pixel cells PC belonging to the odd-numbered display lines of the PDP 50 to initialize all the pixel cells PC belonging to the odd-numbered display lines to an unlit cell state.

Next, in the odd-numbered row address stage $W_{ODD}$ of each subfield, the odd-numbered Y electrode driver 53 sequentially applies a negative scanning pulse SP to the respective odd-numbered row electrodes $Y_1, Y_3, Y_5, \ldots, Y_{n-3}\ Y_{n-1}$ of the PDP 50. Meanwhile, the address driver 55 converts those of the pixel driving data bits DB corresponding to the subfield SF belonging to the odd-numbered row address stage $W_{ODD}$ which correspond to the odd-numbered display lines to pixel data pulses DP having pulse voltages in accordance with the logical levels. For example, the address driver 55 converts a pixel driving data bit at logical level "1" to a high voltage pixel data pulse DP of positive polarity, and converts a pixel driving data bit at logical level "0" to a pixel data pulse DP at a low voltage (zero volts). Then, the address driver 55 sequentially applies the pixel data pulses PD to the column electrodes $D_1$–$D_m$, one display line by one display line, in synchronism with the timing at which the scanning pulse SP is applied. Specifically, the address driver 55 converts pixel driving data bits $DB_{1,1}$–$DB_{1,m}$, $DB_{3,1}$–$DB_{3,m}$, , . . . , $DB_{(n-1),1}$–$DB_{(n-1),m}$ corresponding to the odd-numbered display lines to pixel data pulses $DP_{1,1}$–$DP_{1,m}$, $DP_{3,1}$–$DP_{3,m}$, . . . , $DP_{(n-1),1}$–$DP_{(n-1),m}$, and applies the pixel data pulses to the column electrodes $D_1$–$D_m$ one display line by one display line. In this event, an address discharge (selective write discharge) is produced between the column electrode D and bus electrode Yb, and between the bus electrodes Ya and YB in the control discharge cell C2 of a pixel cell PC which is applied with the scanning pulse SP and also with the high voltage pixel data pulse DP. In this event, the wall charge is formed on the surface of the eminent dielectric layer 12 in the control discharge cell C2 in which the address discharge is produced. On the other hand, the address discharge as described above is not produced in the control discharge cell C2 of a pixel cell PC which is applied with the scanning pulse SP but with the negative pixel data pulse DP. Therefore, no wall charge is formed in the control discharge cell C2 of the pixel cell PC.

In this manner, in the odd-numbered row address stage $W_{ODD}$, the wall charges are selectively formed in accordance with pixel data (input video signal) in the control discharge cells of the pixel cells PC which belong to the odd-numbered display lines of the PDP 50.

Next, in the even-numbered row reset stage $R_{EVE}$ of the subfield SF1, the odd-numbered X electrode driver 51 generates the negative reset pulse $RP_X$ having the waveform as shown in FIG. 19, which is simultaneously applied to the respective odd-numbered row electrodes $X_1$, $X_3$, $X_5$, . . . , $X_{(n-3)}$, $X_{(n-1)}$ of the PDP 50. After the application of the reset pulse $PR_X$, the odd-numbered X electrode driver 51 continuously applies the constant high voltage as shown in FIG. 19. Simultaneously with the application of the reset pulse $RP_X$, the even-numbered Y electrode driver 54 simultaneously applies the positive reset pulse $RP_Y$ having the waveform as shown in FIG. 19 to the respective even-numbered row electrodes $Y_2$, $Y_4$, $Y_6$, . . . , $Y_{(n-2)}$, $Y_n$ of the PD 50. The level transitions in the rising sections and falling sections of the respective reset pulses $RP_X$, $PR_Y$ are slower than the level transitions in the rising section and falling section of the sustain pulse IP, later described. Further, the level transition in the falling section of the reset pulse $PR_Y$ is slower than the level transition in the rising section of the reset pulse $RP_X$. In response to the applications of the reset pulses $RP_X$, $PR_Y$, a reset discharge is produced between the bus electrodes Xb and Yb in the control discharge cell C2 of each of pixel cells $PC_{2,1}$–$PC_{2,m}$, $PC_{4,1}$–$PC_{4,m}$, $PC_{6,1}$–$PC_{6,m}$, . . . , $PC_{n,1}$–$PC_{n,m}$ belonging to the even-numbered display lines. In this event, the first reset discharge is produced at a rising edge of the reset pulse $RP_Y$, and a wall charge is formed on the surface of the eminent dielectric layer 12 in the control discharge cell C2 immediately after the discharge. Subsequently, the second reset discharge is produced at a falling edge of the reset pulse $RP_Y$ to extinguish the wall charge formed in the control discharge cell C2. In the even-numbered row reset stage $R_{EVE}$, the odd-numbered Y electrode driver 53 simultaneously applies a negative discharge preventing pulse BP to the odd-numbered row electrodes $Y_1$, $Y_3$, $Y_5$, . . . , $Y_{(n-1)}$ of the PDP 50 at the same timing as the reset pulses $RP_X$, $RP_Y$. After the application of the discharge preventing pulse BP, the odd-numbered Y electrode driver 53 continuously applies a constant high voltage as shown in FIG. 19. The application of the constant high voltage and the application of the discharge preventing pulse BP prevent discharges in pixel cells PC belonging to the odd-numbered display lines.

In this manner, in the even-numbered row reset stage $R_{EVE}$, the wall discharges are extinguished from the control discharge cells C2 of all the pixel cells PC belonging to the even-numbered display lines of the PDP 50 to initialize all the pixel cells PC belonging to the even-numbered display lines to an unlit cell state.

Next, in the even-numbered row address stage $W_{EVE}$ of each subfield, the even-numbered Y electrode driver 54 sequentially applies a negative scanning pulse SP to the respective even-numbered row electrodes $Y_2$, $Y_4$, $Y_6$, . . . , $Y_n$ of the PDP 50. Meanwhile, the address driver 55 converts those of the pixel driving data bits DB corresponding to the subfield SF belonging to the even-numbered row address stage $W_{EVE}$ which correspond to the even-numbered display lines to pixel data pulses DP having pulse voltages in accordance with the logical levels. For example, the address driver 55 converts a pixel driving data bit at logical level "1" to a high voltage pixel data pulse DP of positive polarity, and converts a pixel driving data bit at logical level "0" to a pixel data pulse DP at a low voltage (zero volts). Then, the address driver 55 sequentially applies the pixel data pulses PD to the column electrodes $D_1$–$D_m$, one display line by one display line, in synchronism with the timing at which the scanning pulse SP is applied. Specifically, the address driver 55 converts pixel driving data bits $DB_{2,1}$–$DB_{2,m}$, $DB_{4,1}$–$DB_{4,m}$, . . . , $DB_{n,1}$–$DB_{n,m}$ corresponding to the even-numbered display lines to pixel data pulses $DP_{2,1}$–$DP_{2,m}$, $DP_{4,1}$–$DP_{4,m}$, . . . , $DP_{n,1}$–$DP_{n,m}$, and applies the pixel data pulses to the column electrodes $D_1$–$D_m$ one display line by one display line. In this event, an address discharge (selective write discharge) is produced between the column electrode D and bus electrode Yb, and between the bus electrodes Ya and YB in the control discharge cell C2 of a pixel cell PC which is applied with the scanning pulse SP and also with the high voltage pixel data pulse DP. In this event, the wall charge is formed on the surface of the eminent dielectric layer 12 in the control discharge cell C2 in which the address discharge is produced. On the other hand, the address discharge as described above is not produced in the control discharge cell C2 of a pixel cell PC which is applied with the scanning pulse SP but with the negative pixel data pulse DP. Therefore, no wall charge is formed in the control discharge cell C2 of the pixel cell PC.

In this manner, in the even-numbered row address stage $W_{EVE}$, the wall charges are selectively formed in accordance with pixel data (input video signal) in the control discharge cells C2 of the pixel cells PC which belong to the odd-numbered display lines of the PDP 50.

Next, in the priming stage P of each subfield, the odd-numbered Y electrode driver 53 intermittently repeats a positive priming pulse $PP_{YO}$ as shown in FIG. 19 which is applied to the respective odd-numbered row electrodes $Y_1$, $Y_3$, $Y_5$, . . . , $Y_{(n-1)}$. Also, in the priming stage P, the odd-numbered X electrode driver 51 intermittently applies a positive priming pulse $PP_{XO}$, as shown in FIG. 19, repeatedly to the respective odd-numbered row electrodes $X_1$, $X_3$, $X_5$, . . . $X_{(n-1)}$. Further, in the priming stage P, the even-numbered X electrode driver 52 intermittently applies a positive priming pulse $PP_{XE}$, as shown in FIG. 19, repeatedly to the respective even-numbered row electrodes $X_0$, $X_2$, $X_4$, . . . , $X_{n-2}$, $X_n$. Further, in the priming stage P, the even-numbered Y electrode driver 54 intermittently applies a positive priming pulse $PP_{YE}$ repeatedly to the even-numbered row electrodes $Y_2, Y_4, \ldots, Y_{n-2}, Y_n$. The priming pulses $PP_{XE}$, $PP_{YE}$ applied to the even-numbered row electrodes X, Y, and the priming pulses $PP_{XO}$, $PP_{YO}$ applied to the odd-numbered row electrodes X, Y are applied at timings offset from each other, as shown in FIG. 19. Each time the priming pulse PP is applied, a priming discharge is produced only in the control discharge cells C2 in which the wall charges are formed. Specifically, the priming discharge is produced between the bus electrodes Xb and Yb only in the control discharge cells C2 in which the wall charges have been formed in the odd-numbered row address stage $W_{ODD}$ or even-numbered row address stage $W_{EVE}$. In this event, charged particles generated by the priming discharge flow into the display discharge cell C1 through the gap r shown in FIG. 7 to extend the discharge toward the display discharge cell C1. Therefore, each time the priming discharge is produced in the control discharge cell C2, the discharge is extended more toward the display discharge cell C1, so that the wall charges are gradually accumulated on the surface of the dielectric layer 11 in the display discharge cell C1. As shown in FIG. 19, the priming pulse PP first applied in the priming state P is given a wider pulse width than the priming pulse PP applied subsequently for preventing an erroneous discharge due to a delayed discharge. Also, at the same timing as the last priming pulse $PP_{XE}$ (or $PP_{YE}$) in the priming stage P, the odd-numbered Y electrode driver 53 applies a negative extension assisting pulse KP as shown in FIG. 19 to the respective odd-numbered row electrodes $Y_1, Y_3, Y_5, \ldots, Y_{(n-1)}$. Further, at the same timing as the last priming pulse $PP_{XO}$ in the priming stage P, the even-numbered Y electrode driver 54 applies the negative extension assisting pulse KP as shown in FIG. 19 to the respective even-numbered row electrodes $Y_2, Y_4, Y_6, \ldots, Y_{n-2}, Y_n$. In response to the simultaneous application of the negative extension assisting pulse KP and positive priming pulse PP, the priming discharge is produced between the bus electrodes Xb and Yb of the control discharge cell C2, and a weak discharge is produced between the transparent electrodes Xa and Ya in the display discharge cell C1. This discharge permits a requisite amount of wall charge for producing a sustain discharge, later described, to be formed on the surface of the dielectric layer 11 of the display discharge cell C1, so that the pixel cell PC including this display discharge cell C1 is set to a lit cell state. On the other hand, no wall charge is formed in the display discharge cell C1 in which no wall charge has been formed in the odd-numbered row address stage $W_{ODD}$ or even-numbered row address stage $W_{EVE}$, and therefore the priming discharge is not produced, so that the pixel cell PC including this display discharge cell C1 is set to an unlit cell state. For preventing an erroneous discharge between the transparent electrodes Xa and Ya in the display discharge cell C1, the odd-numbered Y electrode driver 53 applies a positive erroneous discharge preventing pulse VP as shown in FIG. 19 to the respective odd-numbered row electrodes $Y_1, Y_3, Y_5, \ldots, Y_{n-3}, Y_{n-1}$ immediately after the application of the extension assisting pulse KP.

In this manner, in the priming stage P, only those pixel cells PC having the control discharge cells C2 which have been formed with the wall charges in the odd-numbered row address stage $W_{ODD}$ or even-numbered row address stage $W_{EVE}$ are set to the lit cell state, while those pixel cells PC having the control discharge cells C2 which have not been formed with the wall charges are set to the unlit cell state.

Next, in the sustain stage I of each subfield, the odd-numbered Y electrode driver 53 repeats a positive sustain pulse $IP_{YO}$ as shown in FIG. 19 a number of times assigned to a subfield to which this sustain stage I belongs, and applies the positive sustain pulse $IP_{YO}$ to the respective odd-numbered row electrodes $Y_1, Y_3, Y_5, \ldots, Y_{n-1}$. At the same timing as the sustain pulse $IP_{YO}$, the even-numbered X electrode driver 52 repeats a positive sustain pulse $IP_{XE}$ a number of times assigned to the subfield to which the sustain stage I belongs, and applies the sustain pulse $IP_{XE}$ to the respective even-numbered row electrodes $X_0, X_2, X_4, \ldots, X_{n-2}, X_n$. The odd-numbered X electrode driver 51 repeats a positive sustain pulse $IP_{XO}$ as shown in FIG. 19 a number of times assigned to the subfield to which the sustain stage I belongs, and applies the sustain pulse $IP_{XO}$ to the respective odd-numbered row electrodes $X_1, X_3, X_5, \ldots, X_{(n-1)}$. Further in the sustain stage I, the even-numbered Y electrode driver 54 repeats a positive sustain pulse $IP_{YE}$ a number of times assigned to the subfield to which the sustain stage I belongs, and applies the sustain pulse $IP_{YE}$ to the respective odd-numbered row electrodes $Y_2, Y_4, \ldots, Y_{n-2}, Y_n$. As shown in FIG. 19, the sustain pulses $IP_{XE}$, $IP_{YO}$ and the sustain pulses $IP_{XO}$, $IP_{YE}$ are applied at timings offset from each other. Each time the sustain pulse $IP_{XO}$, $IP_{XE}$, $IP_{YO}$ or $IP_{YE}$ is applied, a sustain discharge is produced between the transparent electrodes Xa and Ya in the display discharge cell C1 of a pixel cell PC which is set in the lit cell state. In this event, ultraviolet rays generated in the sustain discharge excite the fluorescent layer 16 (red fluorescent layer, green fluorescent layer, blue fluorescent layer) formed in the display discharge cell C1 to radiate a color corresponding to the fluorescent light color through the front glass substrate 10. In other words, light emission associated with the sustain discharge is repeatedly produced a number of times assigned to the subfield to which the sustain stage I belongs. For preventing an erroneous discharge between the bus electrodes Xb and Yb in the control discharge cell C2, the odd-numbered Y electrode driver 53 applies the positive erroneous discharge preventing pulse VP as shown in FIG. 19 to the respective odd-numbered row electrodes $Y_1, Y_3, Y_5, \ldots, Y_{(n-1)}$ at the end of the sustain stage I.

In this manner, in the sustain stage I, only pixel cells PC set in the lit cell state are driven to repeatedly emit light the number of times assigned to the subfield.

Next, in the erasure stage E of each subfield, the odd-numbered Y electrode driver 53 and even-numbered Y electrode driver 54 apply an erasure pulse $EP_Y$ as shown in FIG. 19 to the row electrodes $Y_1$–$Y_n$ of the PDP 50. Further, simultaneously with the erasure pulse $EP_Y$, the odd-numbered X electrode driver 51 and even-numbered X electrode driver 52 apply an erasure pulse $EP_X$ having a waveform as shown in FIG. 19 to the row electrodes $X_1$–$X_n$ of the PDP 50. As shown in FIG. 19, a level transition of the erasure pulse $EP_X$ is slower when it falls. In response to the application of the erasure pulses $EP_Y$, $EP_X$, an erasure discharge is produced in each of the display discharge cell C1 and control discharge cell C2 of the pixel cell PC which is set in the lit discharge cell at the timing at which the erasure pulse $EP_X$ falls. The erasure discharge causes the wall charge previously formed in each of the display discharge cell C1 and control discharge cell C2 to extinguish. In other words, all the pixel cells PC of the PDP 50 transition to an unlit cell state.

The driving as described above permits an intermediate luminance to be viewed corresponding to a total number of light emission performed in each sustain stage I through the subfields SF1–SF(N). In other words, a displayed image corresponding to an input video signal can be produced by discharge light associated with the sustain discharge produced in the sustain stage I in each subfield.

In this event, in the plasma display device shown in FIG. 14, the sustain discharge involved in the displayed image is produced in the display discharge cell c1 in each pixel cell PC, while the reset discharge, priming discharge, and address discharge associated with light emission not involved in the displayed image are produced in the control discharge cell C2. The control discharge cell C2 is provided with the eminent dielectric layer 12 formed of a light absorbing layer including a black or a dark pigment, as shown in FIG. 16. Therefore, discharge light associated with the reset discharge, priming discharge, and address discharge is blocked by the eminent dielectric layer 12, and therefore will never appear on the display surface through the front glass substrate 10.

Thus, according to the plasma display device shown in FIG. 14, the contrast of the displayed image, particularly, the dark contrast can be improved when an image corresponding to a generally dark scene is displayed.

Also, in the plasma display device shown in FIG. 14, the PDP 50 employs the structure in which the pixel cells PC, each comprised of the display discharge cell C1 and control discharge cell C2, are arranged in matrix. Therefore, the control discharge cells C2 are positioned upward and downward adjacent to the display discharge cells C1. In this event, if the upward and downward adjacent control discharge cells C2 discharge substantially at the same timing, a discharge may be erroneously produced in the display discharge cells C1 sandwiched by these control discharge cells C2. To prevent this erroneous discharge, in the plasma display device shown in FIG. 14, the reset discharges are produced for initializing all the pixel cells PC of the PDP 50 to the unlit cell state temporally separately in the odd-numbered row reset stage $R_{ODD}$ and even-numbered row reset stage $R_{EVE}$, as shown in FIGS. 18–20. Further, the address discharges for selectively forming the wall charges in the control discharge cells C2 of the pixel cells PC in accordance with the pixel data (input video signal) are produced temporally separately in the odd-numbered row address stage $W_{ODD}$ and even-numbered row address stage $W_{EVE}$ in each subfield. In this manner, the control discharge cells C2 upward and downward adjacent to the display discharge cells C1 will not discharge simultaneously, thereby preventing erroneous discharge in the display discharge cells C1.

In the foregoing embodiment (FIG. 18), while the odd-numbered row reset stage $R_{ODD}$, odd-numbered row address stage $W_{ODD}$, even-numbered row reset stage $R_{EVE}$, even-numbered row address stage $W_{EVE}$, priming stage P, sustain stage I, and erasure stage E are sequentially driven in the first subfield SF1, the order in which these stages are performed can be changed as appropriate.

Figure 21:
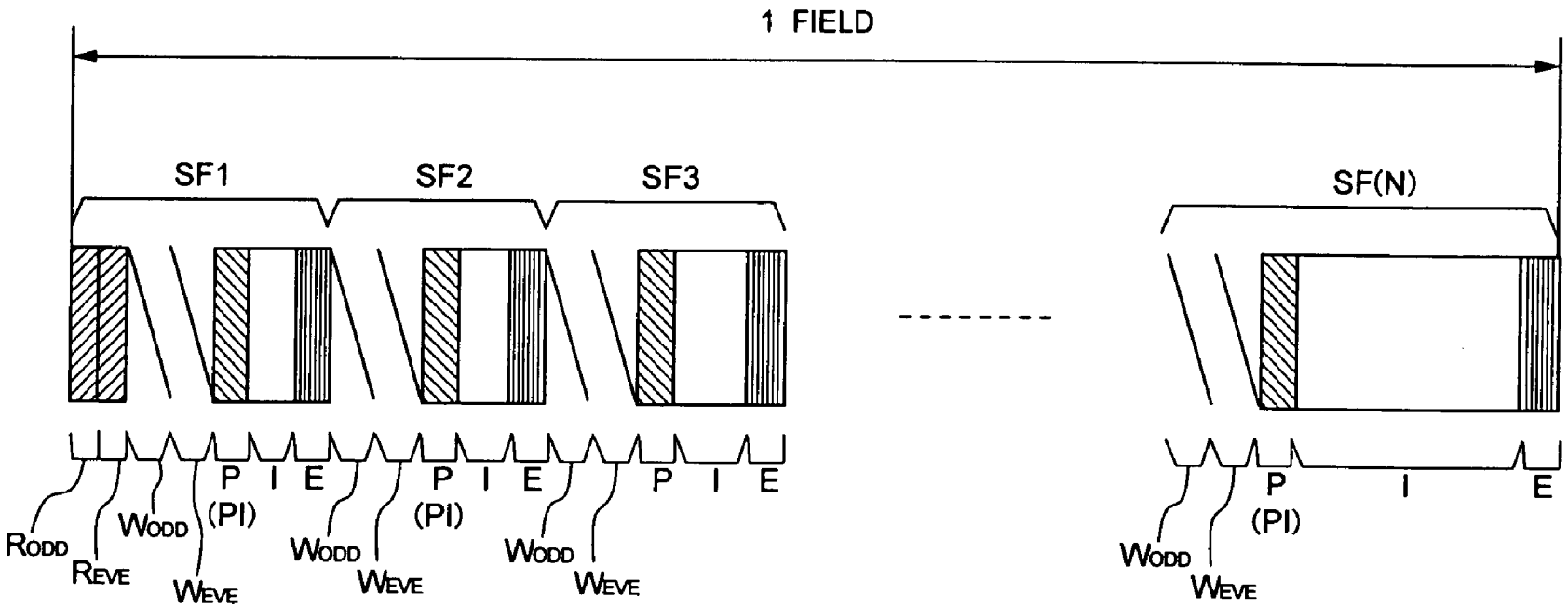
FIG. 21 is a diagram showing another example of the light emission driving sequence when the selective write address method is employed to drive the PDP 50.
Figure 22:
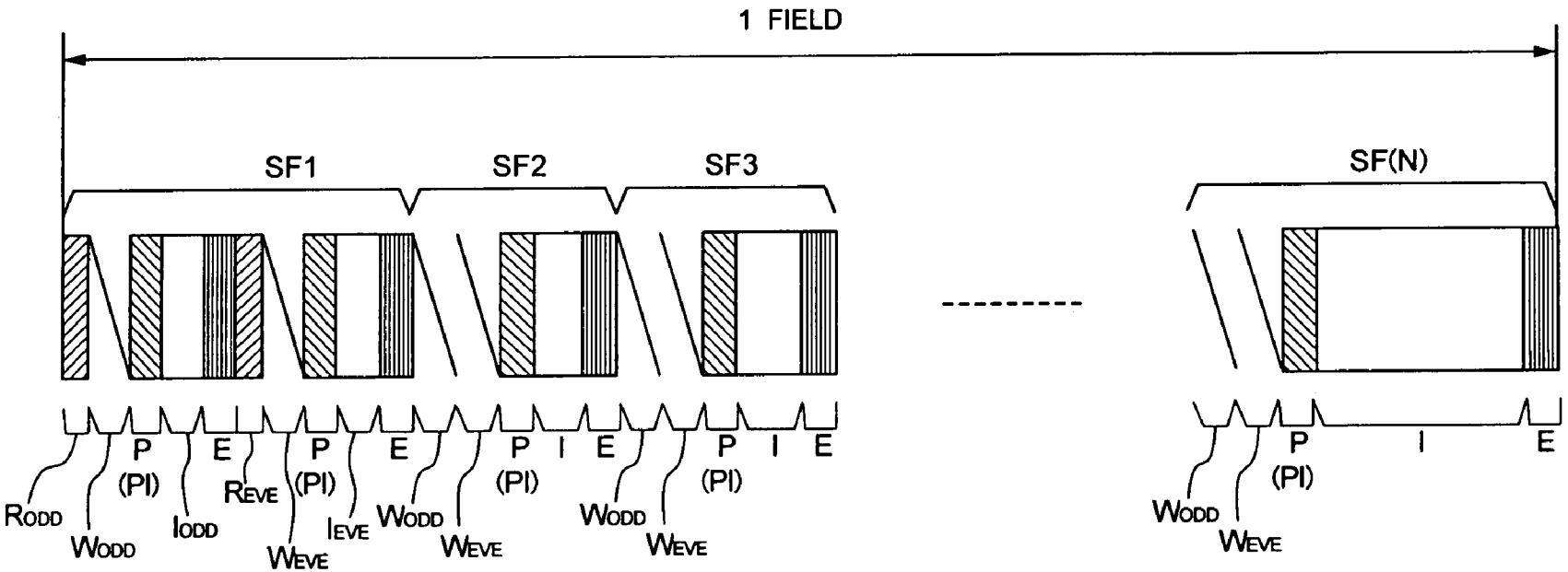
FIG. 22 is a diagram showing a further example of the light emission driving sequence when the selective write address method is employed to drive the PDP 50.

For example, as shown in FIG. 21, these stages may be driven in the order of the odd-numbered row reset stage $R_{ODD}$, even-numbered row reset stage $R_{EVE}$, odd-numbered row address stage $W_{ODD}$, even-numbered row address stage $W_{EVE}$, priming stage P, sustain stage I, and erasure stage E in the subfield SF1. Further alternatively, as shown in FIG. 22, these stages may be driven in the order of the odd-numbered row reset stage $R_{ODD}$, odd-numbered row address stage $W_{ODD}$, priming stage P, sustain stage $I_{ODD}$, erasure stage E, even-numbered row reset stage $R_{EVE}$, even-numbered row address stage $W_{EVE}$, priming stage P, sustain stage $I_{EVE}$, and erasure stage E in the subfield SF1. In other words, the reset stage, address stage, priming stage, sustain stage, and erasure stage are performed for the even-numbered display lines after the reset stage, address stage, priming stage, sustain stage, and erasure stage have been sequentially performed for the odd-numbered display lines.

The foregoing embodiment (FIGS. 18–21) has been described in connection with the selective write address method employed as a pixel data write method for setting each of the pixel cells of the PDP 50 to a wall charge forming state in accordance with pixel data, in which the address discharge is selectively produced in each pixel cell in accordance with pixel data to form a wall charge. However, the present invention can be applied likewise to a plasma display device which employs a so-called selective erasure address method, as the pixel data write method, which involves previously forming wall charges in all the pixel cells, and selectively erasing the wall charges in the pixel cells by address discharges.

FIG. 22 is a diagram showing a light emission driving sequence when the selective erasure address method is employed.

In the light emission driving sequence shown in FIG. 22, an odd-numbered row reset stage $R_{ODD}'$, an odd-numbered row address stage $W_{ODD}'$, an even-numbered row reset stage $R_{EVE}'$, an even-numbered row address stage $W_{EVE}'$, a priming stage P', a sustain stage I', a wall charge moving stage T, and an erasure stage E' are performed in sequence in the first subfield SF1. Also, the odd-numbered row address stage $W_{ODD}'$, even-numbered row reset stage $R_{EVE}'$, priming stage P', sustain stage I', wall charge moving stage T, and erasure stage E' are performed in sequence in each of the subfields SF2–SF(N).

Figure 24:
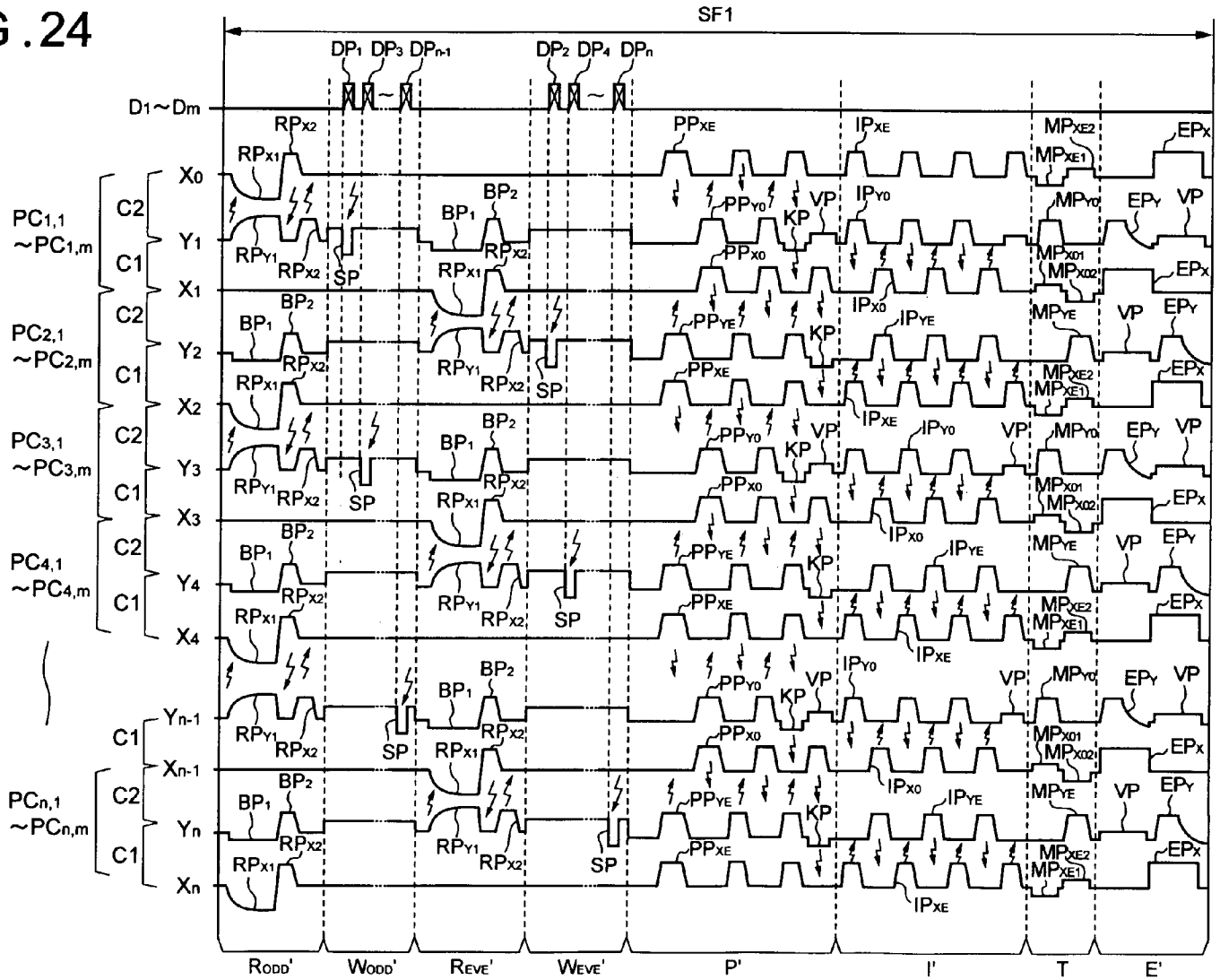
FIG. 24 is a diagram showing a variety of driving pulses applied to the PDP 50 in the first subfield SF1 in accordance with the light emission driving sequence shown in FIG. 23, and timings at which the driving pulses are applied.
Figure 25:
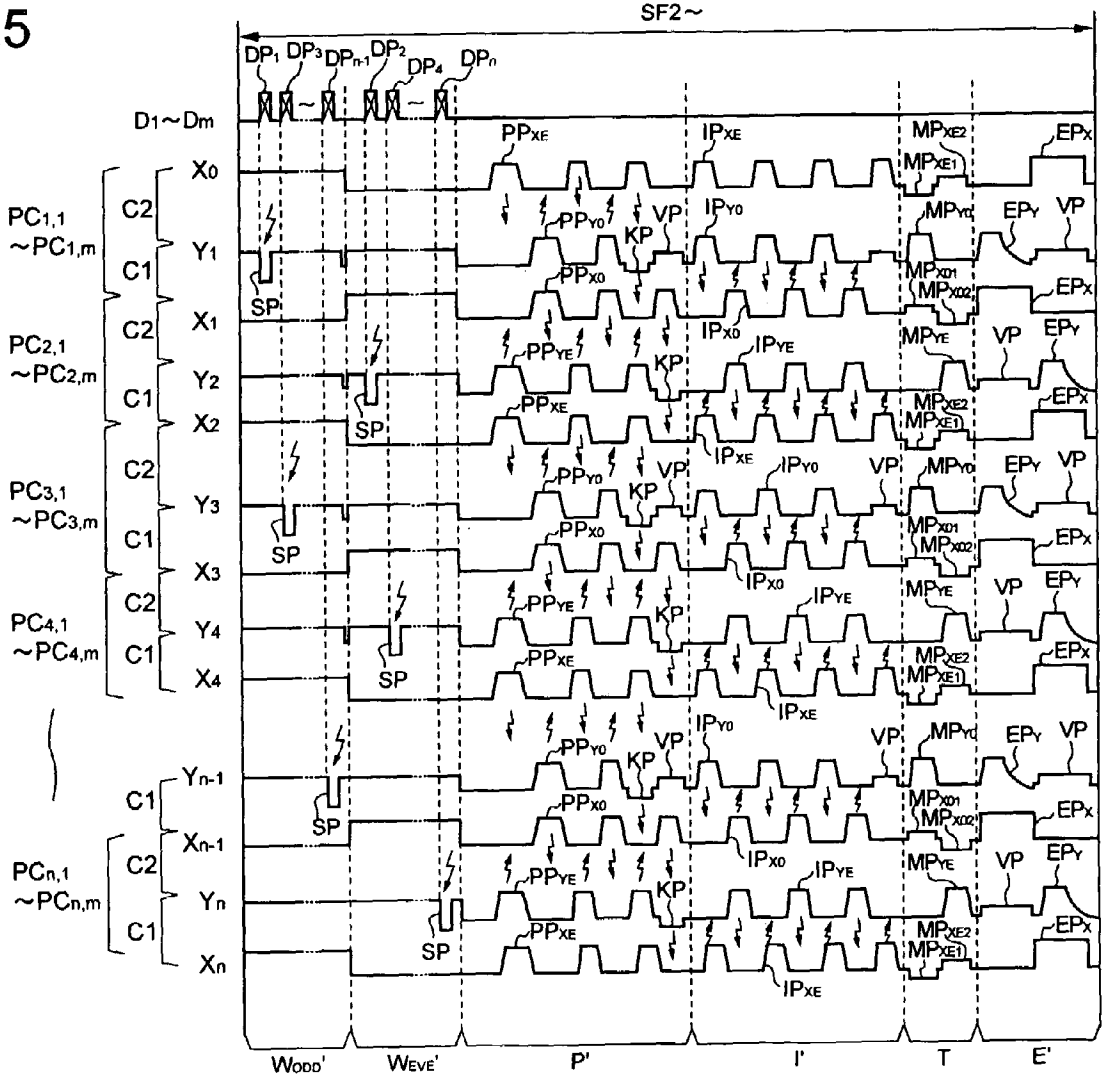
FIG. 25 is a diagram showing a variety of driving pulses applied to the PDP 50 in subfields subsequent to SF2 in accordance with the light emission driving sequence shown in FIG. 23, and timings at which the driving pulses are applied.

FIG. 24 is a diagram showing a variety of driving pulses applied to the PDP 50 in the odd-numbered row reset stage $R_{ODD}'$, odd-numbered row address stage $W_{ODD}'$, even-numbered row reset stage $R_{EVE}'$, even-numbered row address stage $W_{EVE}'$, priming stage P', sustain stage I', wall charge moving stage T, and erasure stage E' of the subfield SF1, and timings at which these driving pulses are applied. FIG. 25 in turn shows a variety of driving pulses applied to the PDP 50 in the odd-numbered row address stage $W_{ODD}'$, even-numbered row address stage $W_{EVE}'$, priming stage P', sustain stage I', and erasure stage E' of each of subfields SF2–SF(N), and timings at which these driving pulses are applied.

First, in the odd-numbered row reset stage $R_{ODD}'$ of the subfield SF1, the even-numbered X electrode driver 52 generates a negative reset pulse $RP_{X1}$ having a waveform as shown in FIG. 24, which is simultaneously applied to the respective even-numbered row electrodes $X_0, X_2, X_4, \ldots, X_{n-2}, X_n$ of the PDP 50. Simultaneously with the application of the reset pulse $PR_{X1}$, the odd-numbered Y electrode driver 53 simultaneously applies a positive reset pulse $RP_{Y1}$ having a waveform as shown in FIG. 24 to the respective odd-numbered row electrodes $Y_1, Y_3, Y_5, \ldots, Y_{n-3}, Y_{n-1}$ of the PDP 50. In response to the applications of the reset pulses $RP_{X1}$, $PR_{Y1}$, a reset discharge is produced between the bus electrodes Xb and Yb in the control discharge cell C2 of each of pixel cells $PC_{1,1}$–$PC_{1,m}$, $PC_{3,1}$–$PC_{3,m}$, $PC_{5,1}$–$PC_{5,m}$, . . . , $PC_{(n-1),1}$–$PC_{(n-1),m}$ belonging to the odd-numbered display lines. The reset discharge causes a wall charge to be formed on the surface of the eminent dielectric layer 12 in the control discharge cell C2. Meanwhile, the even-numbered Y electrode driver 54 simultaneously applies a negative discharge preventing pulse $BP_1$ to the even-numbered row electrodes $Y_2, Y_4, Y_6, \ldots, Y_{n-2}, Y_n$ of the PDP 50 in order to prevent erroneous discharges in the pixel cells PC belonging to the even-numbered display line. Immediately after the application of the reset pulse $RP_{X1}$, the even-numbered X electrode driver 52 simultaneously applies a positive reset pulse $RP_{X2}$ having a waveform as shown in FIG. 24 to the respective even-numbered row electrodes $X_0, X_2, X_4, \ldots, X_{n-2}, X_n$. The reset pulse $PR_{X2}$ thus applied causes a reset discharge to be again produced between the bus electrodes Xb and Yb in the control discharge cell C2 of each of pixel cells $PC_{1,1}$–$PC_{1,m}$, $PC_{3,1}$–$PC_{3,m}$, $PC_{5,1}$–$PC_{5,m}$, . . . , $PC_{(n-1),1}$–$PC_{(n-1),m}$ belonging to the odd-numbered display lines. The reset discharge increases the amount of wall charge formed on the surface of the eminent dielectric layer 12 in the control discharge cell C2. Meanwhile, the oven-numbered Y electrode driver 54 simultaneously applies the positive discharge preventing pulse $BP_2$ as shown in FIG. 24 to the even-numbered row electrodes $Y_2, Y_4, \ldots, Y_{n-2}, Y_n$ of the PDP 50 in order to prevent erroneous discharges in the pixel cells belonging to the even-numbered display line. Immediately after the application of the reset pulse $RP_{X2}$, the odd-numbered Y electrode driver 53 simultaneously applies the positive reset pulse $RP_{Y2}$ having a waveform as shown in FIG. 24 to the respective odd-numbered row electrodes $Y_1, Y_3, Y_5, \ldots, Y_{n-3}$, and $Y_{n-1}$. The reset pulse $RP_{Y2}$ thus applied causes a reset discharge to be again produced between the bus electrodes Xb and Yb in the control discharge cell C2 of each of pixel cells $PC_{1,1}$–$PC_{1,m}$, $PC_{3,1}$–$PC_{3,m}$, $PC_{5,1}$–$PC_{5,m}$, . . . , $PC_{(n-1),1}$–$PC_{(n-1),m}$ belonging to the odd-numbered display lines. The reset discharge increases the amount of wall charge formed on the surface of the eminent dielectric layer 12 in the control discharge cell C2.

In this manner, in the odd-numbered row reset stage $R_{ODD}$', the wall discharges are formed in the control discharge cells C2 of all the pixel cells PC belonging to the odd-numbered display lines of the PDP 50 to initialize all the pixel cells PC belonging to the odd-numbered display lines to a lit cell state.

Next, in the odd-numbered row address stage $W_{ODD}$' of each subfield shown in FIGS. 24 and 25, the odd-numbered Y electrode driver 53 sequentially applies a negative scanning pulse SP to the respective odd-numbered row electrodes $Y_1, Y_3, Y_5, \ldots, Y_{n-3}$, and $Y_{n-1}$ of the PDP 50. Meanwhile, the address driver 55 converts those of the pixel driving data bits DB corresponding to the subfield SF belonging to the odd-numbered row address stage $W_{ODD}$' which correspond to the odd-numbered display lines to pixel data pulses DP having pulse voltages in accordance with the logical levels. For example, the address driver 55 converts a pixel driving data bit at logical level "1" to a high voltage pixel data pulse DP of positive polarity, and converts a pixel driving data bit at logical level "0" to a pixel data pulse DP at a low voltage (zero volts). Then, the address driver 55 sequentially applies the pixel data pulses PD to the column electrodes $D_1$–$D_m$, one display line by one display line, in synchronism with the timing at which the scanning pulse SP is applied. Specifically, the address driver 55 converts pixel driving data bits $DB_{1,1}$–$DB_{1,m}$, $DB_{3,1}$–$DB_{3,m}$, . . . , $DB_{(n-1),1}$–$DB_{(n-1),m}$ corresponding to the odd-numbered display lines to pixel data pulses $DP_{1,1}$–$DP_{1,m}$, $DP_{3,1}$–$DP_{3,m}$, . . . , $DP_{(n-1),1}$–$DP_{(n-1),m}$, and applies the pixel data pulses to the column electrodes $D_1$–$D_m$ one display line by one display line. In this event, an address discharge (selective erasure discharge) is produced between the column electrode D and bus electrode Yb, and between the bus electrodes Ya and Yb in the control discharge cell C2 of a pixel cell PC which is applied with the scanning pulse SP and also with the high voltage pixel data pulse DP. In this event, the wall charge is extinguished on the surface of the eminent dielectric layer 12 in the control discharge cell C2 in which the address discharge is produced. On the other hand, the address discharge as described above is not produced in the control discharge cell C2 of a pixel cell PC which is applied with the scanning pulse SP but with the negative pixel data pulse DP. Therefore, the control discharge cell C2 maintains its previous state (with the wall discharge or without the wall discharge).

In this manner, in the odd-numbered row address stage $W_{ODD}$', the wall charges formed in the control discharge cells C2 of the pixel cells PC which belong to the odd-numbered display lines of the PDP 50 are selectively erased in accordance with pixel data (input video signal).

Next, in the even-numbered row reset stage $R_{EVE}$' of the subfield SF1, the odd-numbered X electrode driver 51 generates the negative reset pulse $RP_{X1}$ having the waveform as shown in FIG. 24, which is simultaneously applied to the respective odd-numbered row electrodes $X_1, X_3, X_5, \ldots, X_{(n-1)}$ of the PDP 50. Simultaneously with the application of the reset pulse $RP_{X1}$, the even-numbered Y electrode driver 54 generates the positive reset pulse $RP_{Y1}$ having the waveform as shown in FIG. 24 which is simultaneously applied to the respective even-numbered row electrodes $Y_2, Y_4, \ldots, Y_{n-2}, Y_n$ of the PD 50. In response to the applications of the reset pulses $RP_{X1}$, $RP_{Y1}$, a reset discharge is produced between the bus electrodes Xb and Yb in the control discharge cell C2 of each of pixel cells $PC_{2,1}$–$PC_{2,m}$, $PC_{4,1}$–$PC_{4,m}$, $PC_{6,1}$–$PC_{6,m}$, . . . , $PC_{n,1}$–$PC_{n,m}$ belonging to the even-numbered display lines. The reset discharge causes wall charges to be formed on the surfaces of the eminent dielectric layers 12 in the control discharge cells C2. Meanwhile, the odd-numbered Y electrode driver 53 simultaneously applies the negative discharge preventing pulse $BP_1$ to the odd-numbered row electrodes $Y_1, Y_3, Y_5, \ldots, Y_{n-3}, Y_{n-1}$ in order to prevent erroneous discharges in the pixel cells PC belonging to the odd-numbered display lines. Immediately after the application of the reset pulse $RP_{X1}$, the even-numbered X electrode driver 52 simultaneously applies a positive reset pulse $RP_{X2}$ having a waveform as shown in FIG. 24 to the respective odd-numbered row electrodes $X_1, X_3, X_5, \ldots, X_{(n-1)}$. The reset pulse $RP_{X2}$ thus applied causes a reset discharge to be again produced between the bus electrodes Xb and Yb in the control discharge cell C2 of each of pixel cells $PC_{2,1}$–$PC_{2,m}$, $PC_{4,1}$–$PC_{4,m}$, $PC_{6,1}$–$PC_{6,m}$, . . . , $PC_{n,1}$–$PC_{n,m}$ belonging to the odd-numbered display lines. The reset discharge increases the amount of wall charge formed on the surface of the eminent dielectric layer 12 in the control discharge cell C2. Meanwhile, the odd-numbered Y electrode driver 53 simultaneously applies a positive discharge preventing pulse $BP_2$ as shown in FIG. 24 to the odd-numbered row electrodes $Y_1, Y_3, Y_5, \ldots, Y_{n-3}, Y_{n-1}$ of the PDP 50 in order to prevent erroneous discharges in the pixel cells PC belonging to the odd-numbered display line. Immediately after the application of the reset pulse $RP_{X2}$, the even-numbered Y electrode driver 54 simultaneously applies a positive reset pulse $RP_{Y2}$ having a waveform as shown in FIG. 24 to the respective even-numbered row electrodes $Y_2, Y_4, \ldots, Y_{n-3}$, an2 $Y_n$. The reset pulse $RP_{Y2}$ thus applied causes a reset discharge to be again produced between the bus electrodes Xb and Yb in the control discharge cell C2 of each of pixel cells $PC_{2,1}$–$PC_{2,m}$, $PC_{4,1}$–$PC_{4,m}$, $PC_{6,1}$–$PC_{6,m}$, . . . , $PC_{n,1}$–$PC_{n,m}$ belonging to the even-numbered display lines. The reset discharge increases the amount of wall charge formed on the surface of the eminent dielectric layer 12 in the control discharge cell C2.

In this manner, in the even-numbered row reset stage $R_{EVE}$', the wall discharges are formed in the control discharge cells C2 of all the pixel cells PC belonging to the even-numbered display lines of the PDP 50 to initialize all the pixel cells PC belonging to the even-numbered display lines to a lit cell state.

Next, in the even-numbered row address stage $W_{EVE}'$ of each subfield shown in FIGS. 24 and 25, the even-numbered Y electrode driver 54 sequentially applies a negative scanning pulse SP to the respective even-numbered row electrodes $Y_2, Y_4, Y_6, \ldots, Y_n$ of the PDP 50. Meanwhile, the address driver 55 converts those of the pixel driving data bits DB corresponding to the subfield SF belonging to the even-numbered row address stage $W_{eve}'$ which correspond to the even-numbered display lines to pixel data pulses DP having pulse voltages in accordance with the logical levels. For example, the address driver 55 converts a pixel driving data bit at logical level "1" to a high voltage pixel data pulse DP of positive polarity, and converts a pixel driving data bit at logical level "0" to a pixel data pulse DP at a low voltage (zero volts). Then, the address driver 55 sequentially applies the pixel data pulses PD to the column electrodes $D_1$–$D_m$, one display line by one display line, in synchronism with the timing at which the scanning pulse SP is applied. Specifically, the address driver 55 converts pixel driving data bits $DB_{2,1}$–$DB_{2,m}$, $DB_{4,1}$–$DB_{4,m}, \ldots, DB_{n,1}$–$DB_{n,m}$ corresponding to the even-numbered display lines to pixel data pulses $DP_{2,1}$–$DP_{2,m}$, $DP_{4,1}$–$DP_{4,m}, \ldots, DP_{n,1}$–$DP_{n,m}$, and applies the pixel data pulses to the column electrodes $D_1$–$D_m$ one display line by one display line. In this event, an address discharge (selective write discharge) is produced between the column electrode D and bus electrode Yb, and between the bus electrodes Ya and Yb in the control discharge cell C2 of a pixel cell PC which is applied with the scanning pulse SP and also with the high voltage pixel data pulse DP. In this event, the wall charge formed on the surface of the eminent dielectric layer 12 is extinguished in the control discharge cell C2 in which the address discharge is produced. On the other hand, the address discharge as described above is not produced in the control discharge cell C2 of a pixel cell PC which is applied with the scanning pulse SP but with the negative pixel data pulse DP. Therefore, the control discharge cell C2 maintains its previous state (with the wall discharge or without the wall discharge).

In this manner, in the even-numbered row address stage $W_{EVE}'$, the wall charges formed in the control discharge cells C2 of the pixel cells PC which belong to the even-numbered display lines of the PDP 50 are selectively extinguished in accordance with pixel data (input video signal).

Next, in the priming stage P of each subfield, the odd-numbered Y electrode driver 53 intermittently repeats a positive priming pulse $PP_{YO}$ as shown in FIG. 24 which is applied to the respective odd-numbered row electrodes $Y_1, Y_3, Y_5, \ldots, Y_{(n-1)}$. Also, in the priming stage P, the odd-numbered X electrode driver 51 intermittently applies a positive priming pulse $PP_{XO}$, as shown in FIG. 24, repeatedly to the respective odd-numbered row electrodes $X_1, X_3, X_5, \ldots, X_{(n-1)}$. Further, in the priming stage P, the even-numbered X electrode driver 52 intermittently applies a positive priming pulse $PP_{XE}$, as shown in FIG. 24, repeatedly to the respective even-numbered row electrodes $X_0, X_2, X_4, \ldots, X_{n-2}, X_n$. Further, in the priming stage P, the even-numbered Y electrode driver 54 intermittently applies a positive priming pulse $PP_{YE}$ repeatedly to the even-numbered row electrodes $Y_2, Y_4, Y_6, \ldots, Y_{n-2}, Y_n$. The priming pulses $PP_{XE}$, $PP_{YE}$ applied to the even-numbered row electrodes X, Y, and the priming pulses $PP_{XO}$, $PP_{YO}$ applied to the odd-numbered row electrodes X, Y are applied at timings offset from each other, as shown in FIG. 24. Each time the priming pulse PP is applied, a priming discharge is produced only in the control discharge cells C2 in which the wall charges are formed. Specifically, the priming discharge is produced between the bus electrodes Xb and Yb only in the control discharge cells C2 in which the wall charges remain at the end of the even-numbered row address stage $W_{EVE}'$. In this event, charged particles generated by the priming discharge flow into the display discharge cell C1 through the gap r shown in FIG. 7 to extend the discharge toward the display discharge cell C1. Therefore, each time the priming discharge is produced in the control discharge cell C2, the discharge is extended more toward the display discharge cell C1, so that the wall charges are gradually accumulated on the surface of the dielectric layer 11 in the display discharge cell C1. As shown in FIG. 24, the priming pulse PP first applied in the priming stage P is given a wider pulse width than the priming pulse PP applied subsequently for preventing an erroneous discharge due to a delayed discharge. Also, at the same timing as the last priming pulse $PP_{XE}$ (or $PP_{YE}$) in the priming stage P, the odd-numbered Y electrode driver 53 applies a negative extension assisting pulse KP as shown in FIG. 24 to the respective odd-numbered row electrodes $Y_1, Y_3, Y_5, \ldots, Y_{(n-1)}$. Further, at the same timing as the last priming pulse $PP_{XO}$ in the priming stage P, the even-numbered Y electrode driver 54 applies the negative extension assisting pulse KP as shown in FIG. 24 to the respective even-numbered row electrodes $Y_2, Y_4, Y_6, \ldots, Y_{n-2}, Y_n$. In response to the simultaneous application of the negative extension assisting pulse KP and positive priming pulse PP, the priming discharge is produced between the bus electrodes Xb and Yb of the control discharge cell C2, and a weak discharge is produced between the transparent electrodes Xa and Ya in the display discharge cell C1. This discharge permits a requisite amount of wall charge for producing a sustain discharge, later described, to be formed on the surface of the dielectric layer 11 of the display discharge cell C1, so that the pixel cell PC including this display discharge cell C1 is set to a lit cell state. On the other hand, no wall charge is formed in the display discharge cell C1 in which no wall charge has been formed in the odd-numbered row address stage $W_{ODD}'$ or even-numbered row address stage $W_{EVE}'$, and therefore the priming discharge is not produced, so that the pixel cell PC including this display discharge cell C1 is set to an unlit cell state. For preventing an erroneous discharge between the transparent electrodes Xa and Ya in the display discharge cell C1, the odd-numbered Y electrode driver 53 applies a positive erroneous discharge preventing pulse VP as shown in FIG. 24 to the respective odd-numbered row electrodes $Y_1, Y_3, Y_5, \ldots, Y_{n-1}$ immediately after the application of the extension assisting pulse KP.

In this manner, in the priming stage P, only those pixel cells PC having the control discharge cells C2 which have been formed with the wall charges in the odd-numbered row address stage $W_{ODD}'$ or even-numbered row address stage $W_{EVE}'$ are set to the lit cell state, while those pixel cells PC having the control discharge cells C2 which have not been formed with the wall charges are set to the unlit cell state.

Next, in the sustain stage I of each subfield, the odd-numbered Y electrode driver 53 repeats a positive sustain pulse $IP_{YO}$ as shown in FIG. 24 a number of times assigned to a subfield to which this sustain stage I belongs, and applies the positive sustain pulse $IP_{YO}$ to the respective odd-numbered row electrodes $Y_1, Y_3, Y_5, \ldots, Y_{(n-1)}$. At the same timing as the sustain pulse $IP_{YO}$, the even-numbered X electrode driver 52 repeats a positive sustain pulse $IP_{XE}$ a number of times assigned to the subfield to which the sustain stage I belongs, and applies the sustain pulse $IP_{XE}$ to the respective even-numbered row electrodes $X_0, X_2, X_4, \ldots, X_{n-2}, X_n$. The odd-numbered X electrode driver 51 repeats a positive sustain pulse $IP_{XO}$ as shown in FIG. 24 a number of times assigned to the subfield to which the sustain stage I belongs, and applies the sustain pulse $IP_{XO}$ to the respective odd-numbered row electrodes $X_1, X_3, X_5, \ldots, X_{(n-1)}$. Further in the sustain stage I, the even-numbered Y electrode driver 54 repeats a positive sustain pulse $IP_{YE}$ a number of times assigned to the subfield to which the sustain stage I belongs, and applies the sustain pulse $IP_{YE}$ to the respective even-numbered row electrodes $Y_2, Y_4, \ldots, Y_{n-2}, Y_n$. As shown in FIG. 24, the sustain pulses $IP_{XE}$, $IP_{YO}$ and the sustain pulses $IP_{XO}$, $IP_{YE}$ are applied at timings offset from each other. Each time the sustain pulse $IP_{XO}$, $IP_{XE}$, $IP_{YO}$ or $IP_{YE}$ is applied, a sustain discharge is produced between the transparent electrodes Xa and Ya in the display discharge cell C1 of a pixel cell PC which is set in the lit cell state. In this event, ultraviolet rays generated in the sustain discharge excite the fluorescent layer 16 (red fluorescent layer, green fluorescent layer, blue fluorescent layer) formed in the display discharge cell C1 to radiate a color corresponding to the fluorescent light color through the front glass substrate 10. In other words, light emission associated with the sustain discharge is repeatedly produced a number of times assigned to the subfield to which the sustain stage I belongs. For preventing an erroneous discharge between the bus electrodes Xb and Yb in the control discharge cell C2, the odd-numbered Y electrode driver 53 applies the positive erroneous discharge preventing pulse VP to the respective odd-numbered row electrodes $Y_1, Y_3, Y_5, \ldots, Y_{(n-1)}$ at the end of the sustain stage I.

In this manner, in the sustain stage I, only pixel cells PC set in the lit cell state are driven to repeatedly emit light the number of times assigned to the subfield to which the sustain stage I belongs.

Next, in the wall charge moving stage T of each subfield, the even-numbered X electrode driver 52 simultaneously applies a negative wall charge moving pulse $MP_{XE1}$ as shown in FIG. 24 to the respective even-numbered row electrodes $X_0, X_2, X_4, \ldots, X_{n-2}, X_n$. Also, simultaneously with the wall charge moving pulse $MP_{XE1}$, the odd-numbered Y electrode driver 53 simultaneously applies a positive wall charge moving pulse $MP_{YO}$ to the respective odd-numbered row electrodes $Y_1, Y, Y_5, \ldots, Y_{n-3}, Y_{n-1}$. In response to the application of these wall charge moving pulse $MP_{XE1}$ and wall charge moving pulse $MP_{YO}$, a moving discharge is produced between the bus electrodes Xb and Yb of the control discharge cell C2 of each of the pixel cells PC belonging to the odd-numbered display lines. Further, in the meantime, the odd-numbered X electrode driver 51 simultaneously applies a positive wall charge moving pulse $MP_{XO1}$ as shown in FIG. 24 to the respective odd-numbered row electrodes $X_1, X_3, X_5, \ldots, X_{(n-1)}$. Consequently, wall charges formed in the display discharge cells C1 of pixel cells PC set in the lit cell state within the pixel cells PC belonging to the odd-numbered display lines move to the control discharge cells C2 through the gap r as shown in FIG. 16. After the application of the wall charge moving pulse $MP_{XO1}$, the odd-numbered X electrode driver 51 simultaneously applies a negative wall charge moving pulse $MP_{XO2}$ as shown in FIG. 24 to the respective odd-numbered row electrodes $X_1, X_3, X_5, \ldots, X_{(n-1)}$. Also, at the same timing as the wall charge moving pulse $MP_{XO2}$, the even-numbered Y electrode driver 54 simultaneously applies a positive wall charge moving pulse $MP_{YE}$ as shown in FIG. 24 to the respective even-numbered row electrodes $Y_2, Y_4, Y_6, \ldots, Y_{n-2}, Y_n$. In response to the application of these wall charge moving pulses $MP_{XO2}$, $MP_{YE}$, a moving discharge is produced between the bus electrodes Xb and Yb in the control discharge cell C2 of each of the pixel cells PC belonging to the even-numbered display lines. Further, in the meantime, the even-numbered X electrode driver 52 simultaneously applies a positive wall charge moving pulse $MP_{XE2}$ as shown in FIG. 24 to the respective even-numbered electrodes $X_0, X_2, X_4, \ldots, X_{n-2}, X_n$. Consequently, wall charges formed in the display discharge cells C1 of pixel cells PC set in the lit cell state within the pixel cells PC belonging to the odd-numbered display lines move to the control discharge cells C2 through the gap r as shown in FIG. 16.

In this manner, in the wall charge moving stage T, the wall charges formed in the display discharge cells C1 of the pixel cells PC set in the lit cell state are moved to the control discharge cells C2.

Next, in the erasure stage E' of each subfield, the odd-numbered Y electrode driver 53 applies an erasure pulse $EP_Y$ having a waveform as shown in FIG. 24 to the respective odd-numbered row electrodes $Y_1, Y, Y_5, \ldots, Y_{n-3}, Y_{n-1}$. As shown in FIG. 24, a level transition of the erasure pulse $EP_Y$ when it falls is slower than that when it rises. At the same timing as the erasure pulse $EP_Y$, the odd-numbered X electrode driver 51 simultaneously applies an erasure pulse $EP_X$ as shown in FIG. 24 to the odd-numbered row electrodes $X_1, X_3, X_5, \ldots, X_{n-3}$, and $X_{n-1}$. In response to the application of the erasure pulses $EP_Y$, $EP_X$, an erasure discharge is produced between the transparent electrodes Xa and Xb in the display discharge cell C1 of each of the pixel cells PC belonging to the odd-numbered display lines in which the wall charges remain, to erase the wall charges. Meanwhile, the even-numbered Y electrode driver 54 applies a positive erroneous discharge preventing pulse VP as shown in FIG. 24 to the respective even-numbered row electrodes $Y_2, Y_4, \ldots, Y_{n-2}, Y_n$. Immediately after the application of the erroneous discharge preventing pulse VP, the odd-numbered Y electrode driver 54 applies a positive erasure pulse $EP_Y$ having a waveform as shown in FIG. 24 to the respective even-numbered row electrodes $Y_2, Y_4, \ldots, Y_{n-2}, Y_n$. At the same timing as the erasure pulse $EP_Y$, the even-numbered X electrode driver 52 simultaneously applies a positive erasure pulse $EP_X$ as shown in FIG. 24 to the respective even-numbered row electrodes $X_0, X_2, X_4, \ldots, X_{n-2}, X_n$. In response to these erasure pulses $EP_Y$, $EP_X$, an erasure discharge is produced between the transparent electrodes Xa and Xb in the display discharge cell C1 of each of the pixel cells PC belonging to the even-numbered display lines in which the wall charges remain, to erase the wall charges. Meanwhile, the odd-numbered Y electrode driver 53 applies the positive erroneous discharge preventing pulse VP as shown in FIG. 24 to the respective odd-numbered row electrodes $Y_1, Y_3, Y_5, \ldots, Y_{n-3}, Y_{n-1}$ in order to prevent erroneous discharges in the control discharge cells C2.

In this manner, in the erasure stage E', the wall charges remaining in all the display discharge cells C1 of the PDP 50 are erased to transition all the pixel cells PC to the unlit cell state.

The driving as described above permits an intermediate luminance to be viewed corresponding to a total number of light emission performed in each sustain stage I through the subfields SF1–SF(N). In other words, a displayed image corresponding to an input video signal can be produced by discharge light associated with the sustain discharge produced in the sustain stage I in each subfield.

Figure 23:
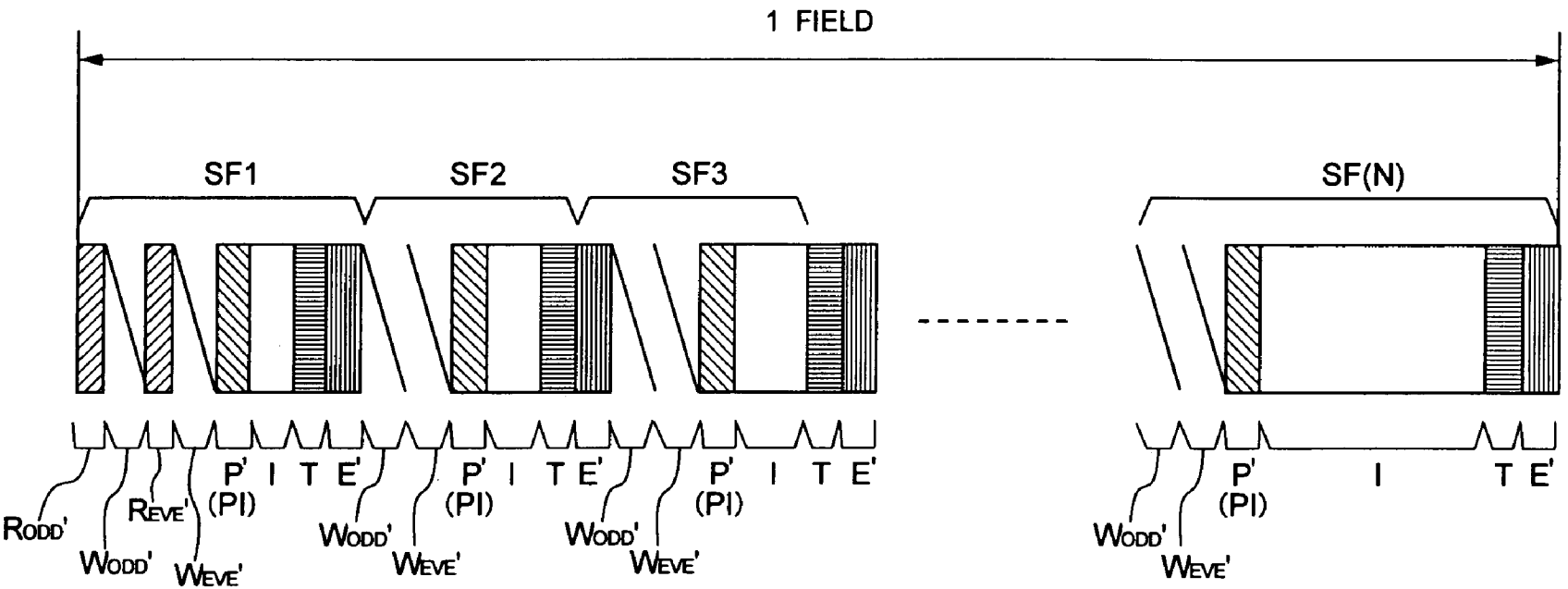
FIG. 23 is a diagram showing an example of a light emission driving sequence when a selective erasure address method is employed to drive the PDP 50.

In this event, in the driving employing the selective erasure address method as shown in FIGS. 23–25, the reset discharge, priming discharge, and address discharge associated with light emission not involved in the displayed image are likewise produced in the control discharge cell C2 which comprises the eminent dielectric layer 12 formed of a light absorbing layer. Therefore, when the selective erasure address method is employed, discharge light associated with the reset discharge, priming discharge, and address discharge is likewise prevented from appearing on the display surface through the front glass substrate 10, so that dark contrast can be increased.

In the driving shown in FIGS. 19 and 20, the first sustain discharge is produced in the sustain stage I after the last priming discharge through the application of the extension assisting pulse KP is terminated in the priming stage P. Alternatively, these discharges can be produced at the same time.

Figure 26:
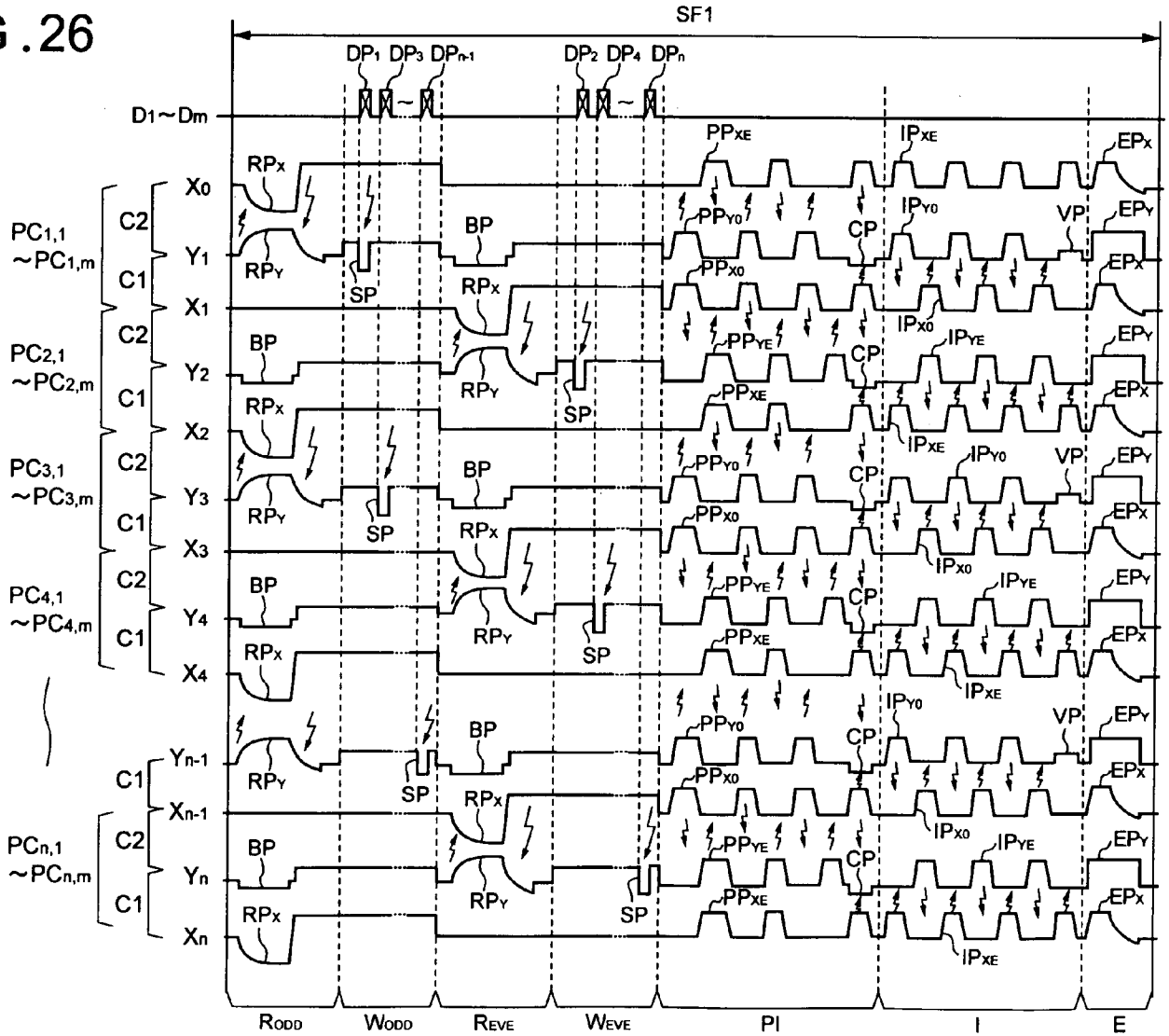
FIG. 26 is a diagram showing another example of a variety of driving pulses applied to the PDP 50 in the first subfield SF1 in accordance with the light emission driving sequence shown in FIG. 18, and timings at which the driving pulses are applied.
Figure 27:
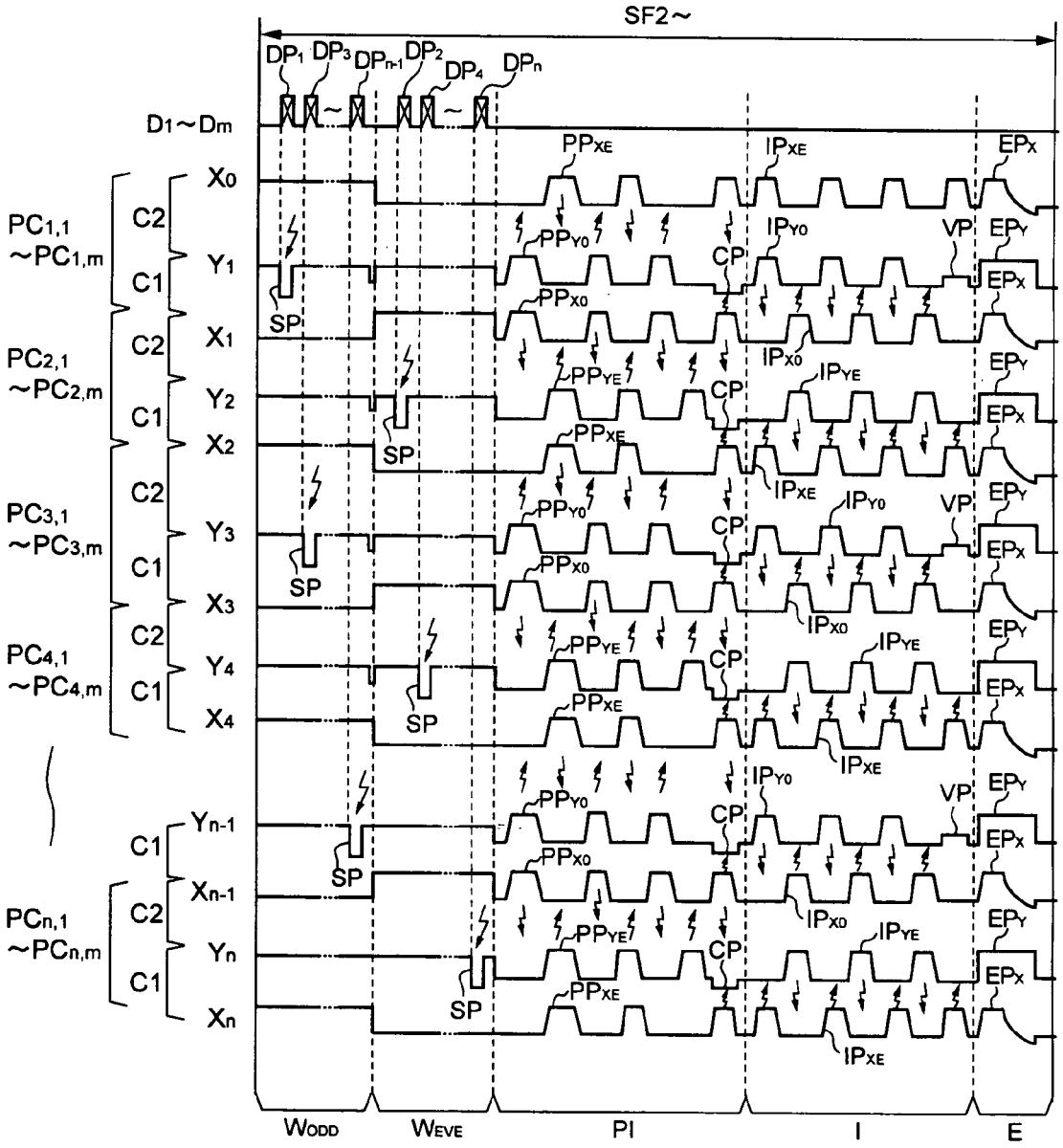
FIG. 27 is a diagram showing another example of a variety of driving pulses applied to the PDP 50 in subfields subsequent to SF2 in accordance with the light emission driving sequence shown in FIG. 18, and timings at which the driving pulses are applied.

FIGS. 26 and 27 show another example of a variety of driving pulses, and timings at which the driving pulses are applied, modified in view of the foregoing aspect.

In FIGS. 26 and 27, the variety of driving pulses applied in the respective stages except for a priming stage P1, and the timing at which the driving pulses are applied are identical to those shown in FIGS. 19 and 20.

In the priming stage P1 shown in FIGS. 26 and 27, the odd-numbered Y electrode driver 53 intermittently and repeatedly applies the positive priming pulse $PP_{YO}$ to the respective odd-numbered row electrodes $Y_1, Y_3, Y_5, \ldots, Y_{(n-1)}$. Also, the odd-numbered X electrode driver 51 intermittently and repeatedly applies a positive priming pulse $PP_{XO}$ to the respective odd-numbered row electrodes $X_1, X_3, X_5, \ldots, X_{(n-1)}$. Further, the even-numbered X electrode driver 52 intermittently and repeatedly applies a positive priming pulse $PP_{XE}$ to the respective even-numbered row electrodes $X_0, X_2, X_4, \ldots, X_{n-2}, X_n$. Further, the even-numbered Y electrode driver 54 intermittently and repeatedly applies a positive priming pulse $PP_{YE}$ to the even-numbered row electrodes $Y_2, Y_4, Y_6, \ldots, Y_{n-2}, Y_n$. The priming pulses $PP_{XE}$, $PP_{YE}$ applied to the even-numbered row electrodes X, Y, and the priming pulses $PP_{XO}$, $PP_{YO}$ applied to the odd-numbered row electrodes X, Y are applied at timings offset from each other.

In the priming stage P1, however, the last priming pulse $PP_{XE}$ is applied at the same timing as the last priming pulse $PP_{XO}$, as shown in FIGS. 26 and 27. Further, in the meantime, the odd-numbered Y electrode driver 53 and even-numbered Y electrode driver 54 simultaneously apply a negative common discharge pulse CP as shown in FIGS. 26 and 27 to all the row electrodes $Y_1$–$Y_n$. With the application of the common discharge pulse CP and last priming pulses $P_{XE}$, $PP_{XO}$, a last priming discharge is produced in the control discharge cell C2 in which a wall charge has been formed, and the first sustain discharge is produced in the display discharge cell C1 in which a wall charge has been formed by the priming discharge. Since the last priming discharge is produced simultaneously with the first sustain discharge, the sustain discharge produced first in the sustain stage I is the second sustain discharge.

Likewise, in the driving which employs the selective erasure address method (FIGS. 23–25), the last priming discharge can be produced simultaneously with the first sustain discharge in each subfield.

Figure 28:
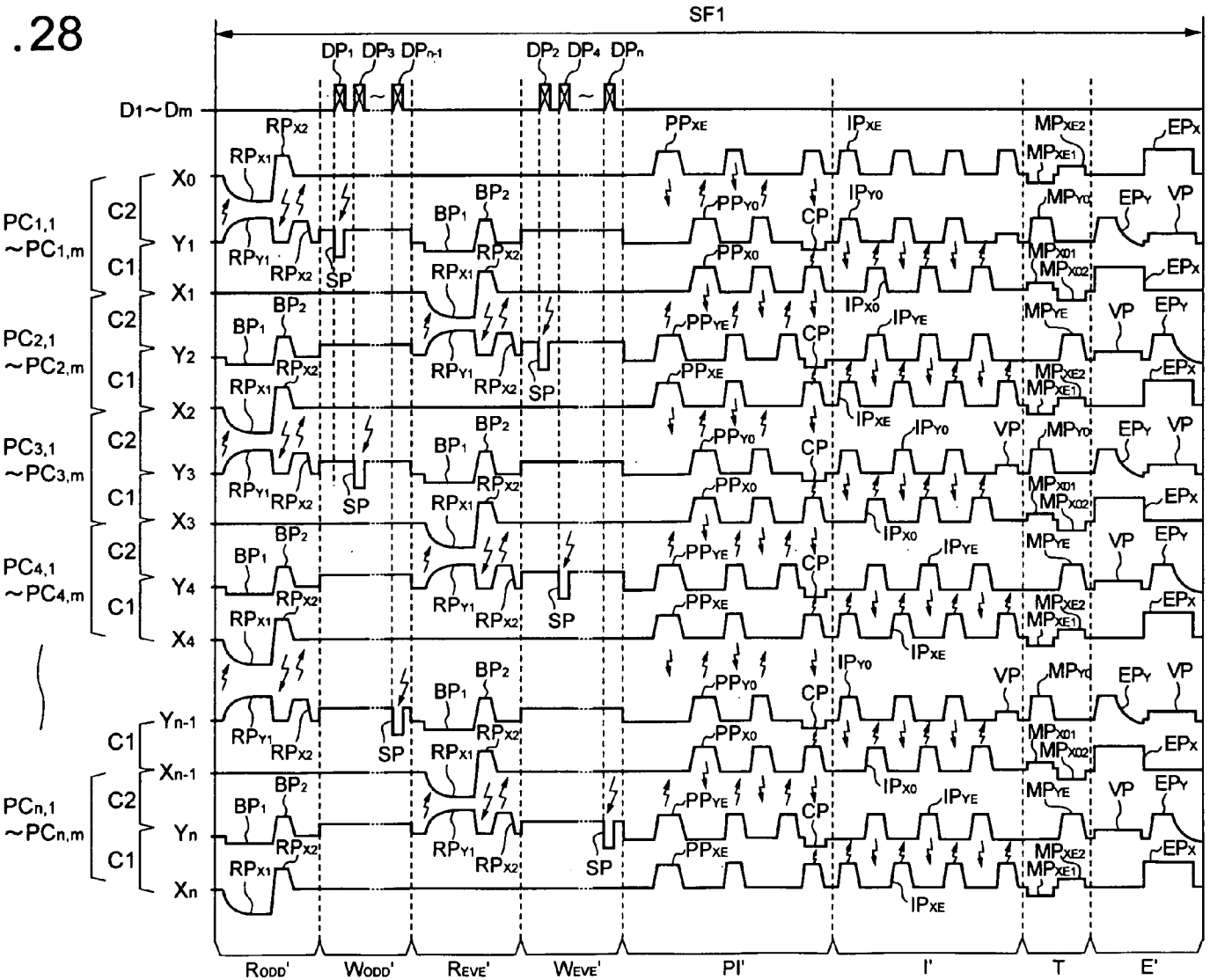
FIG. 28 is a diagram showing another example of a variety of driving pulses applied to the PDP 50 in the first subfield SF1 in accordance with the light emission driving sequence shown in FIG. 23, and timings at which the driving pulses are applied.
Figure 29:
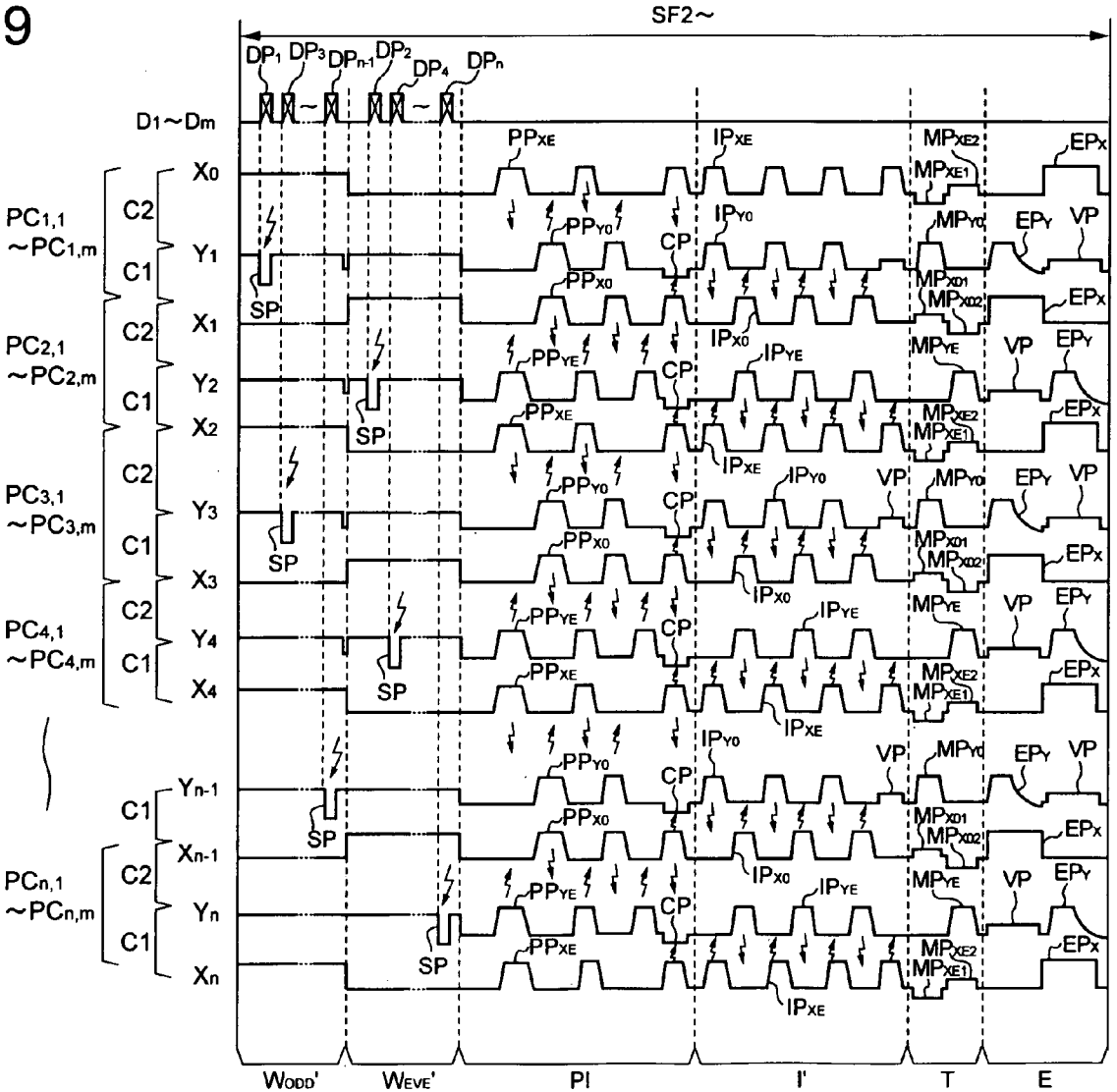
FIG. 29 is a diagram showing another example of a variety of driving pulses applied to the PDP 50 in subfields subsequent to SF2 in accordance with the light emission driving sequence shown in FIG. 23, and timings at which the driving pulses are applied.

FIGS. 28 and 29 are diagrams showing a variety of driving pulses applied to the PDP 50, and timings at which the driving pulses are applied in the driving employing the selective erasure address method, when the last priming discharge is produced simultaneously with the first sustain discharge in each subfield. The driving shown in FIGS. 28 and 29, a variety of driving pulses applied in the respective stages except for the priming stage P1, and the timing at which the driving pulses are applied, are identical to those shown in FIGS. 24 and 25.

In the priming stage P1 shown in FIGS. 28 and 29, the odd-numbered Y electrode driver 53 intermittently and repeatedly applies the positive priming pulse $PP_{YO}$ to the respective odd-numbered row electrodes $Y_1, Y_3, Y_5, \ldots, Y_{(n-1)}$. Also, the odd-numbered X electrode driver 51 intermittently and repeatedly applies a positive priming pulse $PP_{XO}$ to the respective odd-numbered row electrodes $X_1, X_3, X_5, \ldots, X_{(n-1)}$. Further, the even-numbered X electrode driver 52 intermittently and repeatedly applies a positive priming pulse $PP_{XE}$ to the respective even-numbered row electrodes $X_0, X_2, X_4, \ldots, X_{n-2}, X_n$. Further, the even-numbered Y electrode driver 54 intermittently and repeatedly applies a positive priming pulse $PP_{YE}$ to the even-numbered row electrodes $Y_2, Y_4, \ldots, Y_{n-2}, Y_n$. The priming pulses $PP_{XE}$, $PP_{YE}$ applied to the even-numbered row electrodes X, Y, and the priming pulses $PP_{XO}$, $PP_{YO}$ applied to the odd-numbered row electrodes X, Y are applied at timings offset from each other.

In the priming stage P1, however, the last priming pulse $PP_{XE}$ is applied at the same timing as the last priming pulse $PP_{XO}$, as shown in FIGS. 28 and 29. Further, in the meantime, the odd-numbered Y electrode driver 53 and even-numbered Y electrode driver 54 simultaneously apply a negative common discharge pulse CP as shown in FIGS. 28 and 29 to all the row electrodes $Y_1$–$Y_n$. With the application of the common discharge pulse CP and last priming pulses $PP_{XE}$, $PP_{XO}$, a last priming discharge is produced in the control discharge cell C2 in which a wall charge has been formed, and the first sustain discharge is produced in the display discharge cell C1 in which a wall charge has been formed by the priming discharge.

FIG. 30 is a diagram showing driving patterns in one field (frame) when the selective write address method is employed to drive the PDP 50. As shown in FIG. 30, the driving patterns includes (N+1) kinds of driving patterns from a first driving pattern corresponding to the lowest luminance to an (N+1)th driving pattern corresponding to the highest luminance. A double circle shown in FIG. 30 represents that an address discharge (selective write discharge) is produced in the address stage ($W_{ODD}$, $W_{EVE}$) of an associated subfield to drive the pixel cells PC to repeatedly emit light in the sustain stage of the subfield. On the other hand, in a subfield without the double circle, no address discharge (selective write discharge) is produced, so that the pixel cells PC are in the unlit state in the sustain stage of this subfield. Therefore, according to the first driving pattern shown in FIG. 21, for example, since any of the pixel cells PC does not emit light through SF1–SF(N), a black display is represented at the lowest luminance. According to a third driving pattern, in turn, since the pixel cells PC emit light only in the respective sustain stages of SF1 and SF2, an intermediate luminance represented thereby corresponds to the total of the number of light emissions assigned to the sustain stage of SF1 and the number of light emissions assigned to the sustain stage of SF2.

FIG. 31 shows driving patterns in one field (frame) when the selective erasure address method is employed to drive the PDP 50. As shown in FIG. 31, the driving patterns includes (N+1) kinds of driving patterns from a first driving pattern corresponding to the lowest luminance to an (N+1)th driving pattern corresponding to the highest luminance. A black circle shown in FIG. 31 represents that the address discharge (selective erasure discharge) is produced in the address stage ($W_{ODD}$, $W_{EVE}$) of an associated subfield to extinguish wall charges formed in the control discharge cells C2 to set the pixel cells PC in the unlit state. On the other hand, a white circle represents that the pixel cells PC are driven to repeatedly emit light in the sustain stage of this subfield. Therefore, according to a first driving pattern shown in FIG. 30, for example, since any of the pixel cells PC does not emit light through SF1–SF(N), a black display is represented at the lowest luminance. According to a third driving pattern, in turn, since the pixel cells PC emit light only in the respective sustain stages of SF1 and SF2, an intermediate luminance represented thereby corresponds to the total of the number of light emissions assigned to the sustain stage of SF1 and the number of light emissions assigned to the sustain stage of SF2. The driving control circuit 56 selects one from among the (N+1) kinds of driving patterns as shown in FIG. 30 or 31 in accordance with a luminance level indicated by an input video signal for driving the PDP 50. In other words, the driving control circuit 56 generates the pixel driving data bits DB1–DB(N) in accordance with an input video signal to result in the driving state as shown in FIG. 30 or 31, and supplies the pixel driving data bits DB1–DB(N) to the address driver 55. Such driving enables a luminance level indicated by the input video signal to be represented at any of (N+1) intermediate luminance levels.

The foregoing embodiment has been described for the case where the PDP 50 is driven to emit light at (N+1) levels of gradation using (N+1) kinds of driving patterns as shown in FIG. 30 or 31 from $2^N$ different driving patterns represented by N subfields. The present invention however can be applied likewise to the driving of the PDP 50 to emit light at $2^N$ levels of gradation.

Figure 32:
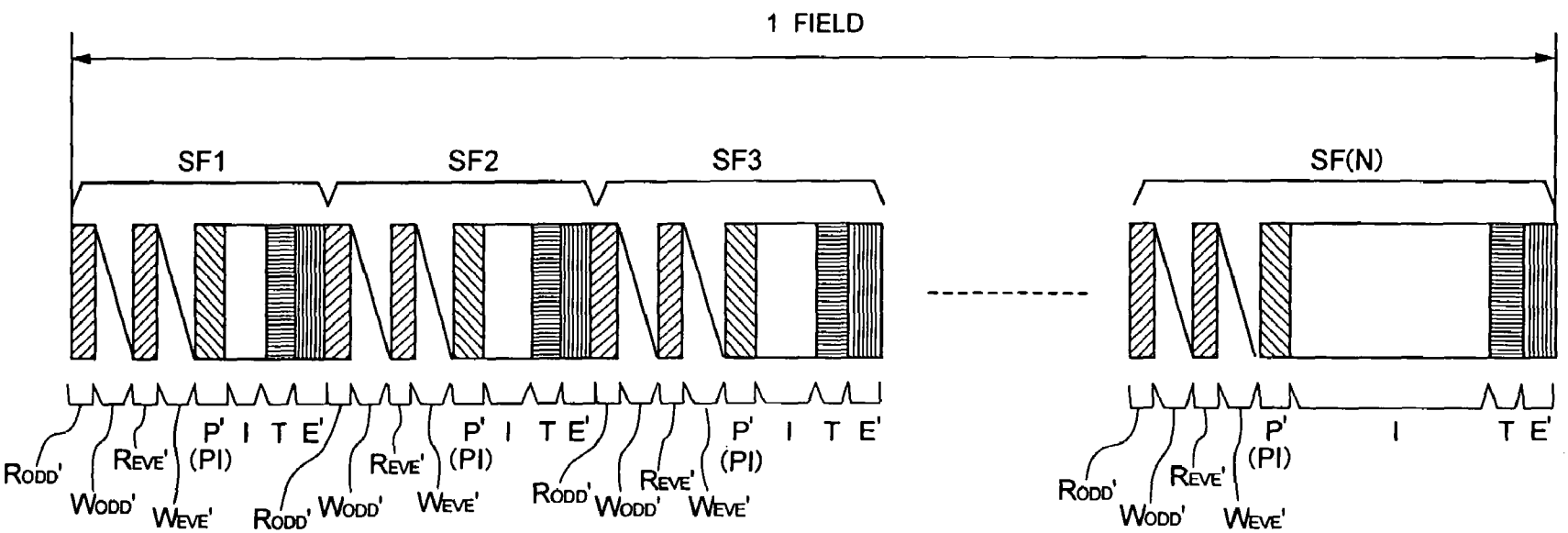
FIG. 32 is a diagram showing an example of a light emission driving sequence which is used when the PDP 50 is driven to provide $2^N$ levels of gradation.

FIG. 32 is a diagram showing a light emission driving sequence when the selective erasure address method is employed to drive the PDP 50 to emit light at $2^N$ levels of gradation.

In the light emission driving sequence shown in FIG. 32, an odd-numbered row reset stage $R_{ODD}'$, an odd-numbered row address stage $W_{ODD}'$, an even-numbered row reset stage $R_{EVE}'$, an even-numbered row address stage $W_{EVE}'$, a priming stage P', a sustain stage I', a wall charge moving stage T, and an erasure stage E' are performed in sequence in each subfield. In each stage, a variety of driving pulses applied to the PDP 50, and timings at which the driving pulses are applied are identical to those shown in FIG. 24. When the selective write address method is employed to drive the PDP 50 to emit light at $2^N$ levels of gradation, an odd-numbered row reset stage $R_{ODD}$ and an even-numbered row reset stage $R_{EVE}$ are performed only in the first subfield SF1.

As described above, in the present invention, the unit light emission region (pixel cell PC) in the display panel is comprised of a first discharge cell (display discharge cell C1) and a second discharge cell (control discharge cell C2) comprising a light absorbing layer. Then, the sustain discharge for emitting light for governing an displayed image is produced in the first discharge cell, while a variety of control discharges causing light emission not associated with the displayed image are produced in the second discharge cell.

Therefore, according to the present invention, since discharge light resulting from control discharges such as the reset discharge and address discharge will never appear on the display surface of the panel, the contrast of the displayed image, particularly dark contrast can be improved when an image corresponding to a generally dark scene is displayed on the PDP 50.

In the following, an embodiment of the present invention will be further described in detail with reference to the drawings.

Figure 33:
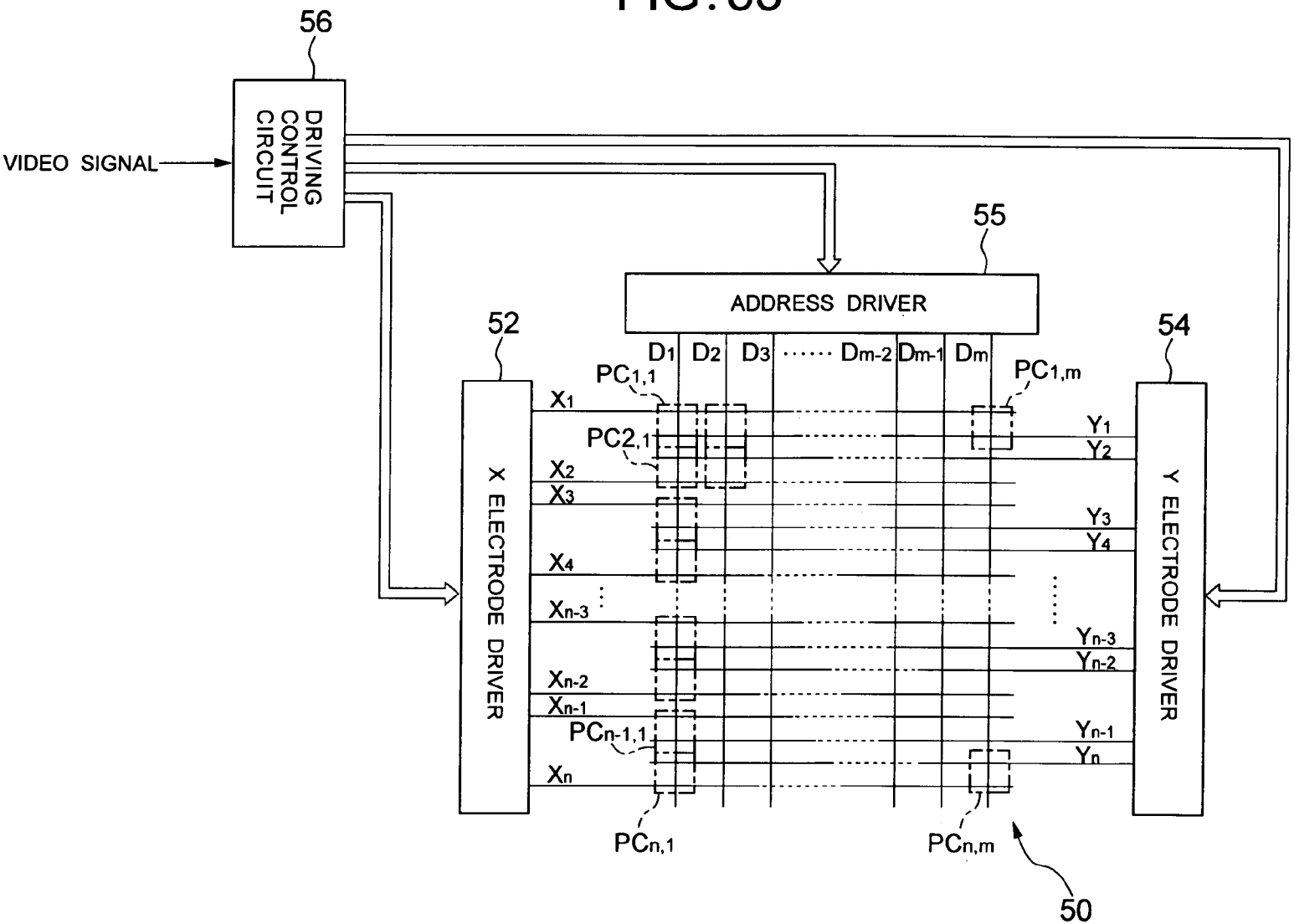
FIG. 33 is a diagram showing another configuration of a plasma display device as a display device according to the present invention.

FIG. 33 is a diagram showing the configuration of a plasma display device as a display device according to the present invention.

As shown in FIG. 33, the plasma display device comprises a PDP 50 as a plasma display panel; an X electrode driver 52; a Y electrode driver 54; an address driver 55; and a driving control circuit 56.

The PDP 50 is formed with a front glass substrate (later described) which serves as an image display surface, and a back glass substrate (later described), in parallel with each other. The front glass substrate is formed with column electrodes $D_1$–$D_m$ extending in the vertical direction on the image display screen, and row electrodes $X_1$–$X_n$ and row electrodes $Y_1$–$Y_n$ extending in the horizontal direction on the image display screen. The row electrodes $X_1$–$X_n$ and row electrodes $Y_1$–$Y_n$ are arranged in the order of $X_1$, $Y_1$, $Y_2$, $X_2$, $X_3$, $Y_3$, $Y_4$, $X_4$, . . . , $X_{n-3}$, $Y_{n-3}$, $Y_{n-2}$, $X_{n-2}$, $X_{-1}$, $Y_{n-1}$, $Y_n$, $X_n$, as shown in FIG. 33. In other words, paris of row electrodes X, Y are arranged alternately on the front glass substrate, and the row electrodes X, Y in each pair are placed in the reverse order to the preceding pair. In this event, the row electrode pair ($X_1$, $Y_1$)—row electrode pair ($X_n$, $Y_n$), pairs of row electrodes, implements a first display line to an n-th display line on the PDP 50. Pixel cells $PC_{1,1}$–$PC_{n,m}$ are formed in matrix as shown in FIG. 33 at intersections of the respective display lines and of the column electrodes $D_1$–$D_m$ as unit light emission regions.

Figure 34:
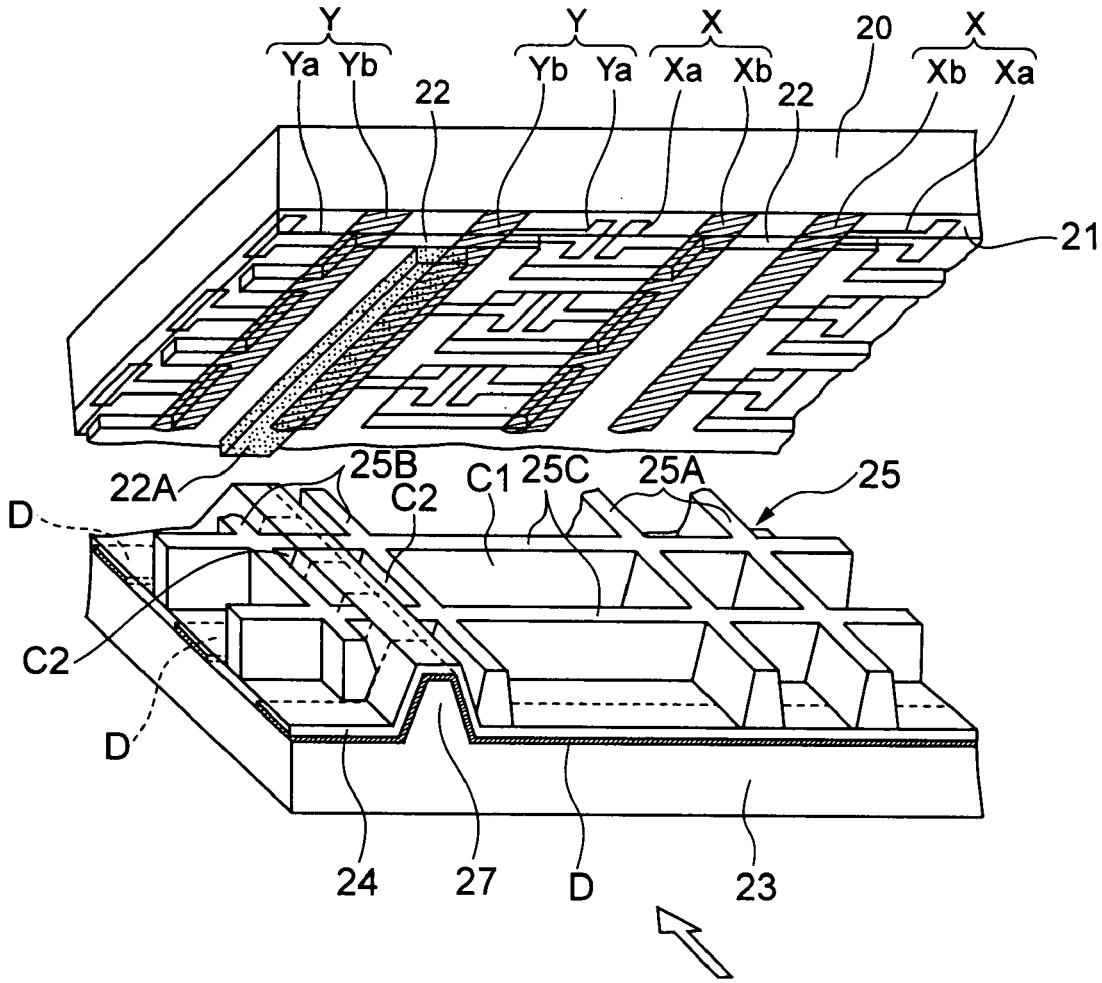
FIG. 34 is a diagram showing the interior of a PDP 50 equipped in the plasma display device shown in FIG. 33 divided into the front glass substrate side and the back glass substrate side.
Figure 35:
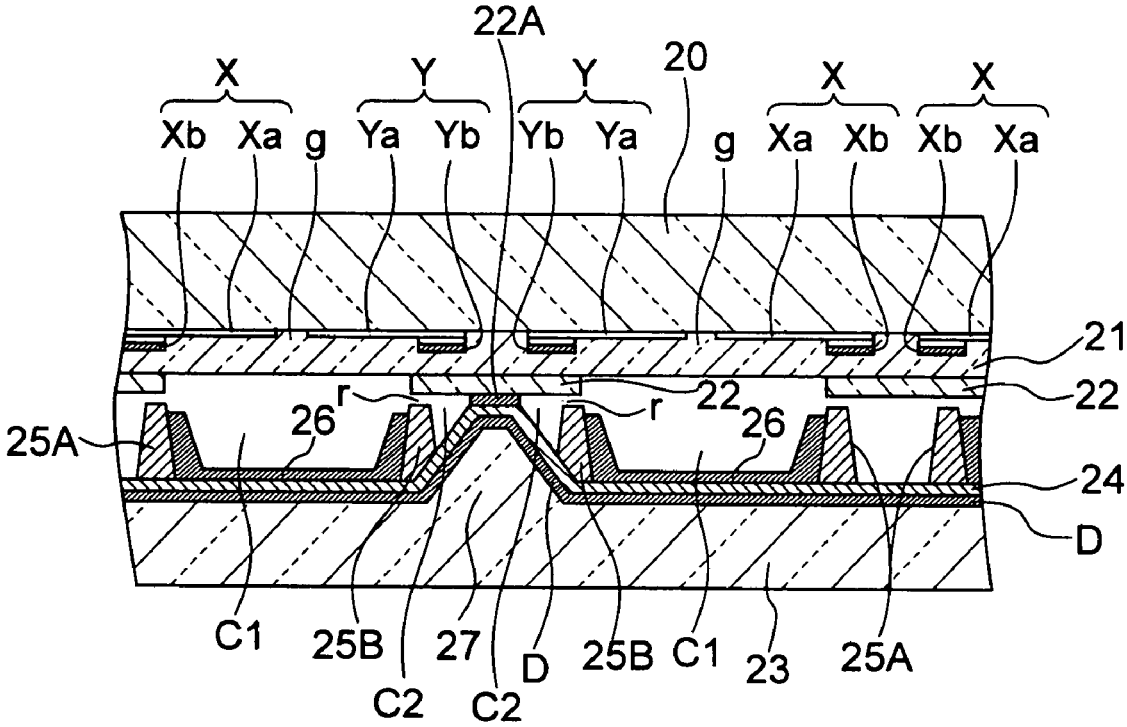
FIG. 35 is a cross-sectional view of the PDP 50 taken in a direction indicated by an arrow in FIG. 34.
Figure 36:
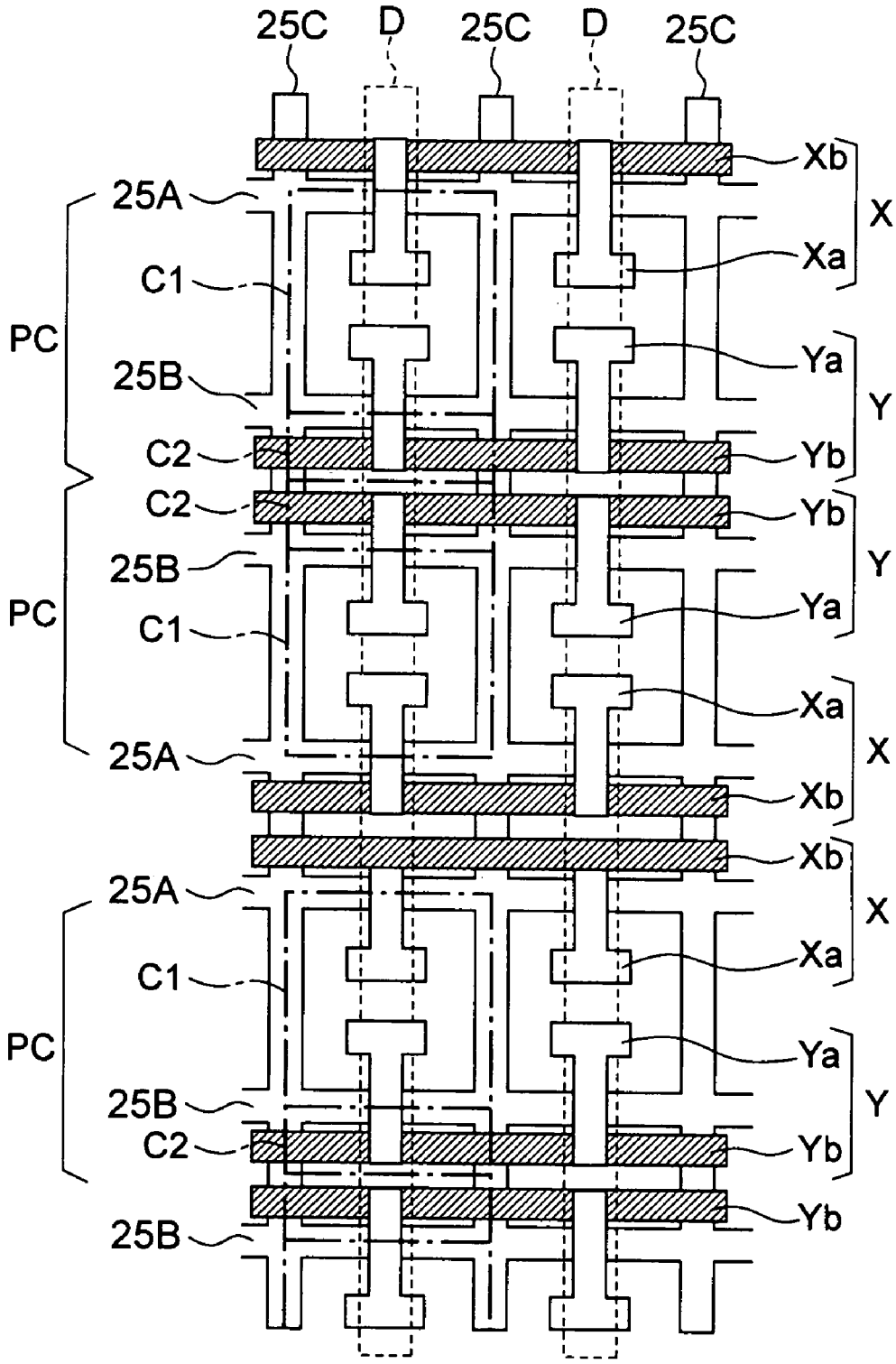
FIG. 36 is a plan view of the PDP 50 seen from the display surface of the PDP 50.

FIGS. 34–36 show a portion of the internal structure extracted from the PDP 50. FIG. 34 is a diagram showing the interior of the PDP 50 divided into the front glass substrate side and back glass substrate side. FIG. 35 is a cross-sectional view showing the PDP 50 seen from a direction indicated by a black arrow in FIG. 34. FIG. 36 is a translucent plan view of the PDP 50 seen from the front glass substrate.

As shown in FIG. 35, the front glass substrate 20 and back glass substrate 23 are formed in parallel with each other. One side of the front glass substrate 20 serves as an image display surface of the PDP, and a plurality of longitudinal row electrode pairs (X, Y) are formed on the other side (hereinafter called the "back side") in parallel in the horizontal direction (left to right in FIG. 5) on the image display surface.

The row electrode X is comprised of a transparent electrode Xa made of a transparent conductive film such as ITO in a T-shape; and a black bus electrode Xb made of a metal film. The bus electrode Xb is a strip-shaped electrode which extends in the horizontal direction on the image display panel. A narrow proximal end of the transparent electrode Xa extends in the vertical direction on the image display screen, and is connected to the bus electrode Xb. The transparent electrode Xa is connected to a position corresponding to each column electrode D on the bus electrode Xb. In other words, the transparent electrode Xa is a protruding electrode which protrudes from the position corresponding to each column electrode D on the strip-shaped bus electrode Xb toward the row electrode Y formed in pair. Similarly, the row electrode Y is comprised of a transparent electrode Ya made of transparent conductive film such as ITO in a T-shape; and a black bus electrode Yb made of a metal film. The bus electrode Yb is a strip-shaped electrode which extends in the horizontal direction on the image display panel. A narrow proximal end of the transparent electrode Ya extends in the vertical direction on the image display screen, and is connected to the bus electrode Yb. The transparent electrode Ya is connected to a position corresponding to each column electrode D on the bus electrode Yb. In other words, the transparent electrode Ya is a protruding electrode which protrudes from the position corresponding to each column electrode D on the strip-shaped bus electrode Yb toward the row electrode X formed in pair. The row electrodes X, Y are arranged in the form of X, Y, Y, X, X, Y, Y, X, . . . in the vertical direction of the image display surface. The respective transparent electrodes Xa, Ya arranged in parallel at equal intervals along the bus electrodes Xb, Yb extend toward the row electrodes with which they are formed in pair. Wider distal ends of the respective transparent electrodes Xa, Ya are arranged opposite to each other through a discharge gap g of a predetermined width.

As shown in FIGS. 34 and 35, the front glass substrate 20 is formed with a dielectric layer 21 on the back side to cover the row electrode pairs (X, Y). Eminent dielectric layers 12 each protruding from the dielectric layer 21 toward the back side of the front glass substrate 20 are formed at positions on the dielectric layer 21 corresponding to the two adjacent bus electrodes Xb, and at positions on the dielectric layer 21 corresponding to the two adjacent bus electrodes Yb. The eminent dielectric layer 22 is formed extending in a direction parallel with the bus electrodes Xb, Yb. The surface of the eminent dielectric layer 22 and the surface of the dielectric layer 21 not formed with the eminent dielectric layer 22 are covered with a protection layer made of MgO (not shown). The eminent dielectric layer 22 formed in a region on the dielectric layer 21 in which the two adjacent bus electrodes Yb are arranged is formed with a black eminent portion 22A made of a light absorbing layer including a black or a dark pigment. Like the eminent dielectric layer 22, the black eminent portion 22A is formed extending in a direction parallel with the bus electrodes Xb, Yb.

On the other hand, the back glass substrate 23 arranged in parallel with the front glass substrate 20 through a discharge space is formed with column electrodes each extending in a direction perpendicular to the bus electrodes Xb, Yb, in parallel with and spaced apart by a predetermined interval with each other. Each of the column electrodes D is formed at a position on the back glass substrate 23 opposing the transparent electrodes Xa, Ya. A white column electrode protection layer (dielectric layer) 24 is further formed on the back glass substrate 23 for covering the column electrodes D. A partition 25 comprised of first horizontal walls 25A, second horizontal walls 25B, and vertical walls 25C is formed on the column electrode protection layer 24.

The first horizontal walls 25A are each formed extending in parallel with the bus electrode Xb at a position opposing each bus electrode Xb on the column electrode protection layer 24. The second horizontal walls 25B are each formed extending in parallel with the bus electrode Yb at a position opposing each bus electrode Yb on the column electrode protection layer 24. The vertical walls 25C are each formed extending in a direction perpendicular to the bus electrode Xb (Yb) at a position between the respective transparent electrodes Xa, Ya arranged at equal intervals along the bus electrodes Xb, Yb. Since the second horizontal walls 25B are not in contact with the protection layer which covers the eminent dielectric layer 22, a gap r is formed between both, as shown in FIG. 35.

A protruding rib 27, which protrudes toward the front glass substrate 20 and extends along a pair of adjacent bus electrodes Yb, is formed at a position on the back glass substrate 23 opposing between the two bus electrodes Yb. As shown in FIGS. 34 and 35, the protruding rib 27 is trapezoidal in cross-section, and raises a portion of the column electrode D existing between two adjacent second horizontal walls 25B, and the column electrode protection layer 24 covering this portion. The peak of the column electrode protection layer 24 raised by the protruding rib 27 is in contact with the black eminent portion 22A. The protruding rib 27 may be formed of the same dielectric material as the column electrode protection layer 24, or may be made by forming ruggedness on the back glass substrate 23 by such a method as sand blast, wet etching, and the like.

A region surrounded by the protruding rib 27, first horizontal wall 25A, and vertical wall 25C formed on the back glass substrate 23 along two adjacent bus electrodes Yb, as indicated by a one-dot-chain line in FIG. 36, serves as a pixel cell PC which carries a pixel. Each pixel cell PC is divided into a display discharge cell C1 and a control discharge cell C2 by the second horizontal wall 25B, as indicated by a broken line in FIG. 36. A discharge gas is filled in a discharge space of each of the display discharge cell C1 and control discharge cell C2, both of which are communicated with each other through the gap r, as shown in FIG. 35.

The display discharge cell C1 includes a column electrode D, and a pair of transparent electrodes Xa, Ya opposing each other. Specifically, the display discharge cell C1 is formed therein with the transparent electrode Xa of the row electrode X and the transparent electrode Ya of the row electrode Y in a row electrode pair (X, Y) corresponding to a display line to which the pixel cell PC belongs, in opposition to each other through the discharge gap g. For example, the transparent electrode Xa of the row electrode $X_2$ and the transparent electrode Ya of the row electrode $Y_2$ are formed in each of the display discharge cells C1 in pixel cells $PC_{2,1}$–$PC_{2,m}$ belonging to a second display line. A fluorescent layer 26 is further formed on the respective side surfaces of the first horizontal wall 25A, vertical wall 25C, and second horizontal wall 25B which face the discharge space of each display discharge cell C1, and on the surface of the column electrode protection layer 24, so as to cover these five surfaces. The fluorescent layer 26 comprises three groups, i.e., a red fluorescent layer for emitting light in red; a green fluorescent layer for emitting light in green; and a blue fluorescent layer for emitting light in blue, and the assignment of color is determined for each pixel cell PC.

The control discharge cell C2, on the other hand, includes the column electrode D, protruding rib 27, bus electrode Yb, eminent dielectric layer 22, and black eminent portion 22A. A side of the protruding rib 27 facing the control discharge cell C2 is inclined, and the column electrode D and bus electrode Yb formed on this inclined surface are positioned opposite to each other in the direction perpendicular to the surface of the back glass substrate 23, as shown in FIG. 35.

As described above, in the PDP 50, the pixel cell PC which carries a pixel is formed in the region surrounded by the protruding rib 27, first horizontal wall 25A, and vertical wall 25C. In this event, each pixel cell PC is comprised of the display discharge cell C1 and control discharge cell C2, with their discharge spaces communicating with each other, and is driven in the following manner through the row electrode $X_1$–$X_n$, row electrode $Y_1$–$Y_n$, and column electrodes $D_1$–$D_n$.

The X electrode driver 52 applies a variety of driving pulses (later described) to the row electrodes $X_1$–$X_n$ of the PDP 50 in response to a timing signal supplied from the driving control circuit 56. The Y electrode driver 54 applies a variety of driving pulses (later described) to the row electrodes $Y_1$–$Y_n$ of the PDP 50 in response to a timing signal supplied from the driving control circuit 56. The address driver 55 applies a variety of driving pulses (later described) to the column electrodes $D_1$–$D_m$ of the PDP 50 in response to a timing signal supplied from the driving control circuit 56.

The driving control circuit 56 controls and drives the PDP 50 based on the so-called subfield (subframe) method which divides each field (frame) in a video signal into N subfields SF1–SF(N) for driving. The driving control circuit 56 first converts an input video signal to pixel data representative of a luminance level for each pixel. Next, the driving control circuit 56 converts the pixel data to a group of pixel driving data bits DB1–DB(N) for specifying whether or not light is emitted in each of the subfields SF1–SF(N), and supplies the address driver 55 with the pixel driving data bits DB1–DB(N).

Figure 37:
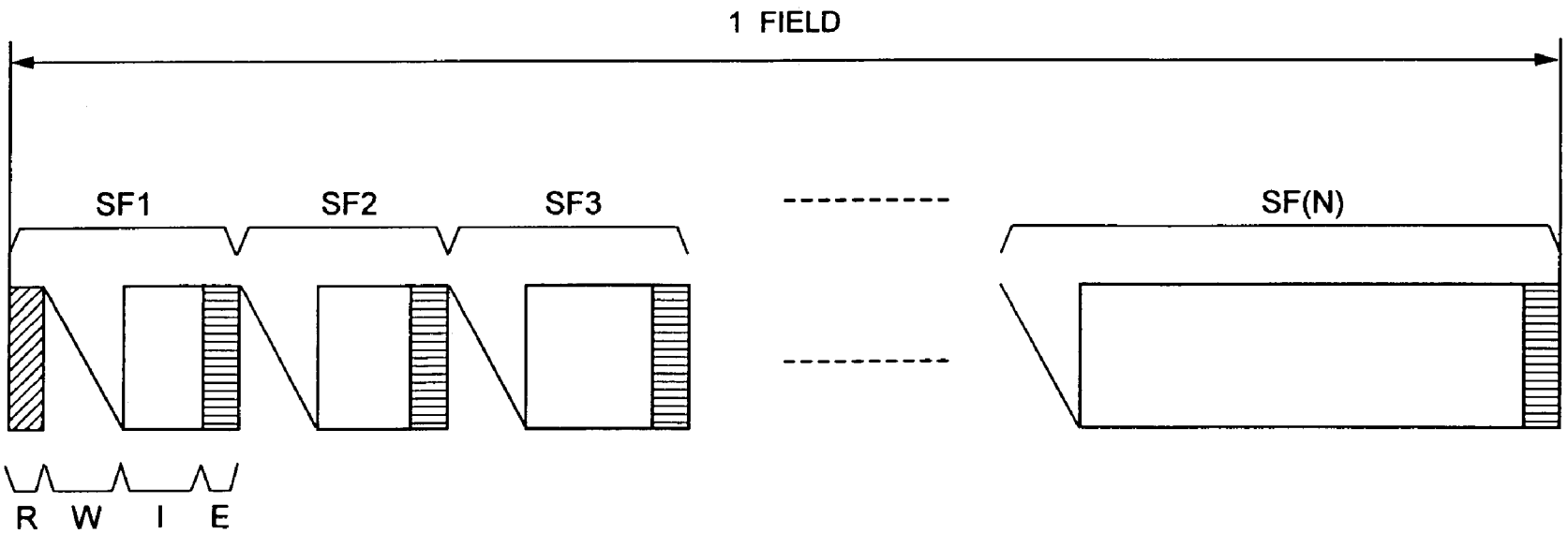
FIG. 37 is a diagram showing an example of a light emission driving sequence when the selective write address method is employed to drive the PDP 50.

The driving control circuit 56 further generates a variety of timing signals for controlling and driving the PDP 50 in accordance with a light emission driving sequence as shown in FIG. 37, and supplies the timing signals to the X electrode driver 52 and Y electrode driver 54.

In the light emission driving sequence shown in FIG. 37, an address stage W, a sustain stage I, and an erasure stage E are sequentially performed in each of subfields SF1–SF(N). In addition, a reset stage R is performed prior to the address stage W only in the first subfield SF1.

Figure 38:
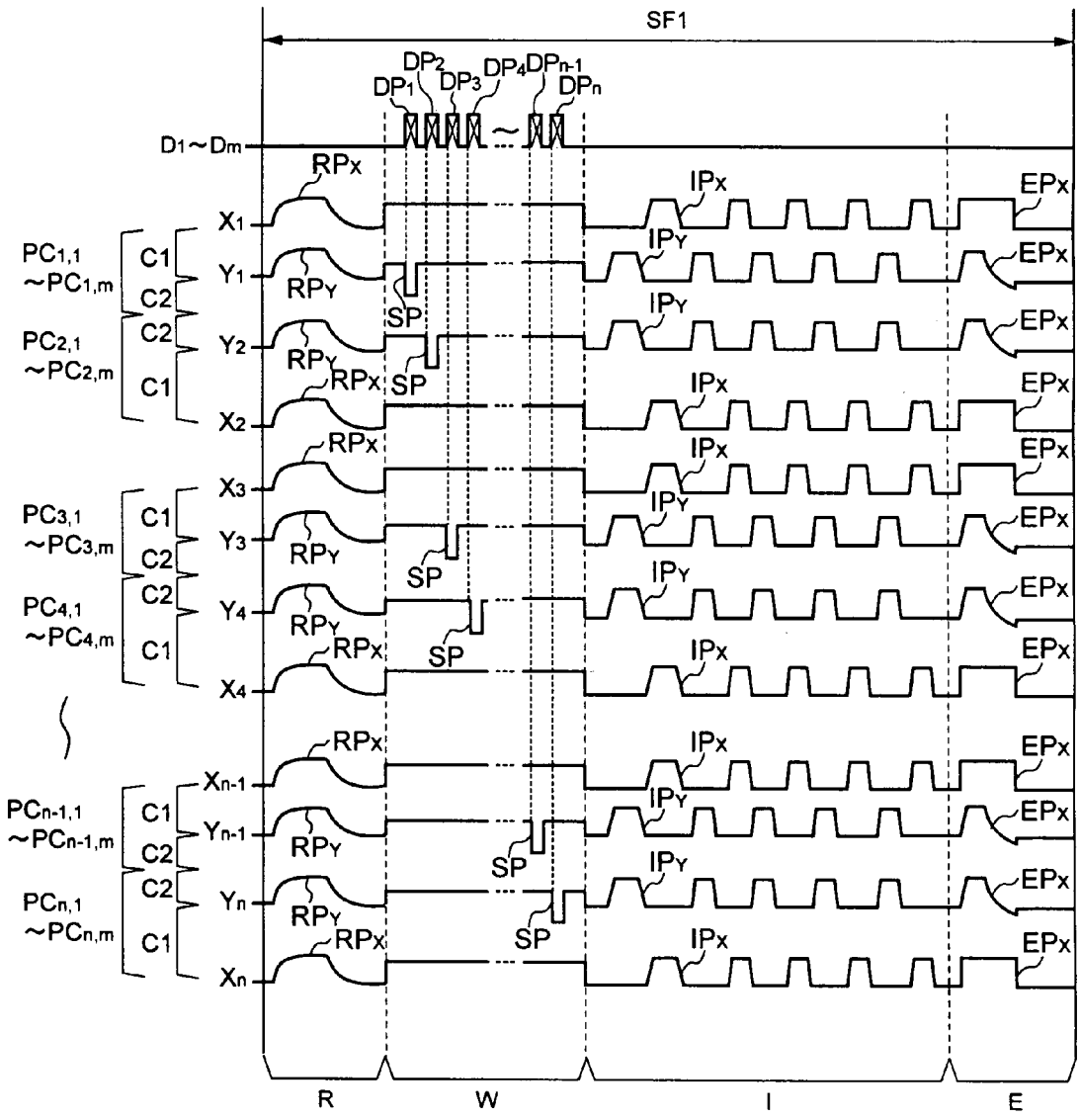
FIG. 38 is a diagram showing a variety of driving pulses applied to the PDP 50 in the first subfield SF1 in accordance with the light emission driving sequence shown in FIG. 37, and timings at which the driving pulses are applied.
Figure 39:
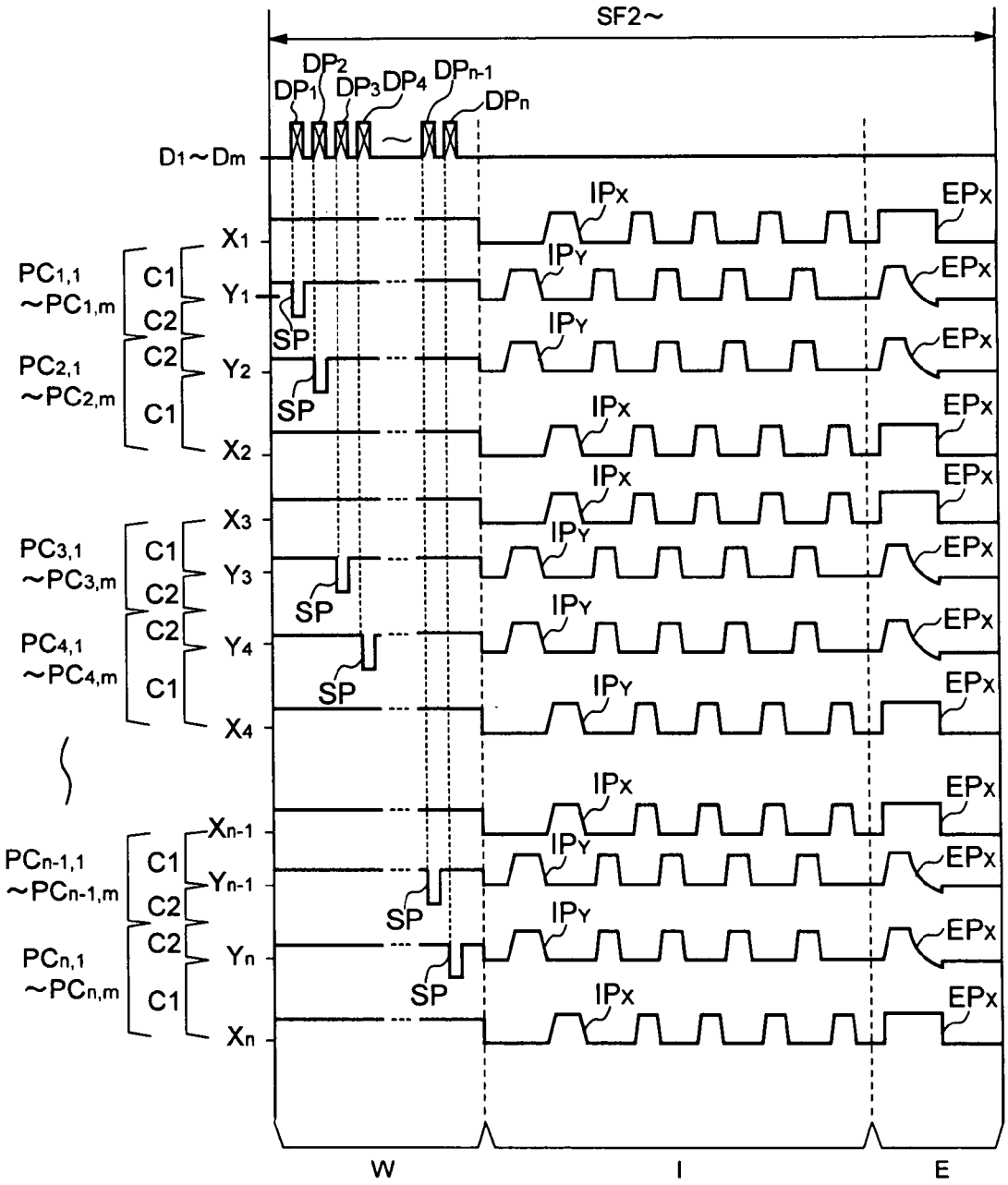
FIG. 39 is a diagram showing a variety of driving pulses applied to the PDP 50 in subfields subsequent to SF2 in accordance with the light emission driving sequence shown in FIG. 37, and timings at which the driving pulses are applied.

FIG. 38 is a diagram showing a variety of driving pulses applied to the PDP 50 by each of the X electrode driver 52, Y electrode driver 54, and address driver 55 in the first subfield SF1, and timings at which the respective driving pulses are applied. FIG. 39 in turn shows a diagram showing a variety of driving pulses applied to the PDP 50 by each of the X electrode driver 52, Y electrode driver 54, and address driver 55 in each of the subfields SF2–SF(N), and timings at which the respective driving pulses are applied.

First, in the reset stage R of the subfield SF1, the X electrode driver 52 generates a positive reset pulse $RP_X$ having a waveform as shown in FIG. 38, which is simultaneously applied to the respective row electrodes $X_1$–$X_n$. Simultaneously with the application of the reset pulse $RP_X$, the Y electrode driver 54 generates a positive reset pulse $RP_Y$ having a waveform as shown in FIG. 38, which is simultaneously applied to the respective row electrodes $Y_1$–$Y_n$. Level transitions in rising sections and falling sections of the respective reset pulses $RP_X$, $RP_Y$ are slower than level transitions in a rising section and a falling section of a sustain pulse IP, later described. In response to the applications of the reset pulses $RP_X$, $RP_Y$, a reset discharge is produced in all the pixel cells $PC_{1,1}$–$PC_{n,m}$ of the PDP 50. Specifically, the reset discharge is produced between a portion of the column electrode D raised by the protruding rib 27 and the bus electrode Yb in the control discharge cell C2, as shown in FIG. 35. In this event, the first reset discharge is produced at a rising edges of the reset pulses $RP_X$, $RP_Y$, and a wall charge of negative polarity is formed near the bus electrode Yb after the end of the discharge. Subsequently, the second reset discharge is produced at falling edges of the reset pulse $RP_Y$, $RP_X$, to extinguish the wall charge formed in the control discharge cell C2.

In this manner, in the reset stage R, the wall discharges are extinguished from the control discharge cells C2 of all the pixel cells PC belonging to the PDP 50 to initialize all the pixel cells PC to an unlit cell state.

Next, in the address stage W of each subfield, the X electrode driver 52 continuously applies a predetermined constant positive voltage as shown in FIG. 38 or 39 to the respective row electrodes $X_1$–$X_n$. The Y electrode driver 54 alternately generates a negative scanning pulse SP which is sequentially applied to the respective row electrodes $Y_1$,–$Y_n$. Meanwhile, the address driver 55 converts those of the pixel driving data bits DB corresponding to the subfield SF belonging to the address stage W to pixel data pulses DP having pulse voltages in accordance with the logical levels. For example, the address driver 55 converts a pixel driving data bit at logical level "1" to a high voltage pixel data pulse DP of positive polarity, and converts a pixel driving data bit at logical level "0" to a pixel data pulse DP at a low voltage (zero volts). Then, the address driver 55 sequentially applies the pixel data pulses DP to the column electrodes $D_1$–$D_m$, one display line by one display line, in synchronism with the timing at which the scanning pulse SP is applied. In this event, an address discharge (selective write discharge) is produced between the column electrode D and bus electrode Yb in the control discharge cell C2 of a pixel cell PC which is applied with the scanning pulse SP and also with the high voltage pixel data pulse DP. Meanwhile, the row electrodes X are applied with the same polarity as the high voltage pixel data pulse DP, i.e. , the positive voltage, so that the address discharge produced in the control discharge cell C2 extends into the display discharge cell C1 through the gap r shown in FIG. 35. In this manner, a discharge is produced between the transparent electrodes Xa and Yb in the display discharge cell C1, and a wall charge is formed in each of the control discharge cells C2 and display discharge cells C1 after the end of the discharge. On the other hand, the address discharge as described above is not produced in the control discharge cell C2 of a pixel cell PC which is applied with the scanning pulse SP but with the negative pixel data pulse DP. Therefore, no wall charge is formed in the control discharge cell C2 and display discharge cell C1 of the pixel cell PC.

In this manner, in the address stage W, the address discharge is selectively produced in the control discharge cells C2 of the pixel cells PC in accordance with pixel data (input video signal). Then, this address discharge is extended to the display discharge cells C1 to form the wall charges in the display discharge cells C1, thereby setting the pixel cells PC in the lit cell state. On the other hand, the pixel cells PC in which the address discharge is not produced are set in the unlit cell state.

Next, in the sustain stage I of each subfield, the X electrode driver 52 repeats a positive sustain pulse $IP_X$ as shown in FIG. 38 or 39 a number of times assigned to the subfield to which the sustain stage I belongs, and applies the sustain pulse $IP_X$ to the respective row electrodes $X_1$–$X_n$. Further, in the sustain stage I, the Y electrode driver 54 repeats a positive sustain pulse $IP_Y$ a number of times assigned to a subfield to which this sustain stage I belongs, and applies the positive sustain pulse $IP_Y$ to the respective row electrodes $Y_1$–$Y_n$. As shown in FIG. 38 or 39, the sustain pulse $IP_X$ and the sustain pulses $IP_Y$ are applied at timings offset from each other. Each time the sustain pulses $IP_X$, $IP_Y$ are applied, a sustain discharge is produced between the transparent electrodes Xa and Ya in the display discharge cell C1 of a pixel cell PC which is set in the lit cell state. In this event, ultraviolet rays generated in the sustain discharge excite the fluorescent layer 26 (red fluorescent layer, green fluorescent layer, blue fluorescent layer) formed in the display discharge cell C1 to radiate a color corresponding to the fluorescent light color through the front glass substrate 20. In other words, light emission associated with the sustain discharge is repeatedly produced a number of times assigned to the subfield to which the sustain stage I belongs.

In this manner, in the sustain stage I, only pixel cells set in the lit cell state are driven to repeatedly emit light the number of times assigned to the subfield.

Next, in the erasure stage E of each subfield, the Y electrode driver 54 applies the row electrodes $Y_1$–$Y_n$ with a positive erasure pulse $EP_Y$, having a waveform with a slower level transition when it falls, as shown in FIG. 38 or 39. The erasure pulse $EP_Y$ reaches a negative voltage at the end of falling, as shown in FIG. 38 or 39. Further, in the erasure stage E, the X electrode driver 52 applies an erasure pulse $EP_X$ having a waveform as shown in FIG. 38 or 39 to the row electrodes $X_1$–$X_n$ of the PDP 50 simultaneously with the erasure pulse $EP_Y$. Immediately after the application of the erasure pulses $EP_Y$, $EP_X$, an erasure discharge is produced between a portion of the column electrode D and the bus electrode Yb in the control discharge cell C2. Further, at the timing the erasure pulse $EP_Y$ becomes a negative voltage, an erasure discharge is produced between the transparent electrodes Xa and Ya in the display discharge cell C1. The two erasure discharges result in erasure of the wall charge previously formed in each of the display discharge cell C1 and control discharge cell C2. In other words, all the pixel cells PC of the PDP 50 transition to an unlit cell state.

The driving as described above permits an intermediate luminance to be viewed corresponding to a total number of light emission performed in each sustain stage I through the subfields SF1–SF(N). In other words, a displayed image corresponding to an input video signal can be produced by discharge light associated with the sustain discharge produced in the sustain stage I in each subfield.

In this event, in the plasma display device shown in FIG. 33, the sustain discharge involved in the displayed image is produced in the display discharge cell C1 in each pixel cell PC, while the reset discharge and address discharge associated with light emission not involved in the displayed image are produced in the control discharge cell C2. The control discharge cell C2 is provided with the black bus electrode Yb and black eminent portion 22A, as shown in FIG. 35. Therefore, discharge light associated with the reset discharge or address discharge produced in the control discharge cell C2 is blocked by the black bus electrode Yb and black eminent portion 22A, and therefore will never appear on the image display surface through the front glass substrate 20.

Thus, according to the plasma display device shown in FIG. 35, the contrast of the displayed image, particularly, the dark contrast can be improved when an image corresponding to a generally dark scene is displayed.

The embodiment shown FIGS. 37–39 has been described in connection with the selective write address method employed as a pixel data write method for setting each of the pixel cells of the PDP 50 to a wall charge forming state in accordance with pixel data, in which the address discharge is selectively produced in each pixel cell in accordance with pixel data to form a wall charge. However, the present invention can be applied likewise to a plasma display device which employs a so-called selective erasure address method, as the pixel data write method, which involves previously forming wall charges in all the pixel cells, and selectively erasing the wall charges in the pixel cells by address discharges.

Figure 40:
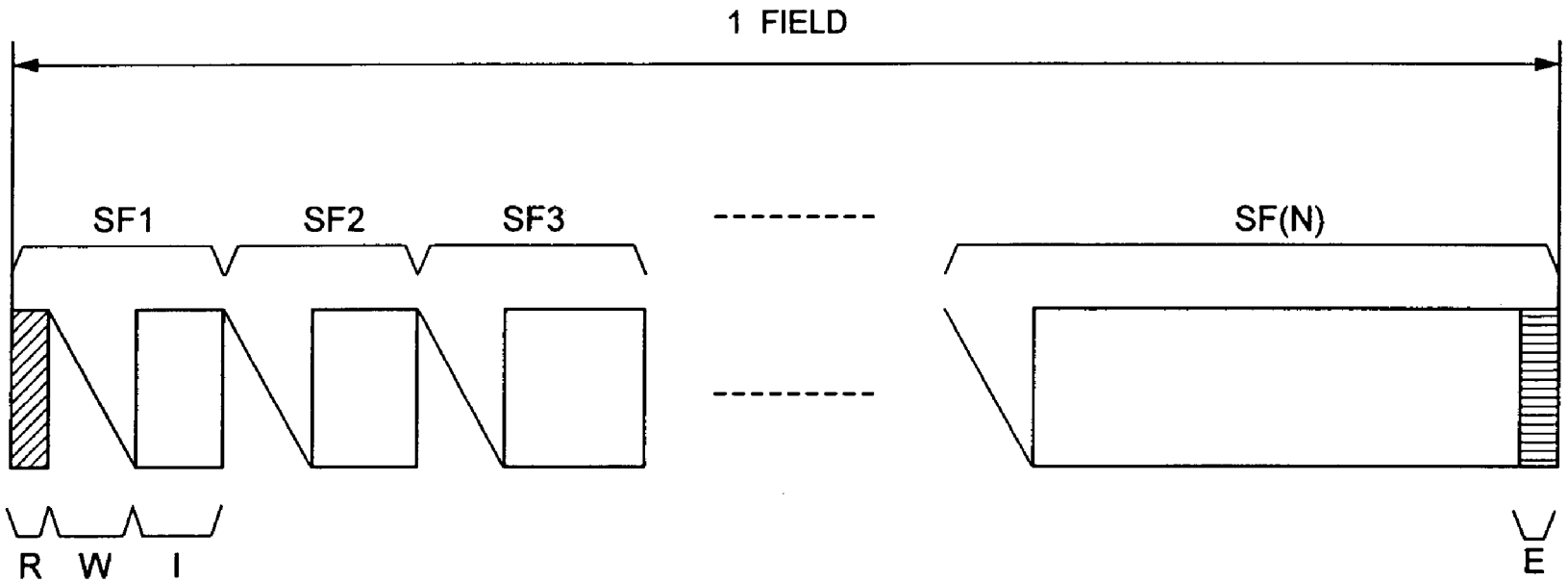
FIG. 40 is a diagram showing a light emission driving sequence when the selective erasure address method is employed to drive the PDP 50.

FIG. 40 is a diagram showing a light emission driving sequence when the selective erasure address method is employed.

In the light emission driving sequence shown in FIG. 40, an address stage W and a sustain stage I are sequentially performed in each of subfields SF1–SF(N). In addition, a reset stage R is performed prior to the address stage W only in the first subfield SF1, and an erasure stage E is performed after the sustain stage I in the last subfield SF(N).

Figure 41:
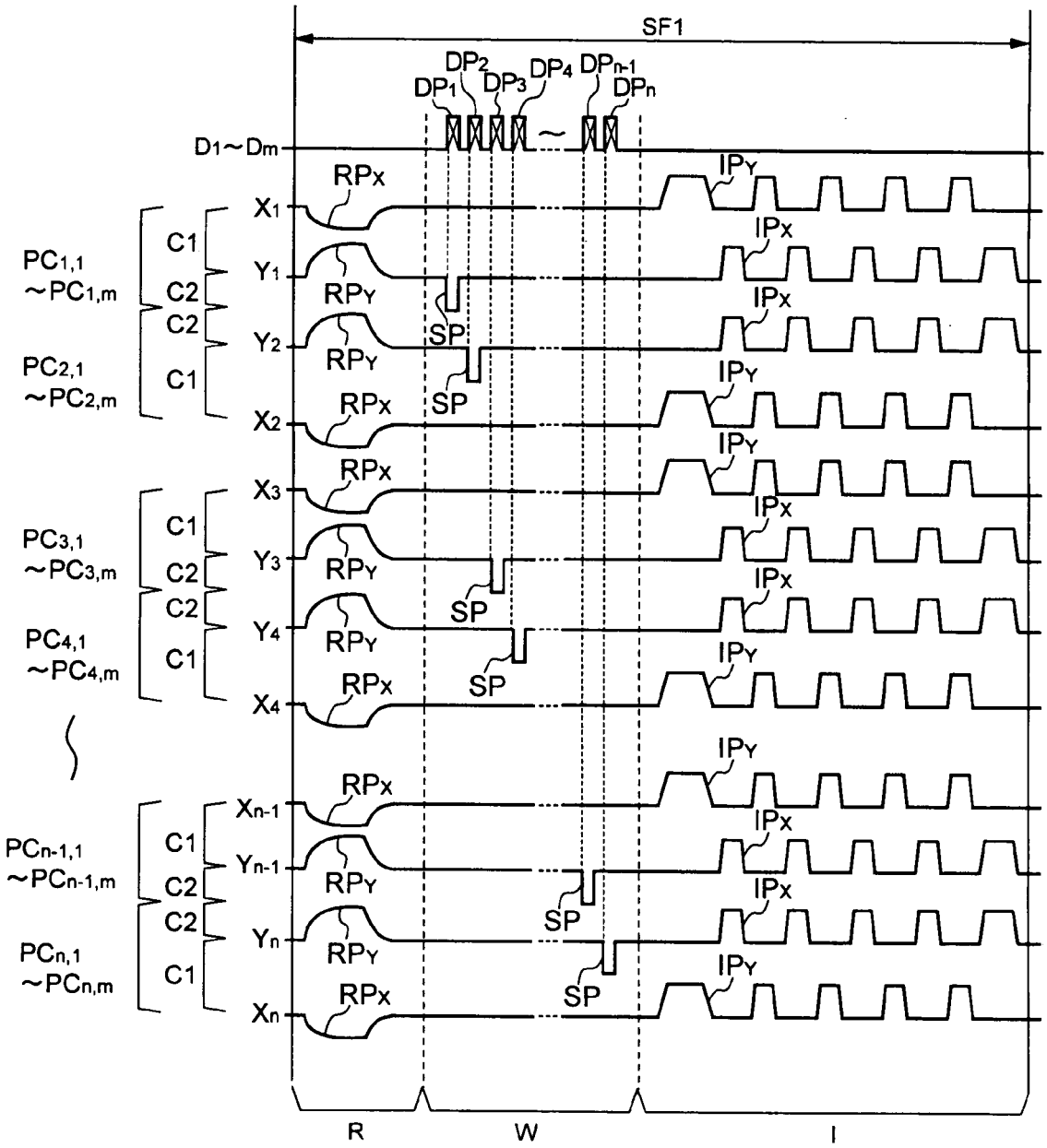
FIG. 41 is a diagram showing a variety of driving pulses applied to the PDP 50 in the first subfield SF1 in accordance with the light emission driving sequence shown in FIG. 40, and timings at which the driving pulses are applied.
Figure 42:
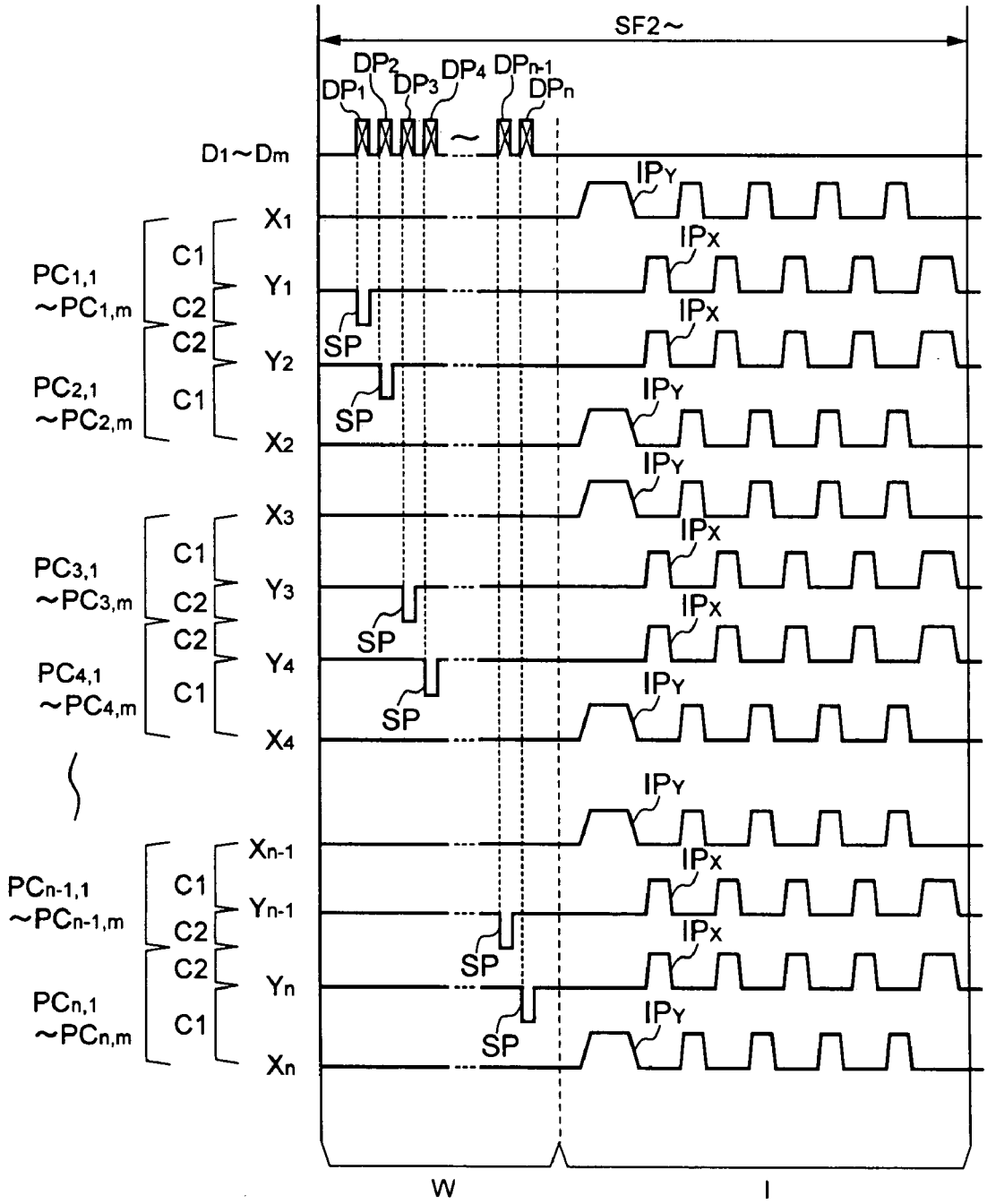
FIG. 42 is a diagram showing a variety of driving pulses applied to the PDP 50 in subfields subsequent to SF2 in accordance with the light emission driving sequence shown in FIG. 40, and timings at which the driving pulses are applied.

FIG. 41 is a diagram showing a variety of driving pulses applied to the PDP 50 in the reset stage R, address stage W, and sustain stage I of the subfield SF1 shown in FIG. 40, and timings at which the respective driving pulses are applied. FIG. 42 in turn shows a diagram showing a variety of driving pulses applied to the PDP 50 in the address stage W and sustain stage I of each of the subfields SF2–SF(N) shown in FIG. 40, and timings at which the respective driving pulses are applied.

In the reset stage R of the subfield SF1, the X electrode driver 52 generates a negative reset pulse $RP_X$ having a waveform as shown in FIG. 41, which is simultaneously applied to the respective row electrodes $X_1$–$X_n$. Simultaneously with the application of the reset pulse $RP_X$, the Y electrode driver 54 generates the positive reset pulse $RP_Y$ having the waveform as shown in FIG. 38, which is simultaneously applied to the respective row electrodes $Y_1$–$Y_n$. Level transitions in rising sections and falling sections of the respective reset pulses $RP_X$, $RP_Y$ are slower than level transitions in a rising section and a falling section of a sustain pulse IP, later described. In response to the applications of the reset pulses $RP_X$, $RP_Y$, a reset discharge is produced between a portion of the column electrode D raised by the protruding rib 27 and the bus electrode Yb in the control discharge cell C2 of each of all the pixel cells $PC_{1,1}$–$PC_{n,m}$ of the PDP 50. Further, with the applications of the reset pulses $RP_X$, $RP_Y$, a weak reset discharge is produced between the transparent electrodes Xa and Ya of each display discharge cell C1. After the end of the reset discharges, wall charges are formed in the display discharge cells C1 and control discharge cells C2.

In this manner, in the reset stage R, the reset discharges are produced in all the pixel cells PC of the PDP 50 to form the wall discharges to initialize all the pixel cells PC to a lit cell state.

Next, in the address stage W of each subfield, the Y electrode driver 54 alternately generates the negative scanning pulse SP which is sequentially applied to the respective row electrodes $Y_1$,–$Y_n$. Meanwhile, the address driver 55 converts those of the pixel driving data bits DB corresponding to the subfield SF belonging to the address stage W to pixel data pulses DP having pulse voltages in accordance with the logical levels. For example, the address driver 55 converts a pixel driving data bit at logical level "1" to a high voltage pixel data pulse DP of positive polarity, and converts a pixel driving data bit at logical level "0" to a pixel data pulse DP at a low voltage (zero volts). Then, the address driver 55 sequentially applies the pixel data pulses PD to the column electrodes $D_1$–$D_m$, one display line by one display line, in synchronism with the timing at which the scanning pulse SP is applied. In this event, an address discharge (selective erasure discharge) is produced between the column electrode D and bus electrode Yb in the control discharge cell C2 of a pixel cell PC which is applied with the scanning pulse SP and also with the high voltage pixel data pulse DP. Then, the address discharge produced in the control discharge cell C2 extends into the display discharge cell C1 through the gap r shown in FIG. 35. In this manner, a discharge is produced between the transparent electrodes Xa and Ya in the display discharge cell C1 to extinguish the wall charge formed in the display discharge cell C1. On the other hand, the address discharge as described above is not produced in the control discharge cell C2 of a pixel cell PC which is applied with the scanning pulse SP but with the negative pixel data pulse DP. Therefore, since no discharge is either produced in the display discharge cell C1 of the pixel cell PC, the wall charge existing in the display discharge cell C1 remains as it is.

In this manner, in the address stage W, the address discharge is selectively produced in the control discharge cells C2 of the pixel cells PC in accordance with pixel data (input video signal). Then, this address discharge is extended to the display discharge cells C1 to extinguish the wall charges existing in the display discharge cells C1, thereby setting the pixel cells PC to the unlit cell state. On the other hand, the pixel cells PC in which the address discharge is not produced are set to the lit cell state.

Next, in the sustain stage I of each subfield, the X electrode driver 52 repeats a positive sustain pulse $IP_X$ as shown in FIG. 41 or 42 a number of times assigned to the subfield to which the sustain stage I belongs, and applies the sustain pulse $IP_X$ to the respective row electrodes $X_1$–$X_n$. Further, in the sustain stage I, the Y electrode driver 54 repeats a positive sustain pulse $IP_Y$ a number of times assigned to a subfield to which this sustain stage I belongs, and applies the positive sustain pulse $IP_Y$ to the respective row electrodes $Y_1$–$Y_n$. As shown in FIG. 41 or 42, the sustain pulse $IP_X$ and the sustain pulses $IP_Y$ are applied at timings offset from each other. Each time the sustain pulses $IP_X$, $IP_Y$ are applied, a sustain discharge is produced between the transparent electrodes Xa and Ya in the display discharge cell C1 of a pixel cell PC which is set in the lit cell state. In this event, ultraviolet rays generated in the sustain discharge excite the fluorescent layer 26 (red fluorescent layer, green fluorescent layer, blue fluorescent layer) formed in the display discharge cell C1 to radiate a color corresponding to the fluorescent light color through the front glass substrate 20. In other words, light emission associated with the sustain discharge is repeatedly produced a number of times assigned to the subfield to which the sustain stage I belongs.

In this manner, in the sustain stage I, only pixel cells set in the lit cell state are driven to repeatedly emit light the number of times assigned to the subfield.

The driving as described above permits an intermediate luminance to be viewed corresponding to a total number of light emission performed in each sustain stage I through the subfields SF1–SF(N). In other words, a displayed image corresponding to an input video signal can be produced by discharge light associated with the sustain discharge produced in the sustain stage I in each subfield.

In this event, in the driving employing the selective erasure address method as shown in FIGS. 40–42, the reset discharge which causes light to emit at a relatively high luminance is likewise produced in the control discharge cell C2 which comprises a light shielding member (the black bus electrode Yb and black eminent portion 22A). Therefore, in the driving employing the selective erasure address method, the contrast of the displayed image, particularly, the dark contrast can be improved when an image corresponding to a generally dark scene is displayed, in a manner similar to the driving employing the selective write address method.

Figure 43:
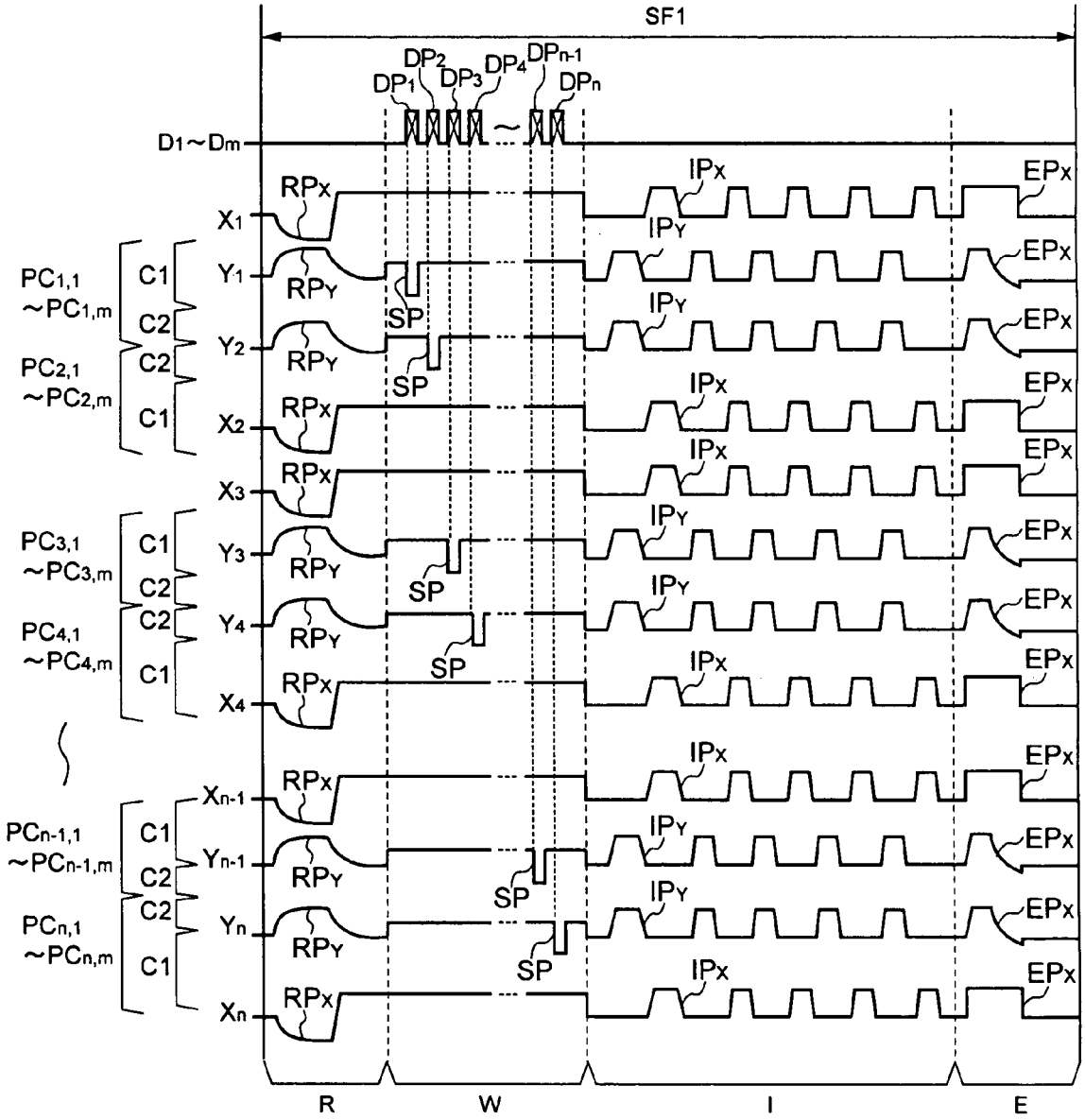
FIG. 43 is a diagram showing a variety of driving pulses applied to the PDP 50 in the first subfield SF1 in accordance with the light emission driving sequence shown in FIG. 37, and timings at which the driving pulses are applied.
Figure 44:
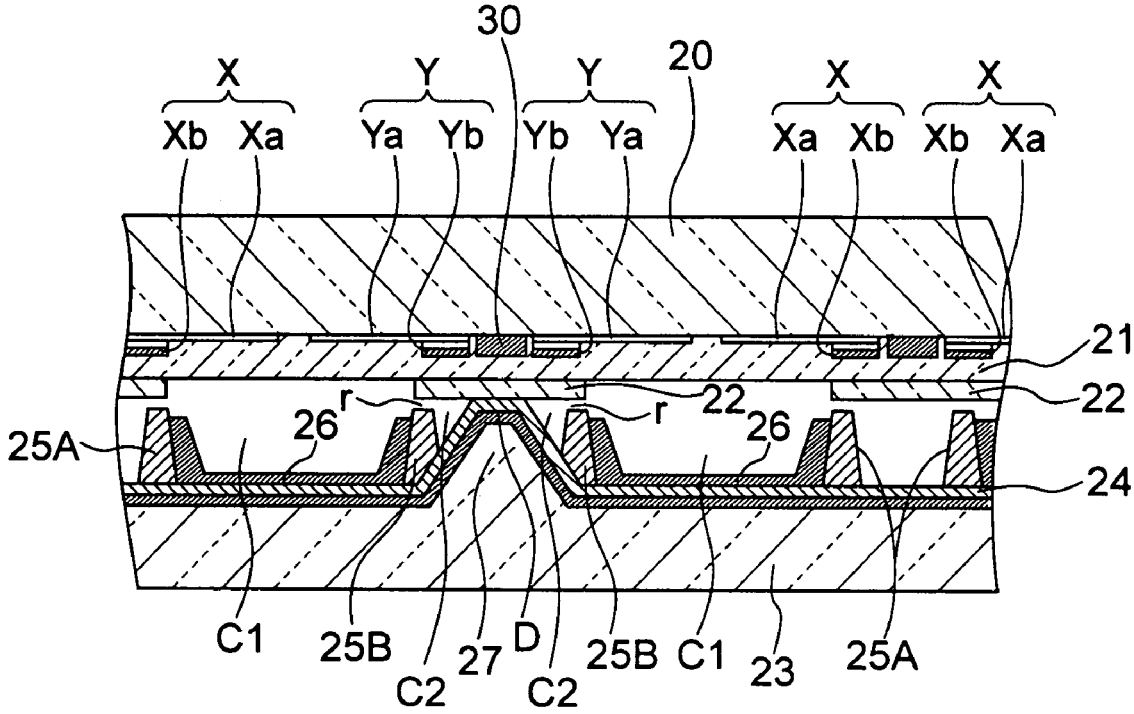
FIG. 44 is another cross-sectional view of the PDP 50 from a direction indicted by an arrow in FIG. 34.

For the waveforms of the reset pulses $RP_X$, $RP_Y$ applied in the reset stage R of the first subfield SF1 when the PDP 50 is driven with the employment of the selective write address method, those shown in FIG. 43 may be employed instead of those shown in FIG. 38.

In the reset stage R shown in FIG. 43, the X electrode driver 52 generates a negative reset pulse $RP_X'$ which is simultaneously applied to the respective row electrodes $X_1$–$X_n$. After the application of the reset pulse $PR_X'$, the X electrode driver 52 continuously applies a constant high voltage as shown in FIG. 43. Simultaneously with the application of the reset pulse $PR_X'$, the Y electrode driver 54 simultaneously applies the positive reset pulse $RP_Y'$ having the waveform as shown in FIG. 43 to the respective row electrodes $Y_1$–$Y_n$. Level transitions in rising sections and falling sections of the respective reset pulses $RP_X'$, $RP_Y'$ are slower than level transitions in the rising section and falling section of the sustain pulse IP. Further, the level transition in the falling section of the reset pulse $RP_Y'$ is slower than the level transition in the rising section of the reset pulse $RP_X'$. In response to the applications of the reset pulses $RP_X'$, $PR_Y'$, a reset discharge is produced in the control discharge cell C2 of each of all the pixel cells $PC_{1,1}$–$PC_{n,m}$. In other words, in response to the application of the reset pulses $RP_X'$, $RP_Y'$, the reset discharge is produced in each of all the pixel cells $PC_{1,1}$–$PC_{n,m}$ of the PDP 50. Specifically, at the rising of the reset pulse $RP_Y'$, a first reset discharge is produced between the portion of the column electrode D raised by the protruding rib 27 and the bus electrode Yb in the control discharge cell C2. Then, at the falling of the reset pulse $RP_Y'$, a second week reset discharge is produced between the transparent electrodes Xa and Yb in the display discharge cell C1, causing the wall charge remaining in the display discharge cell C1 to extinguish. Stated another way, all the pixel cells PC are initialized to the unlit cell state.

In FIG. 43, the variety of driving pulses applied in each of the address stage W, sustain stage I, and erasure stage E, and the timings at which the driving pulses are applied, are identical to those in FIG. 38, so that description thereon is omitted.

The driving control circuit 56 selects one from among (N+1) kinds of driving patterns as shown in FIG. 31 (or FIG. 32) in accordance with a luminance level indicated by an input video signal for driving the PDP 50. In other words, the driving control circuit 56 generates the pixel driving data bits DB1–DB(N) based on an input video signal to result in the driving state as shown in FIG. 31 or 32, and supplies the pixel driving data bits DB1–DB(N) to the address driver 55. Such driving enables a luminance level indicated by the input video signal to be represented at any of (N+1) intermediate luminance levels.

The foregoing embodiment has been described for the case where the PDP 50 is driven to emit light at (N+1) levels of gradation using (N+1) kinds of driving patterns as shown in FIG. 31 or 32 from $2^N$ different driving patterns represented by N subfields. The present invention however can be applied likewise to the driving of the PDP 50 to emit light at $2^N$ levels of gradation. In this event, when the selective write address method is employed to drive the PDP 50 to provide a gradation display at $2^N$ levels, the reset stage R may be performed only in the first subfield SF1.

In the foregoing embodiment, the black eminent portion 22A as shown in FIG. 35 is formed on the eminent dielectric layer 22 of the control discharge cell C2 in order to prevent discharge light from appearing on the image display surface through the front glass substrate 20. The present invention, however, is not limited to this feature. For example, instead of the black eminent portion 22A, a strip-shaped black light shielding layer 30 extending in the horizontal direction on the image display surface in a manner similar to the bus electrode Yb is formed between two adjacent black bus electrodes Yb. In this event, the protruding rib 27 is made higher than that shown in FIG. 7 to bring the column electrode protection layer 24 into contact with the eminent dielectric layer 22. With such a feature, light associated with a reset discharge or an address discharge produced in the control discharge cell C2 is shielded by the two black bus electrodes Yb and black light shielding layer 30, so that the light can be prevented from appearing on the image display surface through the front glass substrate 20.

As described above, in the present invention, the unit light emission region (pixel cell PC) in the display panel is comprised of a first discharge cell (display discharge cell C1) and a second discharge cell (control discharge cell C2) comprising a light absorbing layer. Then, a sustain discharge for emitting light to display an image is produced in the first discharge cell, while a variety of control discharges causing light emission not associated with a displayed image are produced in the second discharge cell.

Therefore, according to the present invention, light associated with control discharges such as the reset discharge and address discharge will not appear on the panel display surface, the contrast of a displayed image, particularly, the dark contrast can be improved when an image corresponding to a generally dark scene is displayed.

This application is based on Japanese Patent Applications Nos. 2001-279504, 2002-167802 and 2002-187466 which are herein incorporated by reference.

What is claimed is:

1. A display device for displaying an image corresponding to an input video signal in accordance with pixel data of each pixel based on said input video signal, comprising:

a display panel having a front substrate and a back substrate opposing each other across a discharge space, a plurality of row electrode pairs arranged on an inner surface of said front substrate, a plurality of column electrodes arranged on an inner surface of said back substrate to intersect with said row electrode pairs, and an unit light emission region formed at each of intersections of said row electrode pairs and said column electrodes and including a first discharge cell and a second discharge cell having a light absorbing layer;

addressing means for sequentially applying a scanning pulse to one row electrode of each said row electrode pair while sequentially applying each said column electrode with pixel data pulses corresponding to said pixel data one display line by one display line at the same timing as said scanning pulse to selectively produce an address discharge in said second discharge cell to set said first discharge cell to one of a lit cell state and an unlit cell state; and sustaining means for repeatedly applying a sustain pulse to each said row electrode pair to produce a sustain discharge only in said first discharge cell set in said lit cell state.

2. A display device according to claim 1, wherein said addressing means includes priming means for alternately applying a priming pulse with each of said row electrode pairs after said address discharge is produced to generate a priming discharge only in said first discharge cell in which said address discharge is produced to move a wall charge formed in said first discharge cell into said second discharge cell to set said second discharge cell to said lit cell state.

3. A display device according to claim 1, wherein said discharge space of each said unit light emission region is enclosed by a partition.

4. A display device according to claim 1, wherein said first discharge cell and said second discharge cell in said unit light emission region is partitioned by a horizontal wall lower than said partition, and said discharge space communicates through a gap formed between said horizontal wall and said front substrate.

5. A display device according to claim 1, further comprising a fluorescent layer formed only in said first discharge cell for emitting light through a discharge.

6. A display device according to claim 1, wherein each of the row electrodes constituting said row electrode pair comprises a bus electrode formed extending in the horizontal direction, and a protruding electrode end protrusively formed from a position on said bus electrode corresponding to each said column electrode to the other row electrode, said first discharge cell includes said protruding electrode end of each said row electrode forming part of said row electrode pair, and said second discharge cell includes said bus electrode of one row electrode in said row electrode pair, and said bus electrode of one row electrode in said row electrode pair adjacent to said row electrode pair.

7. A display device according to claim 1, further comprising resetting means for applying a reset pulse between one row electrode of said row electrode pair and one row electrode of an adjacent row electrode pair prior to said address discharge by said addressing means to produce a reset discharge in said second discharge cell.

8. A display device according to claim 7, wherein said resetting means temporally separately produces said reset discharge in said second discharge cell belonging to an odd-numbered display line and said reset discharge in said second discharge cell belonging to an even-numbered display line.

9. A display device according to claim 1, wherein said addressing means temporally separately produces said address discharge in said second discharge cell belonging to an odd-numbered display line and said address discharge in said second discharge cell belonging to an even-numbered display line.

10. A display device according to claim 7, wherein said reset pulse has a waveform with a slow level transition in a rising section and a falling section as compared with said sustain pulse.

11. A display device according to claim 1, further comprising erasing means for applying a first erasure pulse to one row electrode of said row electrode pair and applying a second erasure pulse to the other row electrode of said row electrode pair, after said sustain discharge by said sustaining means, to produce an erasure discharge in said first discharge cell and said second discharge cell.

12. A display device according to claim 1, further comprising:

wall charge moving means for applying a wall charge moving pulse to one row electrode of said row electrode pair to produce a discharge after said sustain discharge by said sustaining means, to move said wall charge formed in said first discharge cell into said second discharge cell to set said second discharge cell to said lit cell state; and erasing means for applying an erasure pulse to each of the row electrodes forming part of said row electrode pair after said wall charge moving means moves the wall charge to produce an erasure discharge only in said first discharge cell.

13. A method of driving a display panel having a front substrate and a back substrate opposing each other across a discharge space, a plurality of row electrode pairs arranged on an inner surface of said front substrate, a plurality of column electrodes arranged on an inner surface of said back substrate to intersect with said row electrode pairs, and an unit light emission region formed at each of intersections of said row electrode pairs and said column electrodes and including a first discharge cell and a second discharge cell having a light absorbing layer, in accordance with pixel data of each pixel based on an input video signal, said method comprising:

an address stage for sequentially applying a scanning pulse to one row electrode of each said row electrode pair while sequentially applying each said column electrode with pixel data pulses corresponding to said pixel data one display line by one display line at the same timing as said scanning pulse to selectively produce an address discharge in said second discharge cell to set said first discharge cell to one of a lit cell state and an unlit cell state; and a sustain stage for repeatedly applying a sustain pulse to each said row electrode pair to produce a sustain discharge only in said first discharge cell set in said lit cell state.

14. A method of driving a display panel according to claim 13, wherein said address stage includes a priming stage for alternately applying a priming pulse with each of said row electrode pairs after said address discharge is produced to produce a priming discharge only in said first discharge cell in which said address discharge is produced to move a wall charge formed in said first discharge cell into said second discharge cell to set said second discharge cell to said lit cell state.

15. A method of driving a display panel according to claim 13, further comprising a reset stage for applying a reset pulse between one row electrode of said row electrode pair and one row electrode of an adjacent row electrode pair prior to said address stage to produce a reset discharge in said second discharge cell.

16. A method of driving a display panel according to claim 13, wherein said reset stage includes an odd-numbered reset stage for producing said reset discharge in said second discharge cell belonging to an odd-numbered display line, and an even-numbered reset stage for producing said reset discharge in said second discharge cell belonging to an even-numbered display line.

17. A method of driving a display panel according to claim 13, wherein said address stage includes an odd-numbered address stage for producing said address discharge in said second discharge cell belonging to an odd-numbered display line, and an even-numbered address stage for producing said address discharge in said second discharge cell belonging to an even-numbered display line.

18. A method of driving a display panel according to claim 13, wherein said reset pulse has a waveform with a slow level transition in a rising section and a falling section as compared with said sustain pulse.

19. A method of driving a display panel according to claim 13, further comprising a erasure stage for applying a first erasure pulse to one row electrode of said row electrode pair and applying a second erasure pulse to the other row electrode of said row electrode pair, after said sustain stage, to produce an erasure discharge in said first discharge cell and said second discharge cell.

20. A method of driving a display panel according to claim 13, further comprising:

a wall charge moving stage for applying a wall charge moving pulse to one row electrode of said row electrode pair to produce a discharge after said sustain stage, to move said wall charge formed in said first discharge cell into said second discharge cell to set said second discharge cell to said lit cell state; and an erasure stage for applying an erasure pulse to each of the row electrodes forming part of said row electrode pair to produce an erasure discharge only in said first discharge cell.

* * * * *